US009380884B2

(12) United States Patent
Lawlor et al.

(10) Patent No.: US 9,380,884 B2
(45) Date of Patent: Jul. 5, 2016

(54) CRIB

(71) Applicant: Foundations Worldwide, Inc., Medina, OH (US)

(72) Inventors: Joseph A. Lawlor, Medina, OH (US); Robert L. Houry, Willowick, OH (US); Jason Biter, Medina, OH (US); David E. Campbell, Westfield Center, OH (US); Alan L. Lytle, Campbellsburg, IN (US)

(73) Assignee: FOUNDATIONS WORLDWIDE, INC, Medina, OH (US)

( * ) Notice: Subject to any disclaimer, the term of this patent is extended or adjusted under 35 U.S.C. 154(b) by 387 days.

(21) Appl. No.: 13/804,030

(22) Filed: Mar. 14, 2013

(65) Prior Publication Data

US 2014/0115779 A1 May 1, 2014

Related U.S. Application Data

(63) Continuation-in-part of application No. 13/268,249, filed on Oct. 7, 2011, now Pat. No. 8,806,687, which is a continuation-in-part of application No. 13/268,021, filed on Oct. 7, 2011, now Pat. No. 8,646,127, (Continued)

(51) Int. Cl.

| | |
|---|---|
| ***A47D 7/02*** | (2006.01) |
| ***A47D 13/06*** | (2006.01) |
| ***A47D 7/00*** | (2006.01) |

(52) U.S. Cl.

CPC *A47D 7/002* (2013.01); *A47D 7/02* (2013.01); *A47D 13/065* (2013.01)

(58) Field of Classification Search

CPC ..... A47D 7/002; A47D 7/02; A47D 9/00; A47D 9/005; A47D 13/00; A47D 13/06; A47D 13/061; A47D 13/065; A47D 15/003; A47D 15/008; E05D 5/0223; E05D 5/023; E05D 5/0238

See application file for complete search history.

(56) References Cited

U.S. PATENT DOCUMENTS

| | | | | |
|---|---|---|---|---|
| 586,333 | A | | 7/1897 | Dornan |
| 1,211,762 | A | | 1/1917 | Sawyer |
| 1,440,943 | A | | 1/1923 | Szabo |
| D69,241 | S | | 1/1926 | Stuart |
| 1,675,375 | A | | 7/1928 | Netschert |
| 1,678,237 | A | * | 7/1928 | Vallone ..... 5/100 |
| D78,863 | S | | 6/1929 | Stuart |
| 2,059,058 | A | | 10/1936 | Swanson |

(Continued)

FOREIGN PATENT DOCUMENTS

GB 2061099 A 5/1981

OTHER PUBLICATIONS

Convertible "Kathryn" Crib Instruction Sheet, Jun. 2003.

*Primary Examiner* — Nicholas Polito
(74) *Attorney, Agent, or Firm* — Walker & Jocke

(57) ABSTRACT

A crib including first, second, third, and fourth walls configured to bound an interior space that is operative to support a mattress therein. Each of the third and fourth walls includes a pair of panels pivotally connected to each other to enable the crib to be configured between a folded position for storage and an extended position for use. The first wall includes a stationary portion and a drop gate that includes opposed side ends. The drop gate pivots relative to the stationary portion between an upper closed position and a lower open position.

16 Claims, 40 Drawing Sheets

Related U.S. Application Data application No. 13/804,030, which is a continuation-in-part of application No. 13/268,086, filed on Oct. 7, 2011, now Pat. No. 8,572,775.

(60) Provisional application No. 61/507,918, filed on Jul. 14, 2011, provisional application No. 61/407,326, filed on Oct. 27, 2010, provisional application No. 61/659,643, filed on Jun. 14, 2012.

(56) References Cited

U.S. PATENT DOCUMENTS

| | | | | | |
|---|---|---|---|---|---|
| 2,132,988 | A | | 10/1938 | Leibo | |
| 2,135,517 | A | | 11/1938 | Isbell et al. | |
| 2,200,250 | A | | 5/1940 | Atwood | |
| 2,200,440 | A | | 5/1940 | Atwood | |
| 2,372,431 | A | | 3/1945 | Kahle | |
| 2,536,357 | A | | 1/1951 | David | |
| 2,553,579 | A | | 5/1951 | Harris | |
| 2,561,637 | A | | 7/1951 | Rex | |
| D168,681 | S | | 1/1953 | Feldman | |
| 2,781,527 | A | | 2/1957 | Landry | |
| 3,002,199 | A | | 10/1961 | Galloway | |
| D207,484 | S | | 4/1967 | Amdal | |
| 3,590,403 | A | | 7/1971 | Mixon | |
| 3,634,894 | A | | 1/1972 | Harbison | |
| D235,713 | S | | 7/1975 | Donner | |
| 3,896,513 | A | * | 7/1975 | Boucher et al. | 5/99.1 |
| 3,934,282 | A | | 1/1976 | Bryant | |
| 4,105,271 | A | * | 8/1978 | Sebel | A47B 41/02 108/124 |
| 4,231,135 | A | | 11/1980 | Fradin | |
| D272,040 | S | | 1/1984 | Scanlan | |
| D274,877 | S | | 7/1984 | Mower et al. | |
| 4,483,026 | A | | 11/1984 | Kassai | |
| 4,530,528 | A | | 7/1985 | Shamie | |
| 4,535,493 | A | | 8/1985 | Guillot | |
| 4,715,075 | A | | 12/1987 | Shamie | |
| 4,752,977 | A | | 6/1988 | Smith et al. | |
| 4,765,004 | A | | 8/1988 | Kessel | |
| 4,768,243 | A | | 9/1988 | Waples | |
| D298,708 | S | | 11/1988 | Nygren | |
| 5,038,427 | A | * | 8/1991 | Golden | A47D 7/01 5/208 |
| 5,040,254 | A | | 8/1991 | Frank | |
| 5,068,932 | A | | 12/1991 | Chang | |
| 5,072,464 | A | | 12/1991 | Draheim et al. | |
| 5,077,846 | A | | 1/1992 | Wheeler, III et al. | |
| 5,173,974 | A | * | 12/1992 | Proano et al. | 5/93.2 |
| 5,201,085 | A | | 4/1993 | Shamie | |
| D356,452 | S | | 3/1995 | Proano et al. | |
| D357,607 | S | | 4/1995 | Nilsson | |
| D366,778 | S | | 2/1996 | Pollard | |
| 5,715,551 | A | | 2/1998 | Proano et al. | |
| 5,926,870 | A | | 7/1999 | Branca-Barnes et al. | |
| 6,014,781 | A | | 1/2000 | Cone, II | |
| 6,088,851 | A | | 7/2000 | Draheim | |
| D429,431 | S | | 8/2000 | Zaidman | |
| 6,651,275 | B1 | | 11/2003 | Rummell | |
| 6,817,046 | B1 | | 11/2004 | Srour | |
| 6,907,627 | B2 | | 6/2005 | Waldman et al. | |
| 7,376,986 | B2 | | 5/2008 | Smith et al. | |
| 7,415,740 | B1 | | 8/2008 | Kemper | |
| D586,589 | S | | 2/2009 | Magnusson | |
| D597,345 | S | | 8/2009 | Oshinomi et al. | |
| D603,628 | S | | 11/2009 | Towater et al. | |
| D604,065 | S | | 11/2009 | Towater et al. | |
| 7,614,097 | B1 | | 11/2009 | Cheng | |
| D611,324 | S | | 3/2010 | Dawson | |
| D619,376 | S | | 7/2010 | Schopmeyer | |
| 7,752,689 | B1 | | 7/2010 | Shamie et al. | |
| D623,041 | S | | 9/2010 | Ayrest | |
| D625,576 | S | | 10/2010 | Oshima | |
| D628,409 | S | | 12/2010 | Anzai | |
| 8,572,775 | B1 | * | 11/2013 | Biter et al. | 5/100 |
| 8,745,781 | B1 | * | 6/2014 | Biter et al. | 5/100 |
| 2004/0154099 | A1 | * | 8/2004 | Waters | A47D 7/00 5/424 |
| 2007/0101493 | A1 | | 5/2007 | Campbell et al. | |
| 2009/0300957 | A1 | * | 12/2009 | Krinke | G09F 21/04 40/606.01 |

* cited by examiner

CRIB

CROSS-REFERENCE TO RELATED APPLICATIONS

This application is a continuation-in-part of U.S. application Ser. No. 13/268,249 filed Oct. 7, 2011, which claims benefit under 35 U.S.C. §119(e) of Provisional Application No. 61/507,918 filed Jul. 14, 2011.

This application is a continuation-in-part of U.S. application Ser. No. 13/268,021 filed Oct. 7, 2011, which claims benefit under 35 U.S.C. §119(e) of Provisional Application No. 61/507,918 filed Jul. 14, 2011.

This application is a continuation-in-part of U.S. application Ser. No. 13/268,086 filed Oct. 7, 2011, which claims benefit under 35 U.S.C. §119(e) of Provisional Application No. 61/407,326 filed Oct. 27, 2010.

This application claims benefit under 35 U.S.C. §119(e) of Provisional Application No. 61/659,643 filed Jun. 14, 2012. The disclosure of each of these is incorporated herein by reference in its entirety.

BACKGROUND

A crib is designed to hold a child therein. Cribs for children typically include a mattress surrounded by walls that are sufficiently high to prevent a child from falling or climbing out of the crib. The walls of the crib may be comprised of vertical slats, rails, posts, boards, and any other elements operative to form a barrier that keeps a child within the interior space of the crib.

There is a need for improvement to existing cribs.

SUMMARY

The following is a brief summary of subject matter that is described in greater detail herein. This summary is not intended to be limiting as to the scope of the claims.

Described herein are various technologies relating to cribs which enable an adult to more easily and safely move a child into and out of the crib. Also described herein are various technologies which enhance the durability and strength of the crib, such as when the crib is used to move children during emergency evacuations.

In an example embodiment, a crib is provided that includes first, second, third, and fourth walls configured to bound an interior space that is operative to support a mattress therein. Each of the third and fourth walls includes a pair of panels pivotally connected to each other to enable the crib to be configured between a folded position for storage and an extended position for use. The first wall includes a stationary portion and a drop gate that includes opposed side ends. The drop gate pivots relative to the stationary portion between an upper closed position and a lower open position.

Other aspects of embodiments described herein will be appreciated upon reading and understanding the attached figures and description.

DETAILED DESCRIPTION

Figure 1:
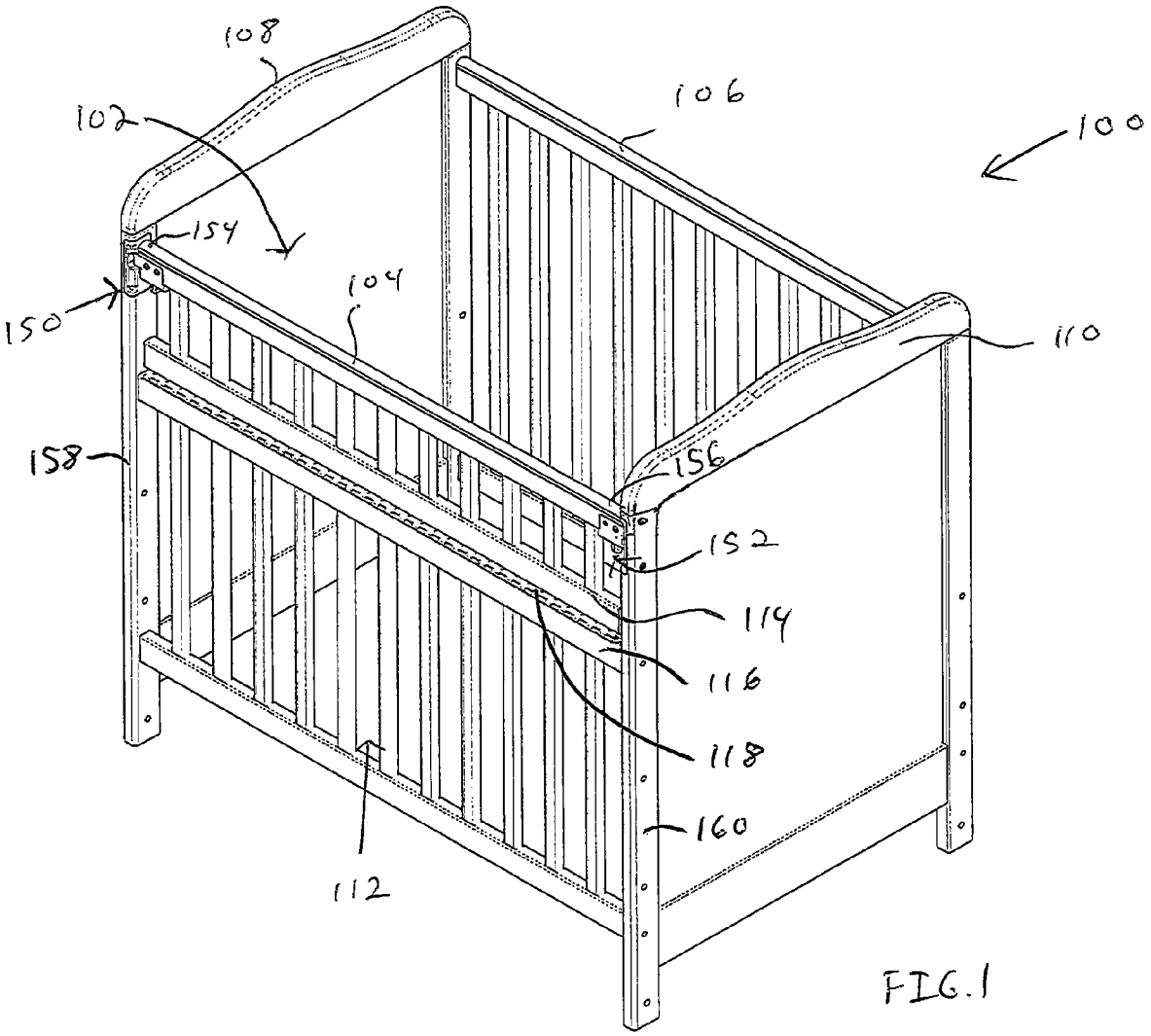
FIG. 1 is an upper perspective view of an example embodiment of a crib that includes a drop gate in an upper closed position.

Various technologies pertaining to cribs will now be described with reference to the drawings, where like reference numerals represent like elements throughout. In addition, several functional block and schematic diagrams of example devices are illustrated and described herein for purposes of explanation. However, it is to be understood that functionality that is described as being carried out by certain components, members, and devices may be performed by multiple components, members, and devices. Similarly, for instance, a component/member/device may be configured to perform functionality that is described as being carried out by multiple components/members/devices.

With reference to FIG. 1, an example embodiment of a crib 100 for use with a child (e.g., a baby or toddler) is illustrated. The crib includes an interior space 102 that is bounded by four walls 104, 106, 108, 110. A bottom portion 112 of the interior of the crib may include slats, a board, frame, and/or other types of support members that are capable of supporting a mattress. The walls of the crib may be comprised of vertical slats, rails, posts, boards, and any other elements operative to form a barrier that keeps a child within the interior space. These described elements of the crib may be made out of materials such as wood, plastic, metal, and combinations thereof and/or other materials operative to form a barrier. Also one or more of these described elements of the crib may be integrally formed and/or may be fastened together via fasteners (e.g., screws, bolts, clips, adhesives).

Figure 2:
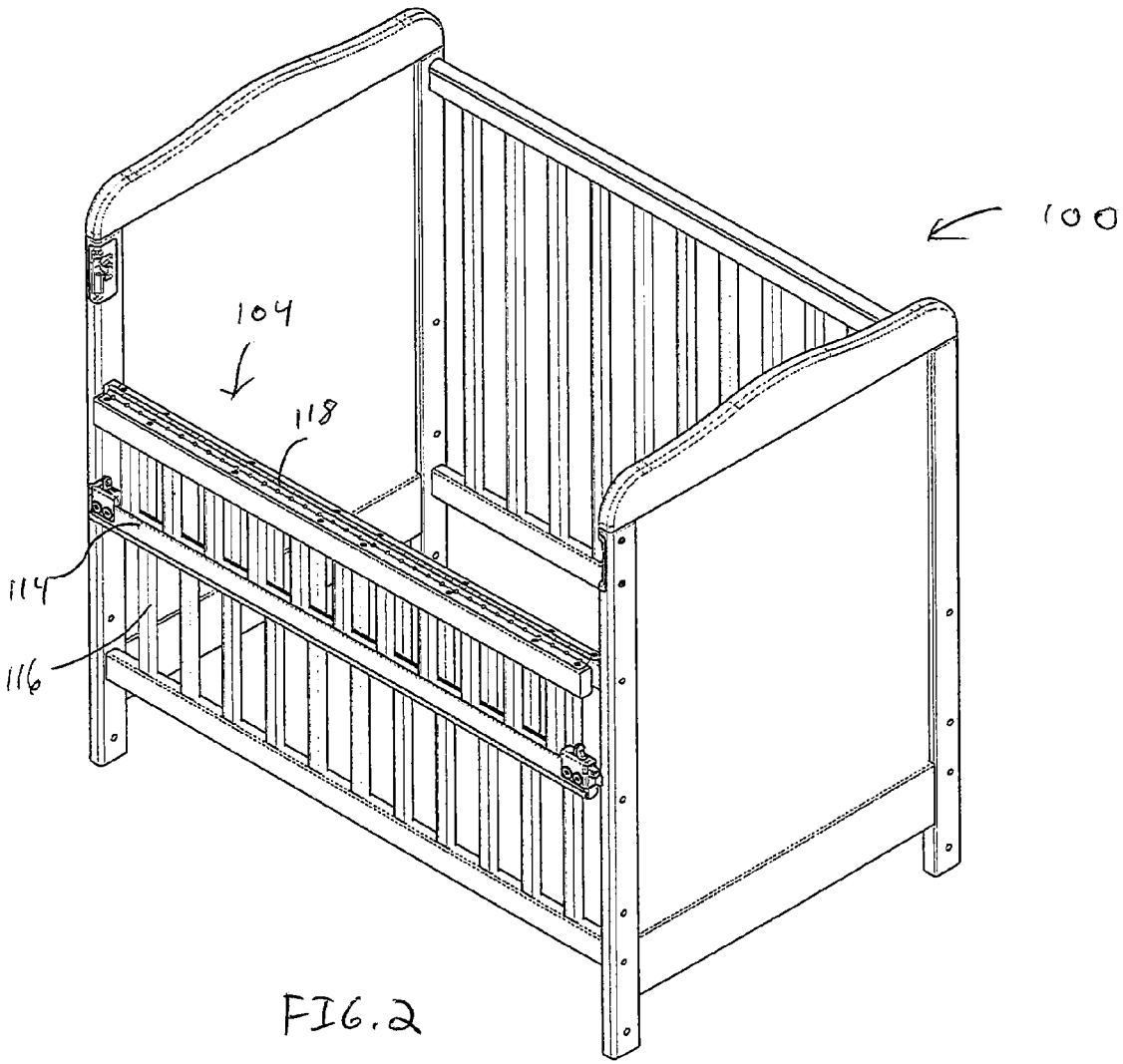
FIG. 2 is an upper perspective view of the example crib in which the drop gate is in the lower open position.

In an example embodiment, at least one wall of the crib may include a pivoting drop gate. In the example shown in FIG. 1, the front wall 104 includes a drop gate 114 which is in an upper closed position. As illustrated in FIG. 2, the drop gate 114 is operatively configured to pivot downwardly with respect to a lower stationary portion 116 of the wall 104, from the upper closed position (shown in FIG. 1) to a lower open position (shown in FIG. 2). In the lower open position of the drop gate 114, the height of the wall 104 is shorter. As a result, an adult may more easily move a child into and out of the crib over the shorter wall. Also, it should be appreciated that in alternative embodiments, additional walls of the crib may include a drop gate. For example, in a further alternative embodiment, both the front and back walls 104, 106 may include drop gates.

In example embodiments, the drop gate includes features which minimize harm to a child in the crib (as well as to adults outside the crib). For example, to enable the drop gate 114 to pivot relative to the lower stationary portion 116, the crib may include at least one hinge 118 positioned between the drop gate 114 and the stationary portion of the wall. Such a hinge may correspond to at least one elongated piano hinge or one or more of any other type of hinges that are capable of enabling the drop gate to pivot with respect to the stationary portion of the wall.

Figure 3:
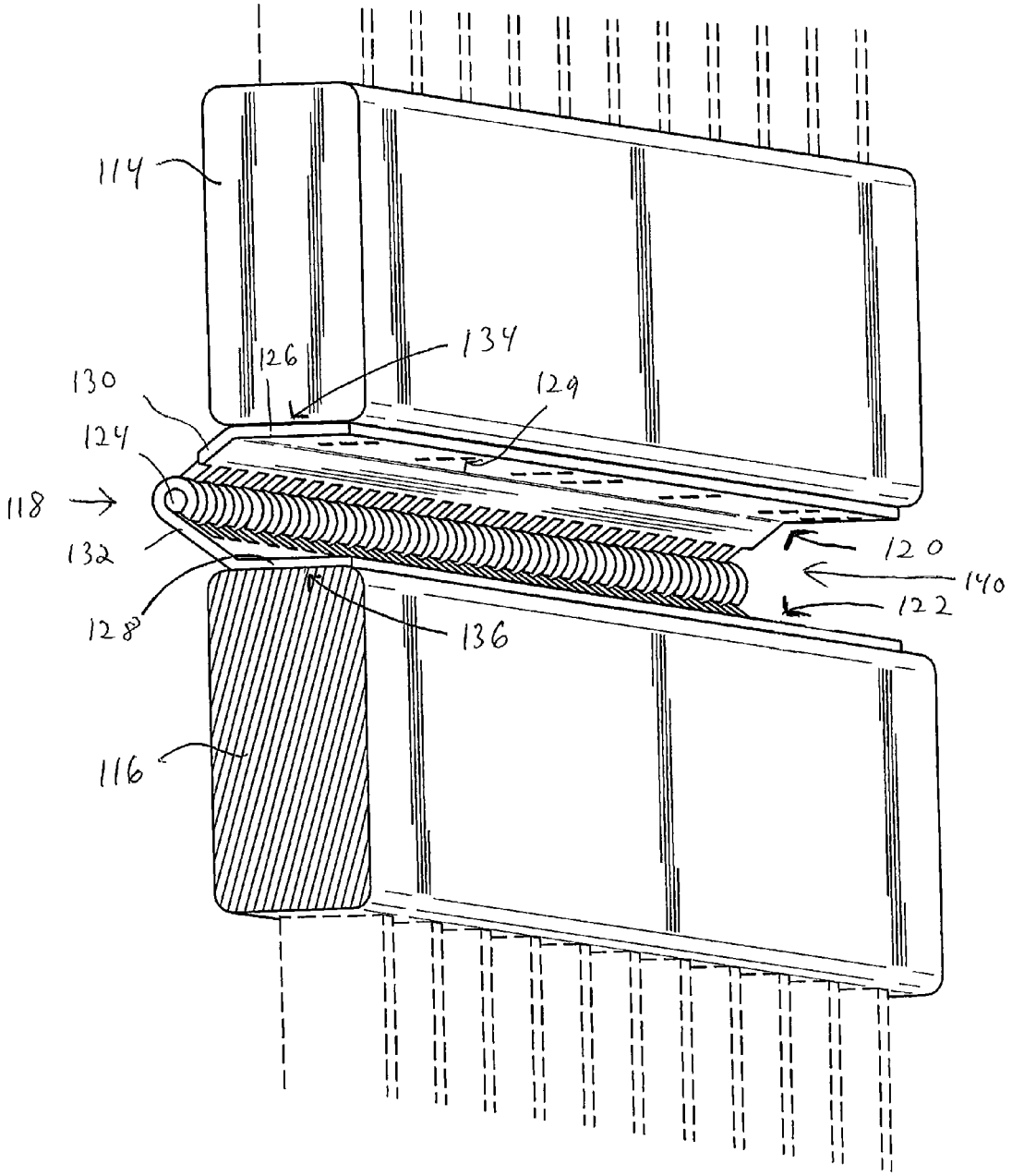
FIG. 3 is a perspective view of an example embodiment of an inside portion of the drop gate in the upper closed position.
Figure 4:
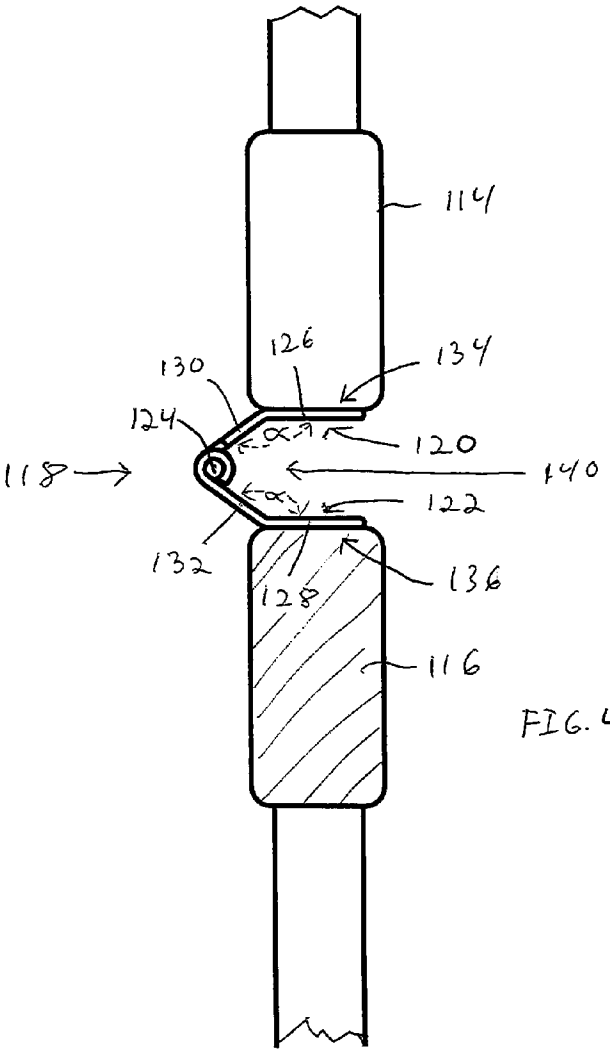
FIG. 4 shows a cross-sectional view of an example embodiment of the drop gate in the upper closed position.

As shown in FIG. 2, (with the drop gate in the lower open position), a child may be able to place their fingers on top of the opened hinge 118. As the drop gate is moved to the upper closed position shown in FIG. 1), an example embodiment of the hinge 118 may be configured to move into a C-shaped form (as illustrated in FIGS. 3 and 4) or other shape, which provides a cavity 140 therein with sufficient space for fingers to extend therein to the back of the hinge without being pinched in the hinge. Thus, when the drop gate is moved to the closed position, fingers resting on top of the hinge will not be pinched. Rather the drop gate may push the fingers away from the hinge 118, and/or may push the fingers into the cavity 140 of the C-shaped form of the hinge.

As illustrated in FIG. 3 (an inside perspective view) and FIG. 4 (a cross-sectional plan view), the hinge 118 includes an angled first hinge member 120 and an angled second hinge member 122. These first and second hinge members include mounted ends 126, 128 that are respectively attached via fasteners 129 (e.g., screws, bolts, nails, barbed projections, and/or other fasteners) to the corresponding ends 134, 136 of the drop gate 114 and stationary portion 116. As shown in FIG. 4, the mounted ends 126, 128 are generally orientated horizontally when the drop gate is in the upper closed position.

In addition the first and second hinge members 120, 122 also include pivot ends 130, 132 that are joined together in operatively pivoting connection at a pivot axis 124. Such a pivot axis 124 may include a shaft or other pivot member about which the first and/or second hinge members 120, 122 rotate with respect thereto.

To produce the C-shaped form (in the closed position of the drop gate), the pivot ends are bent (with respect to the mounted ends) so as to place the pivot axis 124 both between and vertically disposed away from each of the mounted ends 126, 128. This configuration places the mounted ends 126, 128 in spaced apart relation in a vertical direction and forms the cavity 140 therein.

This described cavity 140 formed by the C-shaped form of the hinge, has a sufficient height to enable a human finger of at least a child (and/or an adult) to extend therein to the pivot axis 124 without being pinched (e.g., compressed). For example, the cavity may have a height from 1 to 2 cm. However, it should be appreciated that in alternative embodiments, the cavity may have other sizes and shapes depending on the expected finger sizes of the children and/or adults that may come in contact with the hinge 118.

In an example embodiment, each of the first and second hinge members 120, 122 are bent such that the mounted and pivot ends are orientated with respect to each other at an oblique angle $\alpha$ that is less than 180 degrees and greater than 90 degrees (on the side of the hinge facing toward an interior of the crib when the drop gate is in the closed position). Also it should be appreciated that the bent portion of the first and second hinge members between the mounted end and the pivot end may be sharp (e.g., pointed bend) or relatively more gradual (e.g., rounded/curved bend).

Figure 5:
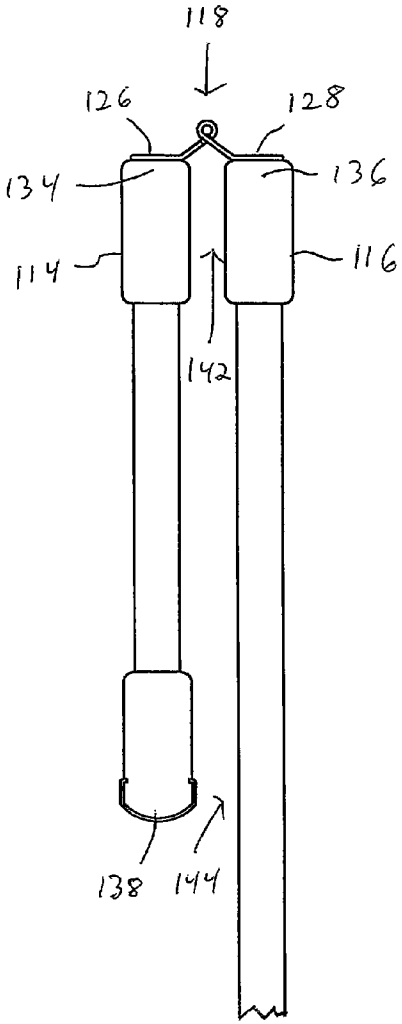
FIG. 5 shows a cross-sectional view of an example embodiment of the drop gate in the lower open position.

FIG. 5 shows a cross-sectional view of the hinge 118 when the drop gate 114 is in the lower open position. In this orientation of the hinge 118, the mounted ends 126, 128 of the hinge are spaced apart in a horizontal direction. As a result the end 134 of the drop gate 114 (that is mounted to the hinge 118) is spaced apart in a horizontal direction from the end 136 of the stationary portion 116 of the wall (that is mounted to the hinge 118). Also, a gap 142 is formed between the drop gate 114 and stationary portion 116 that has a sufficient width to enable a human finger of at least a child (and/or an adult) to extend therein without being pinched when the drop gate is lowered. This gap 142 may extend vertically downwardly from the hinge 118. However, in example embodiments (depending on the size of the hinge and the length of the drop gate) the gap 142 may not extend along the entire length of the drop gate 114. For example, gravity may pull the drop gate 114 into an orientation that tilts the opposed end 138 (e.g., a hand rail) of the drop gate 114 inwardly (relative the vertical direction) to be nearer and/or to contact the side surfaces 144 of the stationary portion of the wall. However, even though in some embodiments the gap 142 may narrow toward the handrail 138 of the drop gate, as can be appreciated, the formation of the gap via the described orientation of the hinge 118, minimizes pinching of fingers for at least a portion of the length of the drop gate 114 when it is in the lower open position.

Referring back to FIG. 1, an example embodiment of the crib may include further features that are operative to reduce the opportunity for fingers of a child or adult from being pinched by the closing of the drop gate. For example, an example embodiment of the crib 100 may include two latch devices 150, 152 on opposed side ends 154, 156 of the drop gate 114 and adjacent portions of vertical members 158, 160 that bound the opposed side ends 154, 156 of the drop gate. As shown in FIG. 1, such vertical members 158, 160 may correspond to posts and/or side ends of the side walls 108, 110 of the crib. However, it should be appreciated that in alternative embodiments, the drop gate 114 may have a width that is less than the stationary portion 116. In such an embodiment, the vertical members that bound the side ends 154, 156 of the drop gate may correspond to portions of the front wall 110 (such as posts) that extend upwardly from the stationary portion 116 of the front wall 104.

Figure 6:
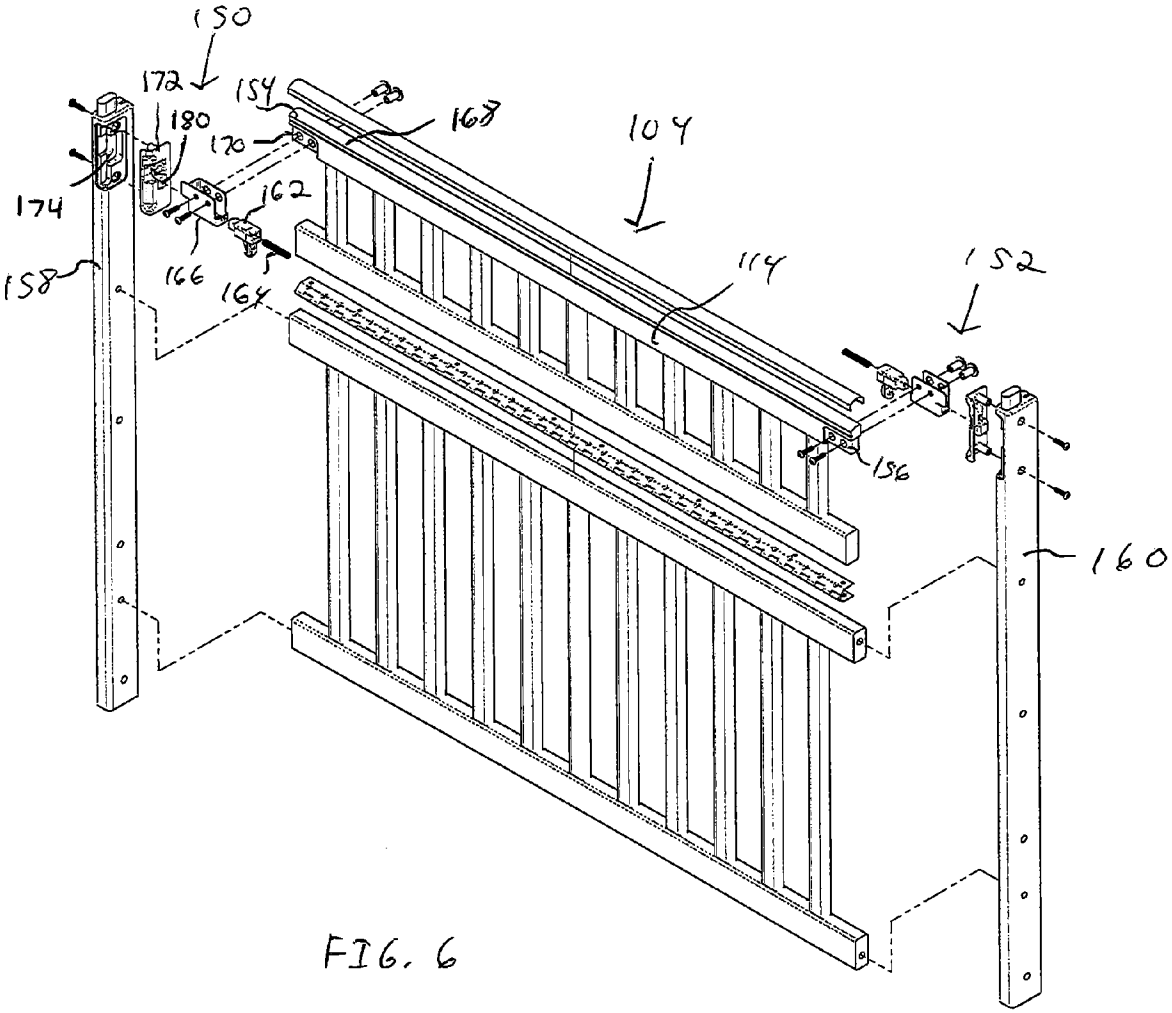
FIG. 6 shows an exploded view of a portion of an example embodiment of the crib.

FIG. 6 shows an exploded view of the front wall 104 and vertical members 158, 160 of the crib. Here the elements of the latch device 150 are discussed. However, it is to be understood that corresponding elements are included in latch device 152. In an example embodiment, the latch device 150 may include a bolt 162 in movable connection with the side end 154 of the drop gate 114. Such a bolt may be biased (e.g., via a spring 164 or other biasing device) to urge the bolt 162 to move outwardly from the side end 154 of the drop gate into engagement with the vertical post 158.

In order to mount the bolt 162 in movable relation with the side end 154 of the drop gate 114, the crib may include a bracket 166 mounted to the side end 154 of the drop gate (via screws, bolts or other fasteners). The bracket 166 may include a cavity therein for receiving the bolt 162 in sliding engagement therein and in sliding engagement relative to the side end 154 of the drop gate.

In the example embodiment of the crib shown in FIG. 6, the described side end 154 may correspond to the ends of an upper hand rail 168 of the drop gate. Such an upper handrail may be comprised of wood, plastic, or other material that is cut (or otherwise formed) to include recesses 170 on either side of the handrail. The recesses may have a sufficient size and shape to receive the bracket 166 mounted therearound such that outer vertical surfaces of the bracket are substantially flush with outer vertical surfaces of the handrail. However, it should be appreciated that in alternative embodiments, the side end of the crib may include a bracket that mounts the bolt in different locations, and/or configurations with respect to the side end 154 of the drop gate.

In an example embodiment, the vertical member 158 may be comprised of wood, plastic, or other material that is cut (or otherwise formed) to include a recess 174. The recess 174 in the vertical member 158 may have a sufficient size and shape to receive a striker plate 172 mounted therein. Such a striker plate may be comprised of a durable material such as brass, stainless steel or other metal or material.

Figure 7:
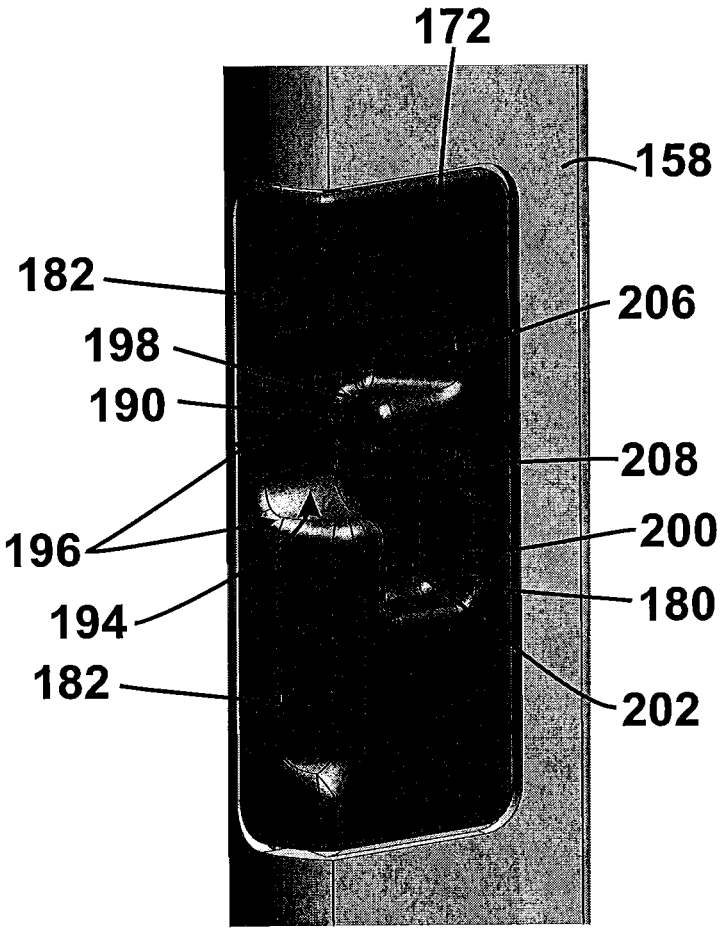
FIG. 7 shows a perspective view of an example embodiment of a striker plate of the crib.

As shown in FIG. 7, the striker plate may include a cavity 180 which is operative to receive an end of the bolt therein (when the drop gate is in the upper closed position). The striker plate may also have a vertical beveled edge surface 182 (e.g., which is chamfered, sloped or and/or rounded) positioned on a forward vertical edge of the vertical member 158. When the drop gate is moved from the lower open position (shown in FIG. 2) to the upper closed position (shown in FIG. 1), the described bolt is operative to slide along and against the lower beveled edge surface 182 and be pushed inwardly (i.e., into the described bracket). When the drop gate reaches its closed position, the bolt will be allied with the cavity 180 and be pushed therein via the spring.

It should be appreciated that if a finger or hand of a child is placed on the striker plate when the drop gate is closed, the beveled edge surface 182 may be operative to minimize injuries by eliminating sharp edges where a finger or hand may be caught. The vertical member 158 above and/or below the striker plate may also include a corresponding beveled edge.

Figure 8:
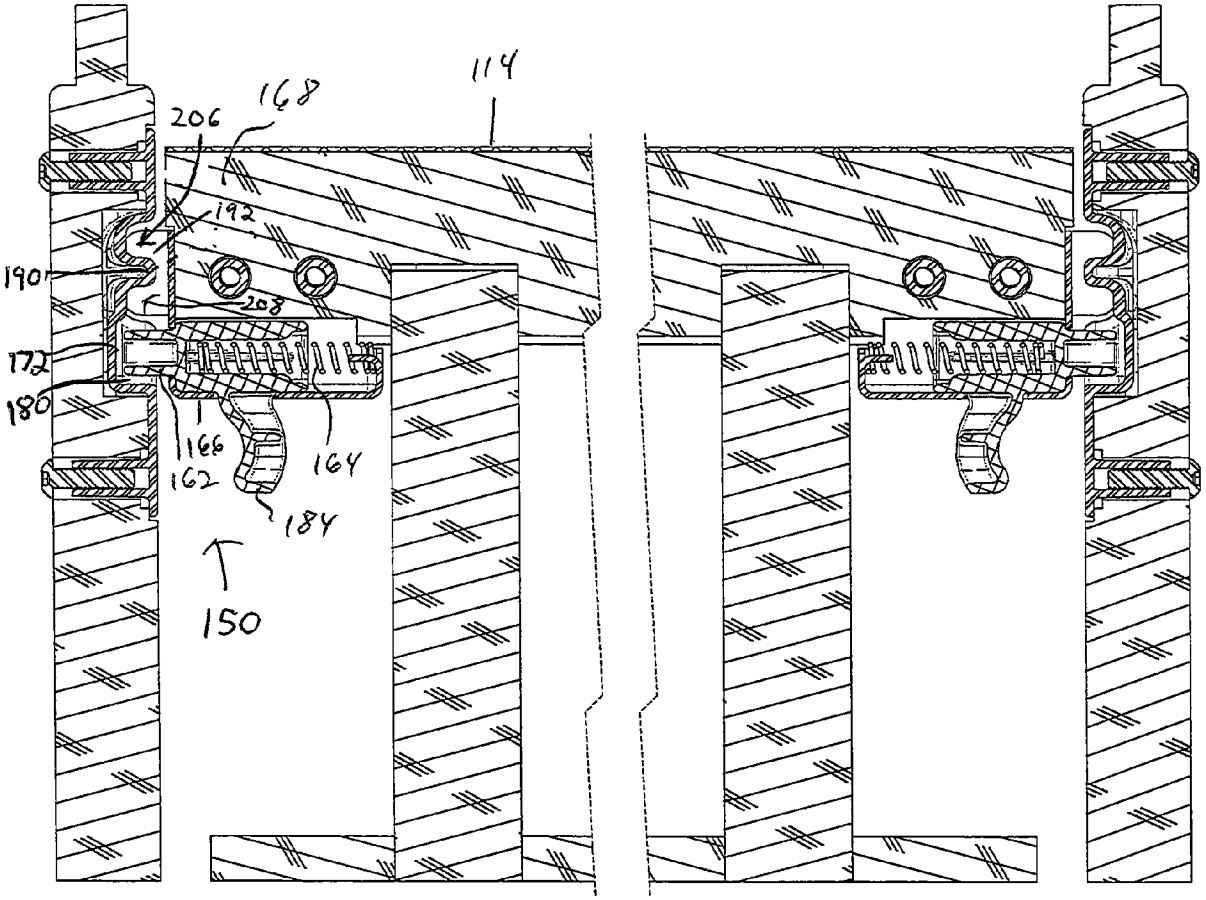
FIGS. 8-9 show cross-sectional views of an example embodiment of a latch device and the striker plate of the crib.

FIG. 8 shows a cross-sectional view of the latch device 150, with the bolt 162 in an orientation in which it has been urged via the spring 164 to project into the cavity 180 of the striker plate 172. In this orientation, the drop gate is not capable of being pivoted downwardly out of the upper closed position shown in FIG. 1 to the lower open position shown in FIG. 2.

As illustrated in FIG. 8, the bolt 162 may include an integral handle 184. Also, the bracket 166 may include a lower slot through which the handle extends downwardly to enable a human finger to have access to push the bolt inwardly so as to no longer project in the cavity 180.

Figure 9:
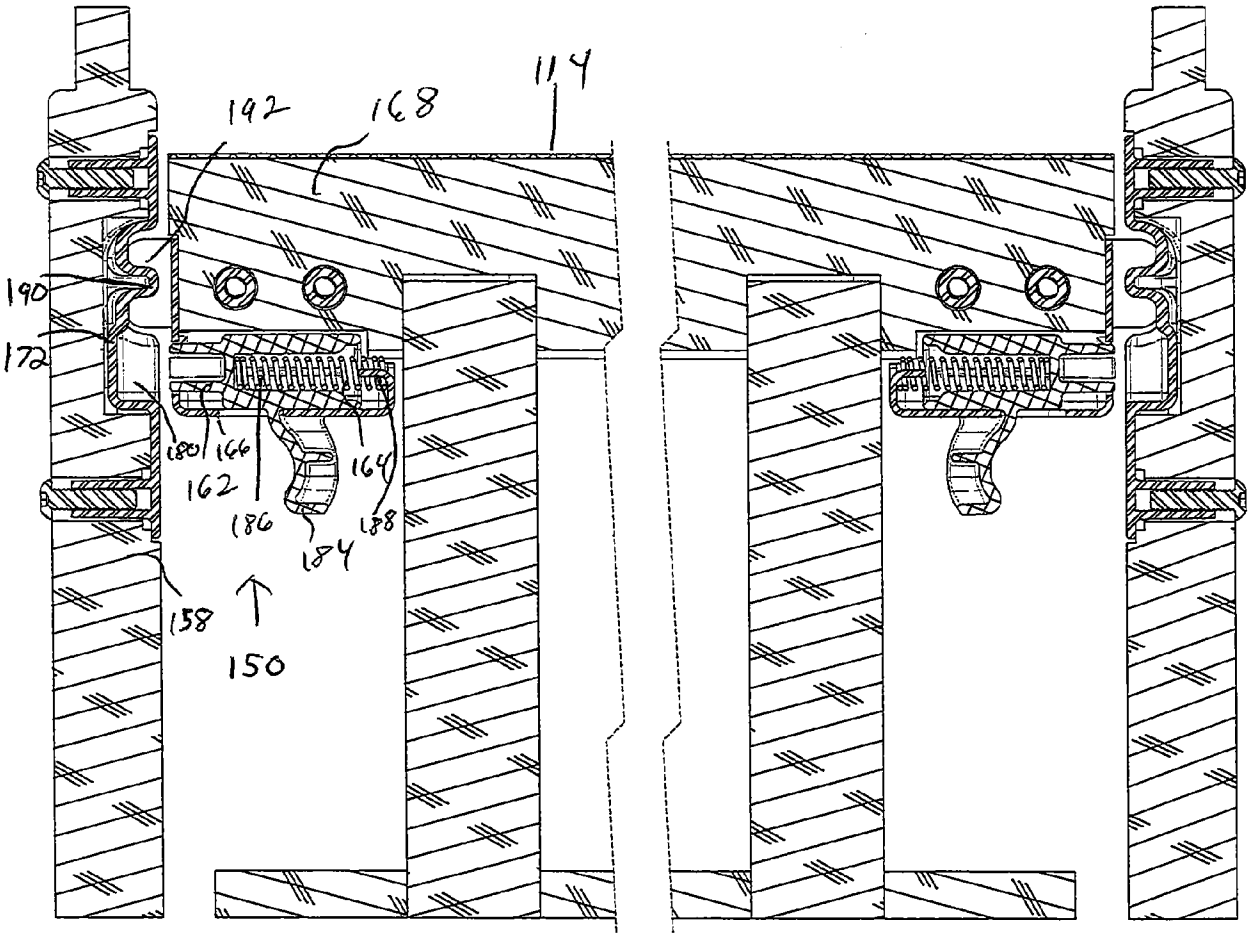

FIG. 9 shows an example of the latch device 150 in which the handle 184 of the bolt 162 has been moved inwardly (thereby further compressing the spring 164). In this orientation, the drop gate is capable of being pivoted downwardly to move to the lower closed position shown in FIG. 2. Also, as shown in FIG. 9, the described bolt 162 may include a bore 186 therein which includes a portion of the spring 164 therein. In this example, the bracket 166 may include an inward hook 188 that is operative to extend through an end of the spring 164 that extends out of the bore 186 in the bolt 162.

Figure 10:
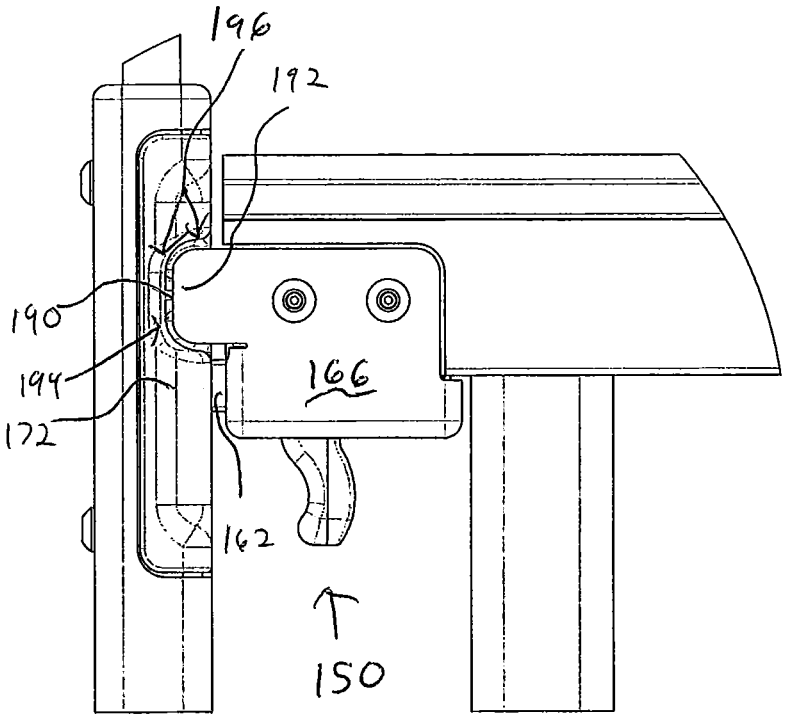
FIG. 10 shows a front plan view of an example embodiment of the latch device and the striker plate of the crib.

In order to stop the drop gate from pivoting into the interior space of the crib, the described striker plate 172 may include a projection 190 within the cavity 180 that is operative to contact a stop surface (e.g., a tab) 192 of the bracket 166 (when the drop gate is in the upper closed position). To further illustrate this arrangement, FIG. 10 shows a front side plan view of the described lock device 150, in which the tab 192 of the bracket 166 is in contact with the projection 190 of the striker plate 172. Also FIG. 10 shows the bolt 162 projecting into the cavity of the striker plate 172.

When the described crib is in use holding a child that is operative to stand up in the crib, it should be appreciated that such a child may be capable of placing his/her hands near the striker plate 172 (when the drop gate is in the lower open position). In order to minimize pinching of fingers in the latch device (when the drop gate is moved to the upper closed position), the described striker plate includes various beveled surfaces and spaces on and around the projection 190 which are operative to urge the child's fingers out of the path of portions of the latch device that could pinch the child's fingers.

For example, referring back to FIG. 7, the striker plate 172 may include a channel 194 adjacent the projection 190. As shown in FIG. 10, the tab 192 of the bracket may pass into and along the channel 194 in order to contact the projection 190. Also, as shown more clearly in FIG. 7, the channel may include beveled edges 196 (at the transition between inner surfaces of the channel 194 and the previously described beveled surface 182). As shown in FIG. 10, these beveled edges 196 bounding the inner surfaces of channel 194 have a generally C-shaped configuration which extends partially around the tab 192. However, as shown in FIG. 7, it should be appreciated that the beveled edges 196 of the channel 194 follow the slope of the beveled surface 182 and extend to the cavity 180.

If a child places his/her fingers adjacent these beveled surfaces, the child's fingers may still be contacted by the tab 192 (when the drop gate is closed). However, the injury to the child may be significantly minimized as a result of the edges 196 along the cavity 194 being beveled rather than squared off and sharp.

As shown in FIG. 8, in an example embodiment, the portion of projection 190 (that is contacted by the tab 192), has a size that is smaller than the facing surface area of the tab 192. In this described configuration of the striker plate, the cavity 180 includes ramp portions 206, 208 that extend in spaces of the cavity on either side of (above and below) the projection 190. These ramp portions 206, 208 extend adjacent the tab 192 (when the drop gate is in the closed position) and are angled (at an acute angle relative to the tab 192) such that when the drop gate closes, the tab 192 urges a finger (located above or below the projection 190) to move into the spaces of the cavity along the ramp portions and/or to slide up the ramp portions 206, 208 (thereby preventing pinching).

Also, as shown in FIG. 7, a front portion 198 of the projection 190 (that is contacted by the tab 192) is beveled (e.g., rounded). Thus, if a child places his/her fingers adjacent the projection 190 and/or the channel 194, (when the drop gate is moved to the closed position) the relatively larger tab (compared to the front portion 198 of the projection 190) may be operative to push such fingers into one of the spaces of the cavity adjacent the ramp portions 206, 208 of the cavity 180 on either side of (e.g., above or below) the projection 190, rather than pinching the fingers between the tab and the front portion 198 of the projection 190.

As shown in FIG. 7, in example embodiments, the cavity 180 may also be sufficiently wide to receive fingers in a rearward space 200 of the cavity 180 adjacent the bolt, when the bolt extends into the cavity. When the drop gate is in the closed position and the tab 192 contacts the projection 190 to stop the drop gate from moving, the bolt is positioned to project into a forward space 202 of the cavity 180, thereby pushing any fingers into the rearward space 200 (rather than pinching them). In an alternative embodiment, such a rearward space 200 may include a ramp portion as well (at an acute angle with respect to the longitudinal axis of the bolt) so as to urge fingers out of the cavity when the bolt projects into the cavity 180.

Also, it should be appreciated that alternative embodiments may include other arrangements and configurations for the latch device 150 and striker plate 172. For example, in an alternative embodiment, rather than having the bolt 162 and/or handle 184 be positioned generally below the hand rail 168, such an alternative embodiment may include a bolt and handle that is positioned within, beside or above the hand rail 168. Also in further alterative embodiments the orientation of the latch device 150 may be reversed with a bolt positioned to extend out of the vertical members (e.g. posts) and the striker plate mounted on the ends of the drop gate.

Figure 11:
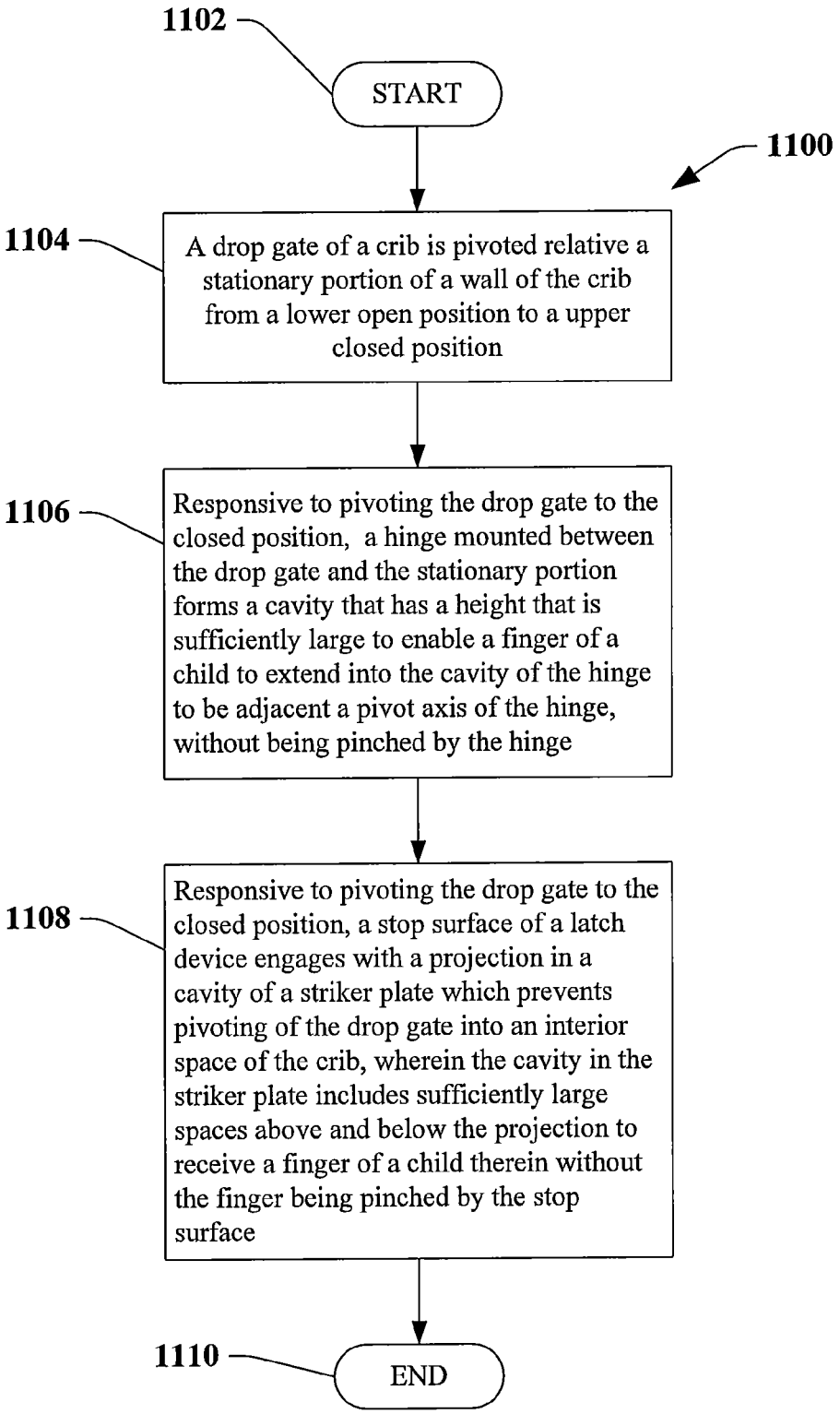
FIG. 11 shows a flow diagram that illustrates an example methodology for operating the crib.

With reference now to FIG. 11, an example methodology is illustrated and described associated with the operation of one or more of the previously described examples of the crib. While the methodology is described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

As illustrated in FIG. 11, the methodology 1100 begins at 1102, and at 1104 includes a step of pivoting a drop gate of a crib relative a stationary portion of a wall of a crib from a lower open position to an upper closed position. Responsive to pivoting the drop gate to the closed upper position, the methodology may include a step 1106 of forming with a hinge mounted between the drop gate and the stationary portion, a cavity therein. As discussed previously, the hinge includes a pivot axis. When the drop gate is in the closed position, the cavity of the hinge has a height that is sufficiently large to enable a finger of a child to extend into the cavity of the hinge to be adjacent the pivot axis, without being pinched by the hinge.

In addition responsive to pivoting of the drop gate to the closed upper position, the methodology may include a step 1108 of engaging a stop surface of a latch device with a projection in a cavity of a striker plate which prevents pivoting of the drop gate into an interior space of the crib. In this step the cavity in the striker plate includes sufficiently large spaces above and below the projection to receive a finger of a child therein without the finger being pinched by the stop surface.

At 1110 the methodology ends. However, it should be appreciated that the described methodology may include further or alternative steps. For example the methodology may include a step of engaging the bolt of the latch device in the cavity of the striker plate such that there is sufficient space in the cavity for a finger to extend therein without being pinched by the bolt. Also in this example embodiment, the projection in the cavity and the stop surface may be positioned to stop further movement of the bolt from pinching the finger.

In addition, when a finger is actually placed adjacent the hinge during the pivoting step, the methodology may include a step that is responsive to the pivoting step to have portions of the drop gate and/or hinge contact the finger and urge the finger into the cavity of the hinge generated in the forming step. Also, when a finger is actually placed adjacent the striker plate during the pivoting step, the methodology may include a step that is responsive to the pivoting to have portions of the drop gate and/or latch device contact the finger and urge the finger into spaces in the cavity of the striker plate above or below the projection and/or adjacent the bolt. Also, the methodology may include a step that is responsive to the pivoting step to have portions of the drop gate and/or latch device contact the fingers and urge the fingers of a user along the previously described beveled surfaces and ramps of the striker plate and out of locations that may cause the fingers to be pinched.

Cribs are often used at day care centers to hold children. At such facilities, the cribs may also be used to transport children out of the day care building during, for example, an evacuation from a fire, earthquake, or other hazardous condition in the building or for any other purpose. To get the children out of the building as quickly as possible, two or more children may be placed in the crib and the crib is then moved out of the building. However, many cribs are generally design to support one child. Also, to exit a building, a crib may need to roll over bumps on the floor and/or strike other objects as it is moved, which could cause the crib (such as a leg of the crib) to break.

Figure 12:
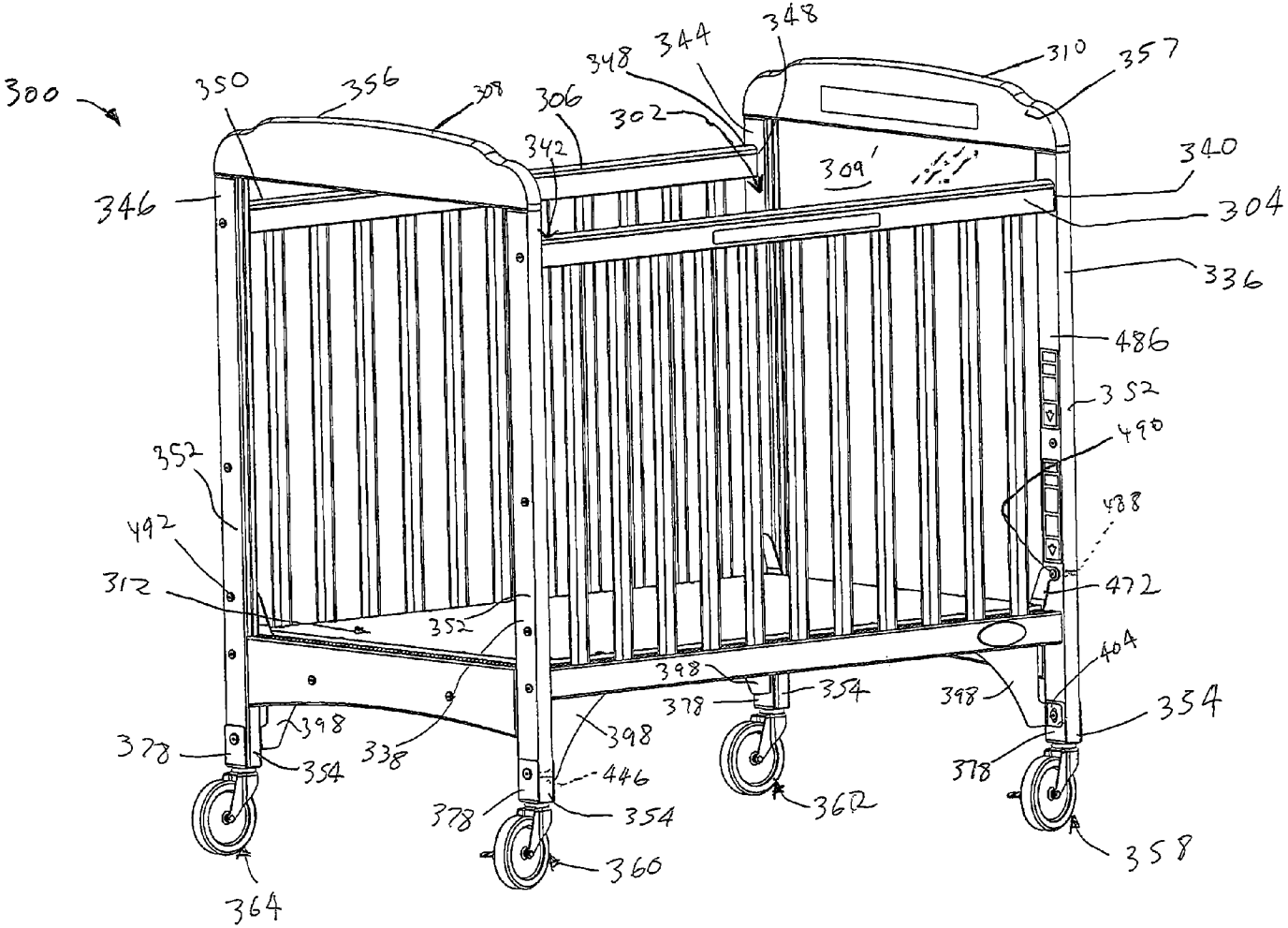
FIG. 12 shows a front and left perspective view of another example embodiment of a crib.

FIG. 12 shows an exemplary embodiment of a crib 300 that is configured to provide additional support in cases of an emergency evacuation, where one or more children are placed in the crib. The crib 300 includes an interior space 302 that is bounded by front and rear walls 304, 306, and left and right side walls 308, 310. The walls 304, 306, 308, 310 of the crib 300 may be comprised of vertical slats, rails, posts, boards, and any other elements operative to form a barrier that keeps a child within the interior space. Walls 308, 310 may also comprise a transparent thermoplastic portion 309 such as Plexiglass® or other transparent material. Alternatively, the walls may include a mirror or reflective material provided on their inner surface. A bottom portion 312 of the interior of the crib 300 may include slats, a board, frame, and/or other types of support members that are capable of supporting a mattress. These described elements of the crib 300 may be made out of materials such as wood, plastic, metal, and combinations thereof. Also one or more of these described elements of the crib may be integrally formed and/or may be fastened together via fasteners (e.g., screws, bolts, clips, adhesives).

Figure 13:
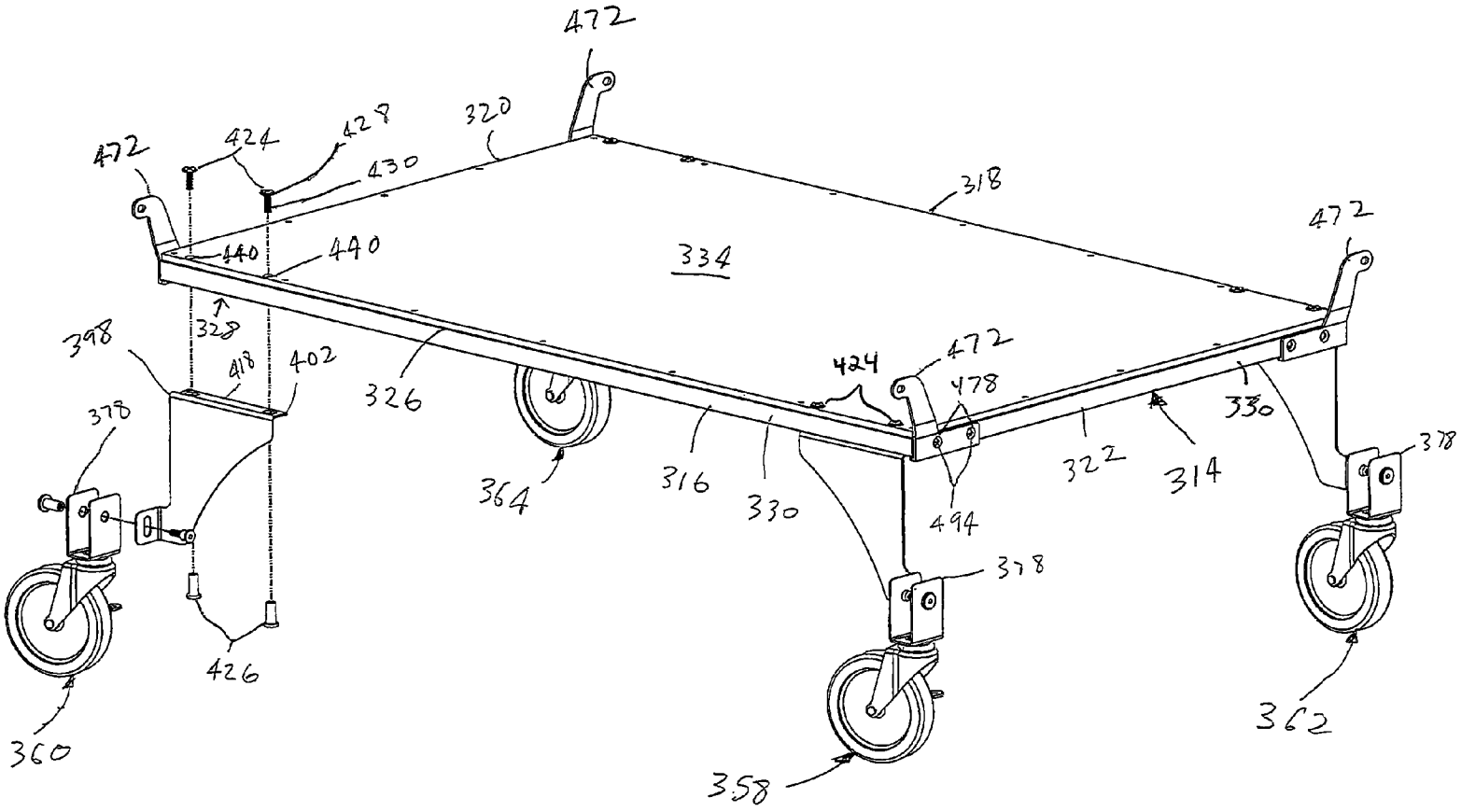
FIG. 13 shows a front and right perspective view of a bottom portion of the crib of FIG. 12 and related elements with a portion of the crib in exploded view.
Figure 14:
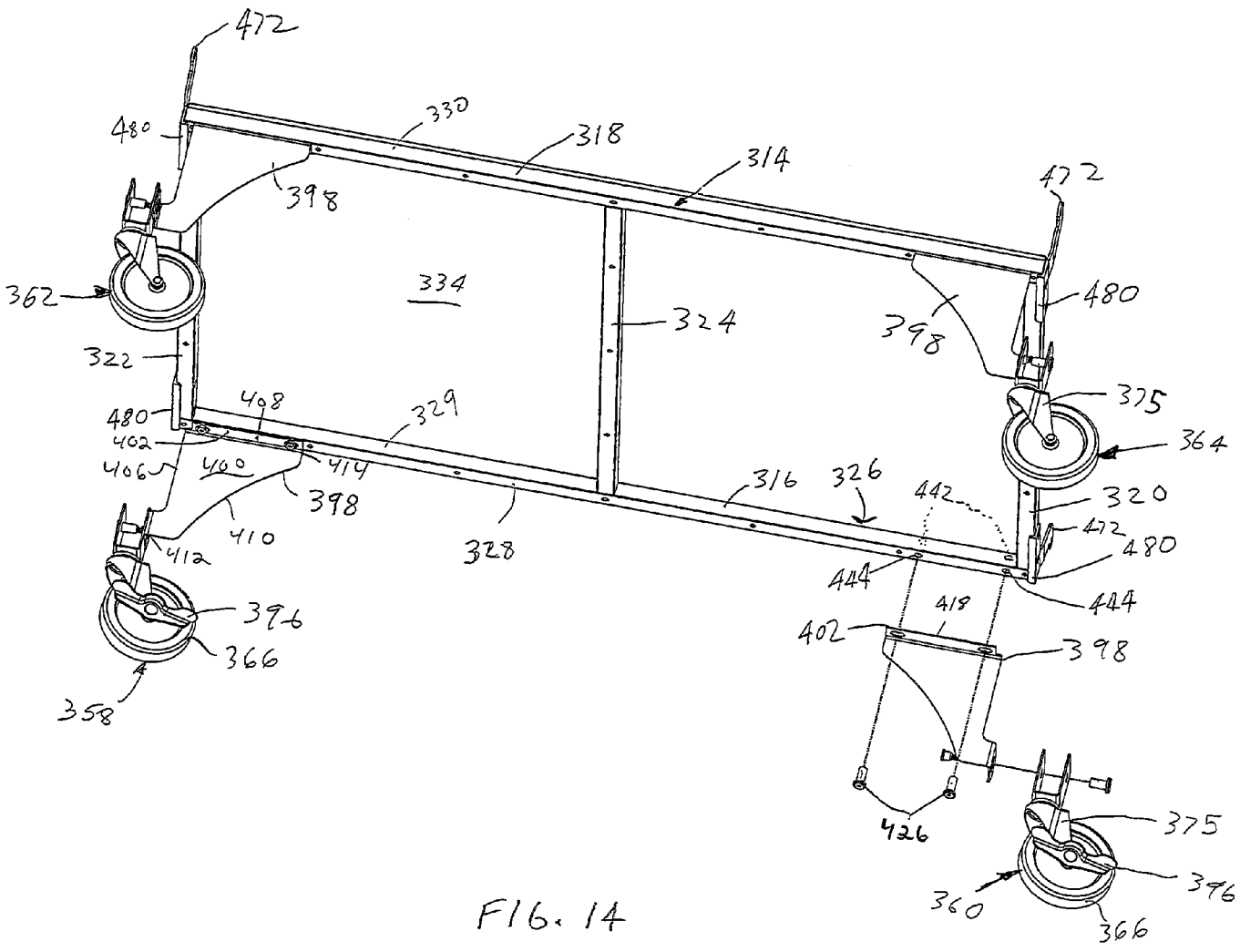
FIG. 14 shows a bottom and rear perspective view of the portion of the crib of FIG. 13.
Figure 15:
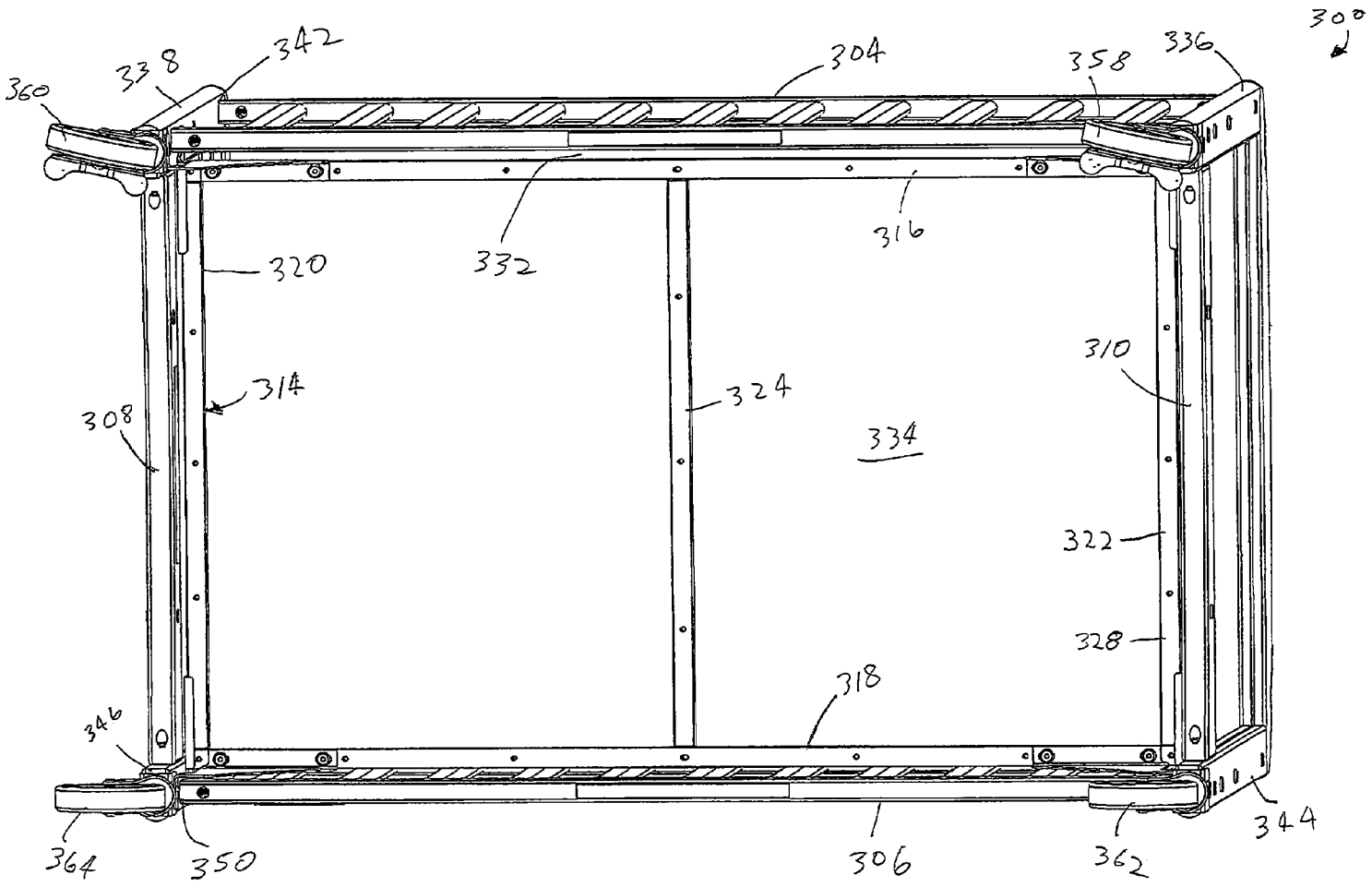
FIG. 15 shows a bottom perspective view of the crib of FIG. 12.

For example, in an example embodiment, the bottom portion 312 may include a rectangular frame 314 as depicted in FIGS. 13-15. The frame 314 may be made of metal such as steel or any other suitable high strength material. The frame 314 may include front and rear side rails 316, 318, and left, right and intermediate cross members 320, 322, 324 that extend between the front and rear side rails 316, 318. The cross members may be attached to the side rails by fasteners or other suitable ways such as welding. The number of cross members may vary depending upon the particular crib, and its size or desirability. For example, there may be no intermediate cross member between the right and left cross members if the crib size is very small or more than one intermediate cross member between the right and left cross members to provide additional support to the mattress if the crib size is large.

Each of the front and rear side rails 316, 318 and cross members 320, 322, 324 may be tubular and square shaped in cross section and may include top, bottom, inner, and outer walls 326, 328, 329, 330. In this example, each of the side rails and cross members are generally formed in one piece and generally constructed of iron, steel, or other suitable rigid material. However, it should be appreciated that in other examples the side rails and cross member may have other shapes and configurations operative to support a mattress and more than one child.

As show in FIG. 15, the frame 314 may be spaced inwardly from the walls 304, 306, 308, 310 at a sufficient distance that allows a finger of a child to extend through gap 332 between the walls 304, 306, 308, 310 and the frame 314 without being pinched. A board 334 may be positioned upon the top wall 326 of the frame 314 and may extend to the peripheral end of the frame 314 to provided additional support to the mattress as shown in FIG. 13. The board 334 may be made out of wood, particle board, or other materials. Alternatively or in addition, a wired spring mesh may be attached to the frame 314 and extend between the front and rear side rails and left and right cross members to provide additional support to the mattress.

As shown in FIG. 12, two elongated vertical members 336, 338 may bound the opposed side ends 340, 342 of the front wall 304 and two elongated vertical members 344, 346 may bound the opposed side ends 348, 350 of the rear wall 306. The vertical members 336, 344 may also correspond to posts and/or side ends of the right side wall 310, and the vertical members 338, 346 may correspond to posts and/or side ends of the left side wall of 308 of the crib. The vertical members may be made of wood or other suitable material. Each of the vertical members 336, 338, 344, 346 includes an upper end 352 that extends above the bottom portion 312 (e.g., where the board 334 is located) and a lower end 354 (see vertical member 336 of FIG. 12) that extends below the bottom portion 312. A left headboard 356 of the left side wall 308 may be positioned upon the upper ends 352 of the vertical members 338, 346. A right headboard 357 of the right side wall 310 may be positioned upon the upper ends 352 of the vertical members 336, 344. Casters 358, 360, 362, 364 may be operatively connected to the lower ends 352 of their respective vertical members 336, 338, 344, 346 so as to be in contact with the floor.

Figure 16:
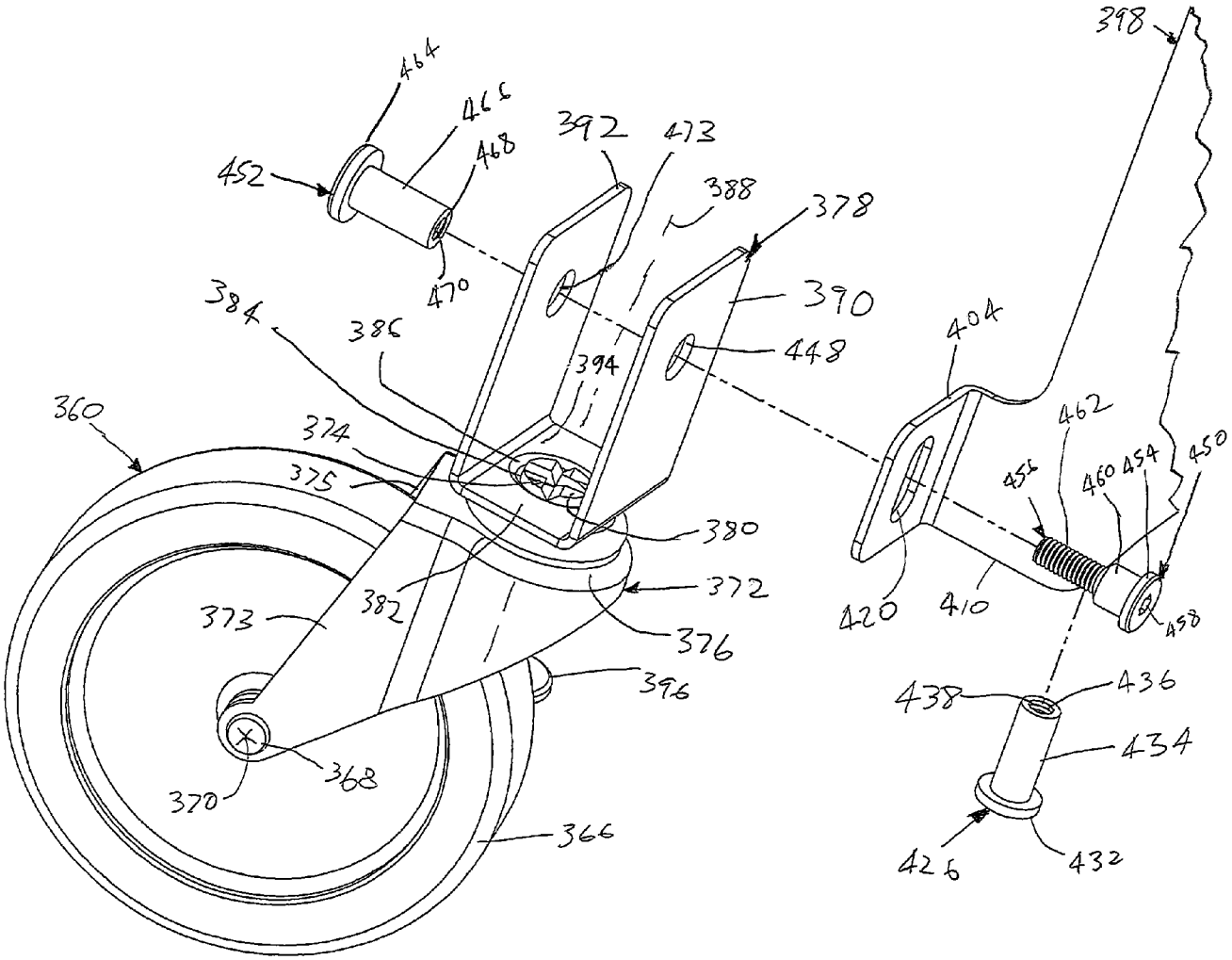
FIG. 16 shows an exploded view of the caster of the crib of FIG. 12 and related elements.

Referring to FIG. 16, each caster includes a roller 366 that is cylindrical and includes an axle 368 that rotates about an axis 370 that is parallel to the floor. The caster may also include a housing 372 defining a fork. The fork 372 may include two legs 373, 375 that are rotatably connected to opposite ends of the axle 368 in a manner that allows rotation of roller 366 about the axis 370 relative to the housing 372. The housing 372 may also include an upstanding stem 374 that is fixed to a junction portion 376 of the legs 373, 375 at the upper end of the housing 372.

The stem 374 may be rotatably connected to a holder 378, which in this example is U-shaped. The holder is operative to receive and mount to the lower end of a respective vertical member (e.g. a foot) of the crib. In particular, the stem 374 includes a shaft (not shown) and a head 380 that is sized larger than the shaft. The holder 378 includes a base 382 that has an opening 384 that receives the stem 374. The opening 384 may be bounded by a beveled peripheral edge 386 that slopes downwardly and radially inwardly. The head 380 is slidably seated upon the top surface of the peripheral edge 386 such that the head may rotate relative to the holder 378 about an axis 388 of the stem 374. Thus, since the housing is fixed to the stem 374, the housing 372 and the roller 366 swivel about the axis 388 of the upstanding stem 374 such that the roller 366 becomes aligned with the proper path of travel when the crib 300 is being moved. Each of the holders 378 further includes opposite upstanding inner and outer flanges 390, 392 that extend upwardly from the base 382 and receive the lower end 354 of their respective vertical members 336, 338, 344, 346 as shown in FIG. 12. Specifically, the lower end 354 of the vertical member associated with the caster extends between the inner and outer flanges 390, 392 and abuts top surface 394 of the base 382. As shown in FIG. 16, the head 380 of the stem 374 is positioned below the top surface 394 of the base 382 and thus is spaced from the lower end 354 of the associated vertical member to prevent the vertical member from interfering with the rotation of the stem 374 and hence swivel of the roller 366 about axis 388.

The holder 378 may be made of a rigid metal and formed in one piece or multiple pieces by any suitable method such as by a stamping or die casting process. Alternatively, the holder 378 may be formed by several pieces such as by welding the flanges 390, 392 to the base 382. Also, further examples of the holder 378 may have additional upstanding flanges or have upstanding flanges formed in one piece to define a tube that completely surrounds the inner end of the vertical member. For example, the holder may have four upstanding flanges that form four walls of a rectangular cavity, into which the lower end 354 (e.g. foot) of each vertical member extends.

In example embodiments, brakes 396 may be operatively connected to each roller 366 of casters 358, 360. As best shown in FIG. 14, the brakes are generally in the form of a large wing nut that is threadily connected to one end of the axle 368. Rotating the brake counterclockwise (as viewed in FIG. 14) engages the brake 396 to the roller 366 to prevent rotation of the roller 366 along the floor and rotating the brake 396 clockwise disengages the brake 396 to the roller 366 to allow rotation of the roller 366 along the floor.

Figure 17:
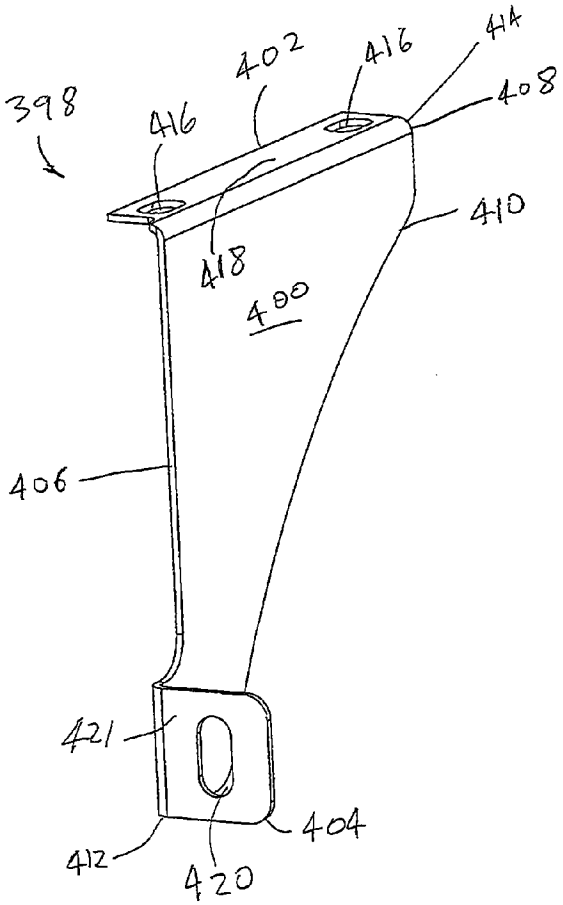
FIG. 17 shows a perspective view of a reinforcing member of the crib of FIG. 12.

As shown in FIG. 12, the crib 300 may include gussets 398 that provide additional support to frame 314 and vertical members 336, 338, 344, 346. As shown in FIG. 17, each of the gussets 398 may be formed in one piece of a suitable rigid material such as steel. The gusset 398 may include a base 400, and upper and lower flanges 402, 404.

As shown in FIG. 14, the base 400 may be generally triangular in shape and may include a vertical side end 406 and an upper end 408 that extends horizontally from the top of the vertical side end 406 when the gusset is installed on the crib. The gusset 398 may further include a third side 410 end that extends a small distance horizontally from a lower end 412 of the vertical side end 406 and then concavely curves upwardly and away from the vertical side end 406 and then extends upwardly to inner end 414 of the upper end. The upper flange 402 is generally horizontal and extends inwardly from the upper end 408.

As shown in FIG. 17, the upper flange 402 includes two mounting apertures 416. The lower flange 404 is generally vertical and extends outwardly from the vertical side end 406 when the gusset 398 is mounted to the crib. The lower flange 404 includes a mounting aperture 420 and outer side 421. In other examples, the gussets 398 may have other shapes and configurations. For example, third side 410 may be straight or convex, rather than concave.

Each of the gussets 398 may be mounted to its respective vertical member, holder, and side rail of the frame as follows. As depicted in FIG. 13, the top surface 418 of the upper flange 402 of the gusset 398 is positioned flushed (as shown in FIG. 14) on the underside of the bottom wall 328 of the associated side rail. A fastening arrangement such as bolts 424 and T-nuts 426 may be used to fasten the gusset 398 to the frame 314 and board 334. Each bolt 424 may include a head 428 and a threaded shaft 430. The head 428 has a diameter that is larger than its corresponding hole 440 in the board and includes a recess configured to receive an Allen wrench. As depicted in FIG. 16, each of the T-nuts 426 includes a head 432 and a hollow shaft 434. The shaft 434 includes a longitudinal bore 436. Threads 438 are provided on the interior surface of the shaft defining the bore 436. The head 432 has a diameter that is larger than the mounting aperture 416 of the upper flange 402 and includes a recess configured to receive an Allen wrench. The bolts 424 are inserted into holes 440 in the particle board and apertures 442 (FIG. 14) in the top wall 326 of the associated side rail. The T-nuts 426 are then inserted into their respective apertures 416 of the upper flange 402 and respective apertures 444 in the bottom wall 328 of the associated side rail until the interior threads 438 of the shafts of the T-nuts 426 engages the corresponding threaded shafts 430 of the bolts 424. The bolts 424 and/or T-nuts 426 are turned clockwise until the heads 432 of the T-nuts bear against the upper flange 402 and the heads 428 of the bolts 424 bear against the top of the particle board 334.

As depicted in FIGS. 12, 16 and 17, the outer side 421 (FIG. 17) of the lower flange 404 of the gusset 398 is positioned flushed on the inner flange 390 (FIG. 16) of the holder 378 such that the aperture 420 of the lower flange 404 of the gusset 398 is aligned with an aperture 448 of the inner flange 390 and a lateral bore 446 (FIG. 12) formed in the lower end 354 of the associated vertical member. The aperture 420 of the lower flange 404 of the gusset 398 has a greater height than the aperture 448 of the inner flange 390 of the holder 378 to accommodate possible various mounting locations of the inner flange 390 and lower flange 404 due to tolerances associated with the manufacturing parts and assemblies.

A fastening arrangement is used to fasten the gusset, holder, and vertical member together. As depicted in FIG. 16, the fastening arrangement may include a threaded fastener such as a wood screw or threaded bolt 450 and a T-nut 452. The threaded bolt 450 includes a head 454 and a shaft 456. The head 454 has a diameter that is larger than the width of the aperture 420 and includes a recess 458 configured to receive an Allen wrench. The shaft 456 comprises an unthreaded portion 460 adjacent the head 454 and threaded portion 462 adjacent the unthreaded portion 460. The T-nut 452 includes a head 464 and a hollow shaft 466. The shaft 466 includes a longitudinal bore 468. Threads 470 are provided on the interior surface of the shaft that define the bore 468. The head 464 has a diameter that is larger than the width of mounting aperture 473 of the outer flange 392 of the holder 378 and also includes a recess configured to receive an Allen wrench. The T-nut 452 is inserted into the aperture 473 and bore 446 of the lower end 354 of the associated vertical member. When inserted, the shaft 466 of the T-nut 452 extends partially through the bore 446 of the vertical member. The threaded bolt 450 is then inserted into the apertures 420 and bore 446 until the threaded portion 462 of the shaft 456 extends into the threaded bore 468 of the shaft 466 of the T-nut 452. In particular, the threads 470 on the interior surface of the shaft threadily engage the corresponding threaded portion 462 of shaft 456 of the threaded bolt 450. The threaded bolt 450 and/or T-nut 452 is turned clockwise until the head 464 of the T-nut 452 bears against the outer flange 392 and the head 454 of the threaded bolt 450 bears against the lower flange 404 of the gusset 398. The unthreaded portion 460 of the shaft 456 of the threaded bolt 450 is designed to slide through the vertical member so that the threaded bolt 450 can be pulled tight to the lower flange 404 to tightly fasten the gusset 398, holder 378, and vertical member to each other. Alternatively, other suitable types of fastening arrangements may be used to mount each reinforcing member (e.g. gusset) to the holder associated with a caster and the lower portion (e.g. foot) of the vertical members (e.g. posts) of the crib, as well as the frame that supports the mattress.

In an example embodiment, the crib may further include upper reinforcing members 472 (FIG. 14) that are mounted between respective left and right cross members 320, 322 and corresponding vertical members 336, 338, 344, 346 (FIG. 12). The reinforcing member 472 may attach the frame or mattress support to the vertical members of the crib and provides additional support. The reinforcing member 472 may be a spring bracket or any other suitable member for attaching the mattress support to the crib.

Figure 18:
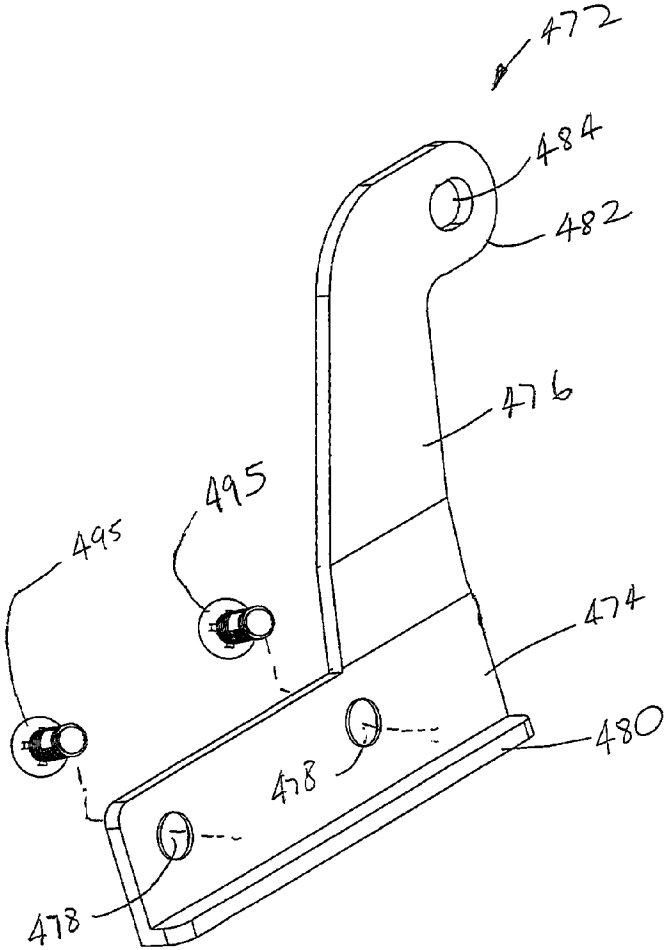
FIG. 18 shows an exploded perspective view of the reinforcing member and its fastener for the crib of FIG. 12.

As shown in FIG. 18, each upper reinforcing member 472 may be formed in one piece of a suitable rigid material such as steel. Each reinforcing member 472 may comprise a rectangular base 474 and a hook-shaped member 476. The base 474 may include a pair of apertures 478 and an inwardly extending support step 480 at its lower end. The hook-shaped member 476 extends upwardly from the base 474 and may slanted at an acute angle towards its respective vertical member (as best seen in FIG. 12), and then terminates into an upper mounting end portion 482. The mounting end portion 482 includes a mounting aperture 484.

To mount the reinforcing member 472 to its respective right or left cross member and vertical member, the mounting end portion 482 may be fastened (flush or spaced apart with washers) to the inwardly facing side 486 (FIG. 12) of the corresponding vertical member such that the aperture is aligned with a lateral bore 488 (FIG. 12) in the vertical member. A fastening arrangement such as a threaded bolt and T-nut type arrangement as previously mentioned may then be used to mount the mounting end portion 482 to the vertical member. In particular, as best depicted in FIG. 12, a wood screw or threaded bolt 490 may be inserted into the mounting aperture 484 and bore 488 such that it threadily engages a T-nut 492 inserted into the bore 488 on the opposite side of the vertical member.

As shown in FIG. 13, the base 474 is positioned on the outer wall 330 of the respective cross member such that the apertures 478 are aligned with holes 494 in the outer wall 330, and (as shown in FIG. 14) the support step 480 engages the underside of the bottom wall 328 of the respective cross member. Fasteners 495 (FIG. 18) such as threaded bolts are then threadily inserted into the apertures 478 and holes 494 to mount the base 474 to the cross member. Nuts may be turned on bolts to further secure the base 474 to the cross member.

It should be appreciated that the above described upper and lower reinforcing members and metal frame may provide addition strength to a crib in order to handle the weight of several children during an emergency evacuation. Further the reinforcing members may minimize the risk that the lower portions of the vertical members will break, when the crib is pushed over thresholds, steps and other non flat surfaces.

Also, it should be appreciated that when cribs are moved (during day to day use or emergency situations), cribs may hit structures or other objects which could damage the crib. To protect cribs, example embodiments may include bumpers that are placed on the exterior side of the walls of the crib. FIGS. 19-23 show an example embodiment of a crib 500 that comprises bumpers.

Figure 19:
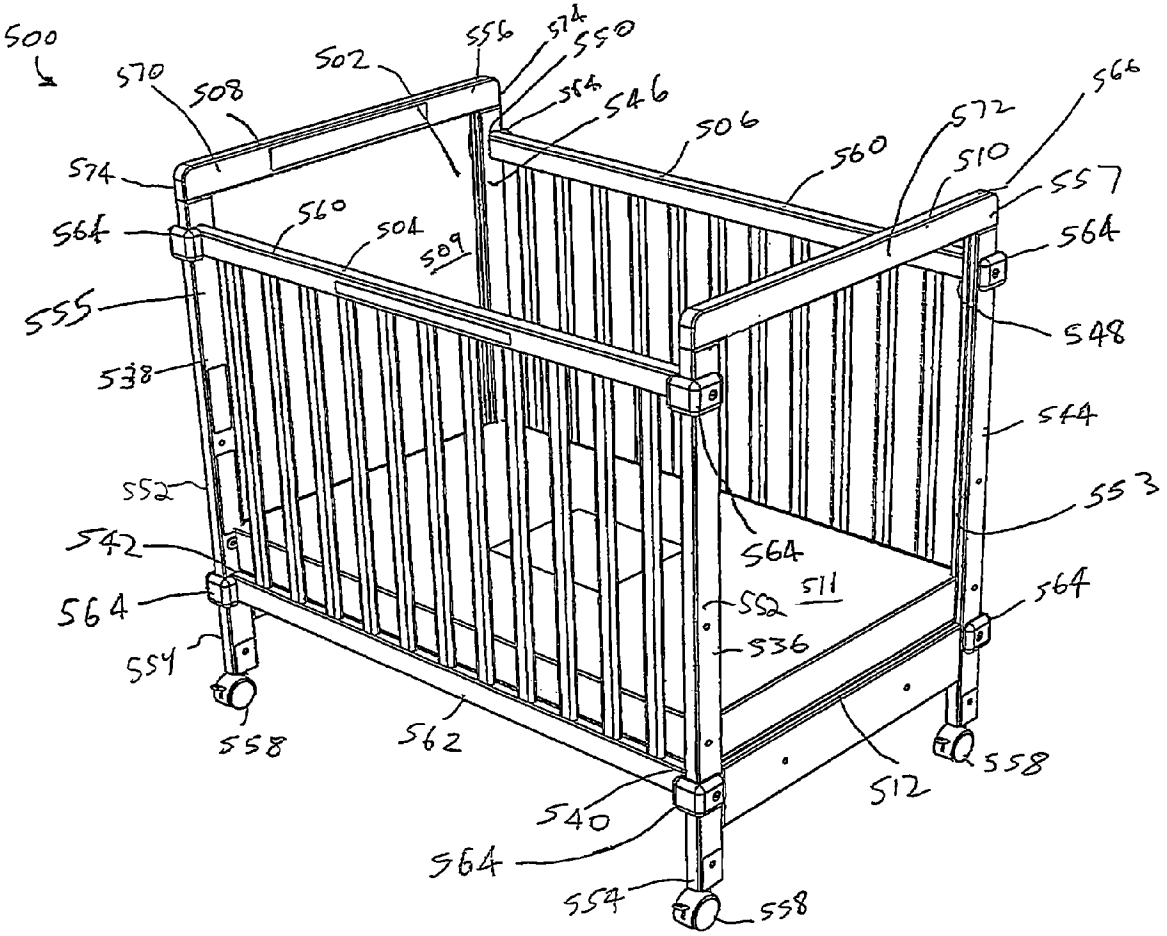
FIG. 19 shows a front and right perspective view of another example embodiment of a crib.
Figure 20:
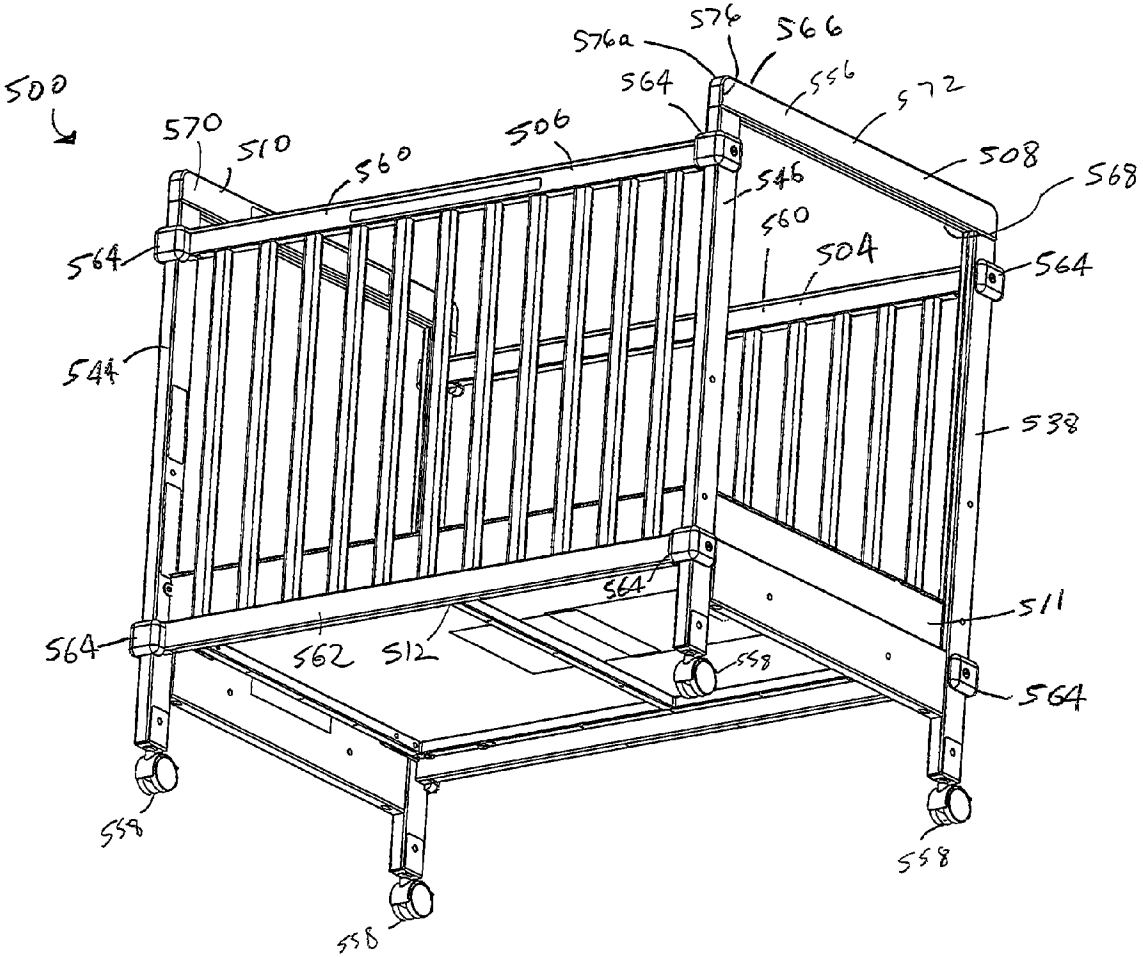
FIG. 20 shows a rear perspective view of the crib of FIG. 19.

Referring to FIGS. 19 and 20, the crib 500 includes an interior space 502 that is bounded by front and rear walls 504, 506, and left and right walls 508, 510. The walls 504, 506, 508, 510 of the crib 500 may be comprised of vertical slats, rails, posts, boards, and any other elements operative to form a barrier that keeps a child within the interior space. Walls 508, 510 may also comprise a transparent thermoplastic portion 509 such as Plexiglass® or other transparent material. Alternatively, the walls may include a mirror or reflective material provided on their inner surface. A bottom portion 512 of the interior of the crib 500 may include slats, a board, frame, and/or other types of support members that are capable of supporting a mattress 511. These described elements of the crib 500 may be made out of materials such as wood, plastic, metal, and combinations thereof. Also one or more of these described elements of the crib may be integrally formed and/or may be fastened together via fasteners (e.g., screws, bolts, clips, adhesives).

Two elongated vertical members 536, 538 bound the opposed side ends 540, 542 of the front wall 504 and two elongated vertical members 544, 546 bound the opposed side ends 548, 550 of the rear wall 506. The vertical members 536, 544 may also correspond to posts and/or side ends of the right side wall 510, and the vertical members 538, 546 may correspond to posts and/or side ends of the left side wall of 508 of the crib 500. In this example, the vertical members have a generally rectangular cross section with generally flat sides, and may be made of wood or other suitable material. Also the edges of the vertical members may be beveled/rounded to reduce pointed edges. In addition, as discussed below with respect to FIG. 24, it should be appreciated that vertical members may have other cross-sectional shapes (such as one or more rounded sides). Each of the vertical members 536, 538, 544, 546 includes an upper end 552 and a lower end 554 (see vertical members 536, 538 of FIG. 19) and four flat side faces 549, 551, 553, 555 (FIG. 21) that are each rectangular in shape. Opposite side faces 551 and 553 are located at right angles to opposite side faces 549 and 555. Alternatively, opposite side faces 551 and 553 may be located at obtuse or acute angles with respect to opposite side faces 549, 555. The vertical members may also includes rounded or convexly curved side ends/edges 559, 561 (FIG. 21) at the intersections of adjacent side faces 551, 553 and side faces 549, 551, respectively, and convexly curved side ends/edges 563 at the intersection of adjacent side faces 549, 555 and at the intersection (not shown) of side faces 553, 555, respectively.

A left headboard 556 of the left side wall 508 may be positioned upon the upper ends 552 of the vertical members 538, 546. A right headboard 557 of the right side wall 510 may be positioned upon the upper ends 552 of the vertical members 536, 544. Each headboard may be generally rectangular in shape (or have other shapes) and comprises upper, lower, inner, outer, and side faces 566, 568, 570, 572, 574.

Figure 22:
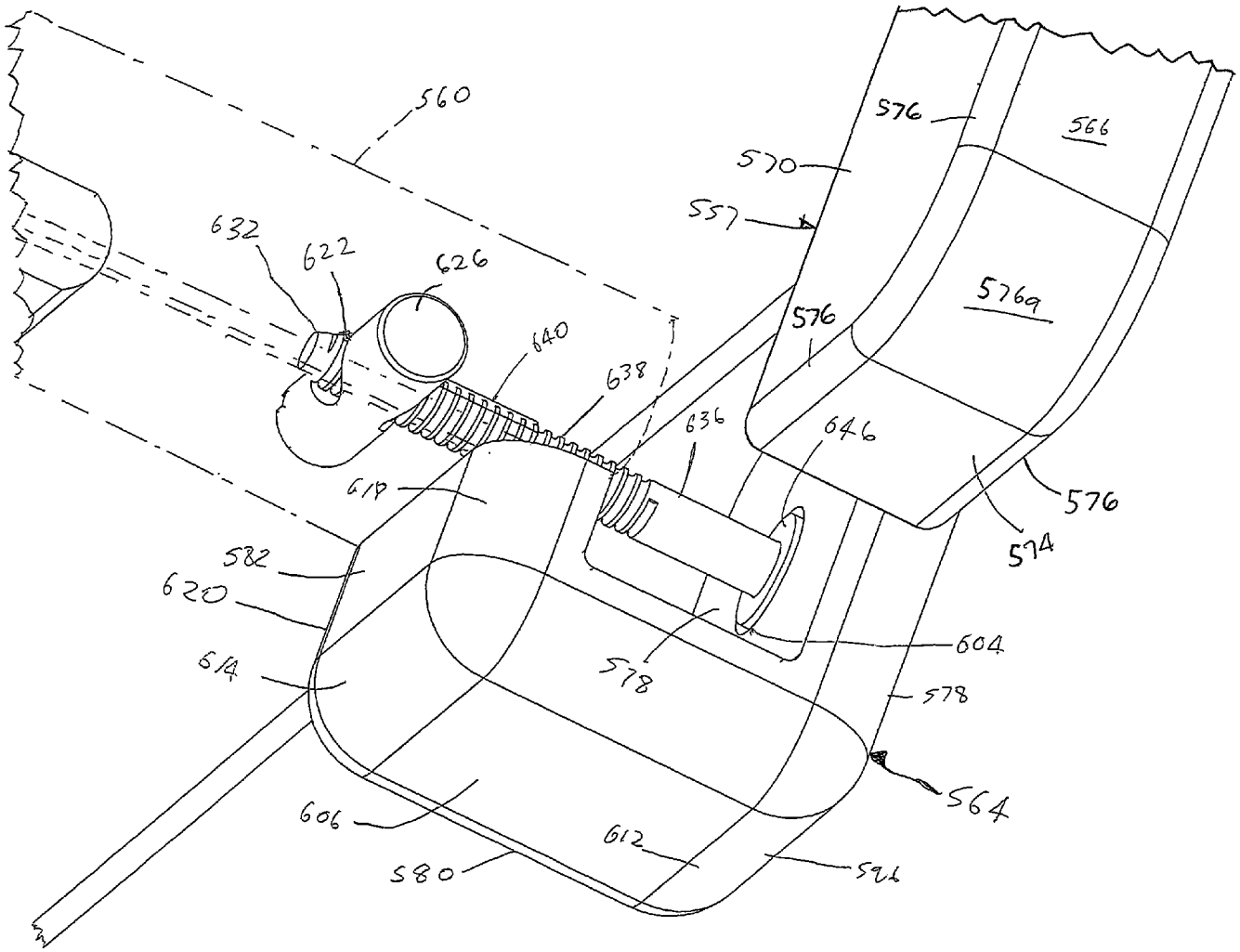
FIG. 22 shows a top perspective view of a portion of the crib of FIG. 19 with portions removed and in phantom to illustrate a bumper and its fastening arrangement.

As shown in FIGS. 20 and 22. The headboard may include rounded or convexly curved ends/edges 576 at the intersection of adjacent faces 566, 568, 570, 572, 574. That is the exterior surface of each of the ends 576 is convexly curved between the adjacent faces. At the intersection of the upper face 566 and a side face 574, the end or corner **576*a* has a lengthier curve than the other ends. As shown in FIG. 19, casters 558 may be operatively connected to the lower ends 554 of their respective vertical members 536, 538, 544, 546** and are in contact with the floor.

Each of the front and rear walls 504, 506 include upper and lower horizontal members 560, 562. The horizontal members may correspond to rails. Each of the upper and lower horizontal members 560, 562 extend between the side ends of their respective walls. One or more bumpers 564 may be mounted to each of the vertical members 536, 538, 544, 546. For example, one bumper 564 may be secured to the junction of a respective vertical member and the upper horizontal member 560, and a second bumper may be secured to the junction of the respective vertical member and lower horizontal member 562. However, it should be appreciated that in other examples a crib may only have bumpers only at the lower horizontal member or only at the upper horizontal member (and/or other combinations and arrangements of bumpers).

Figure 21:
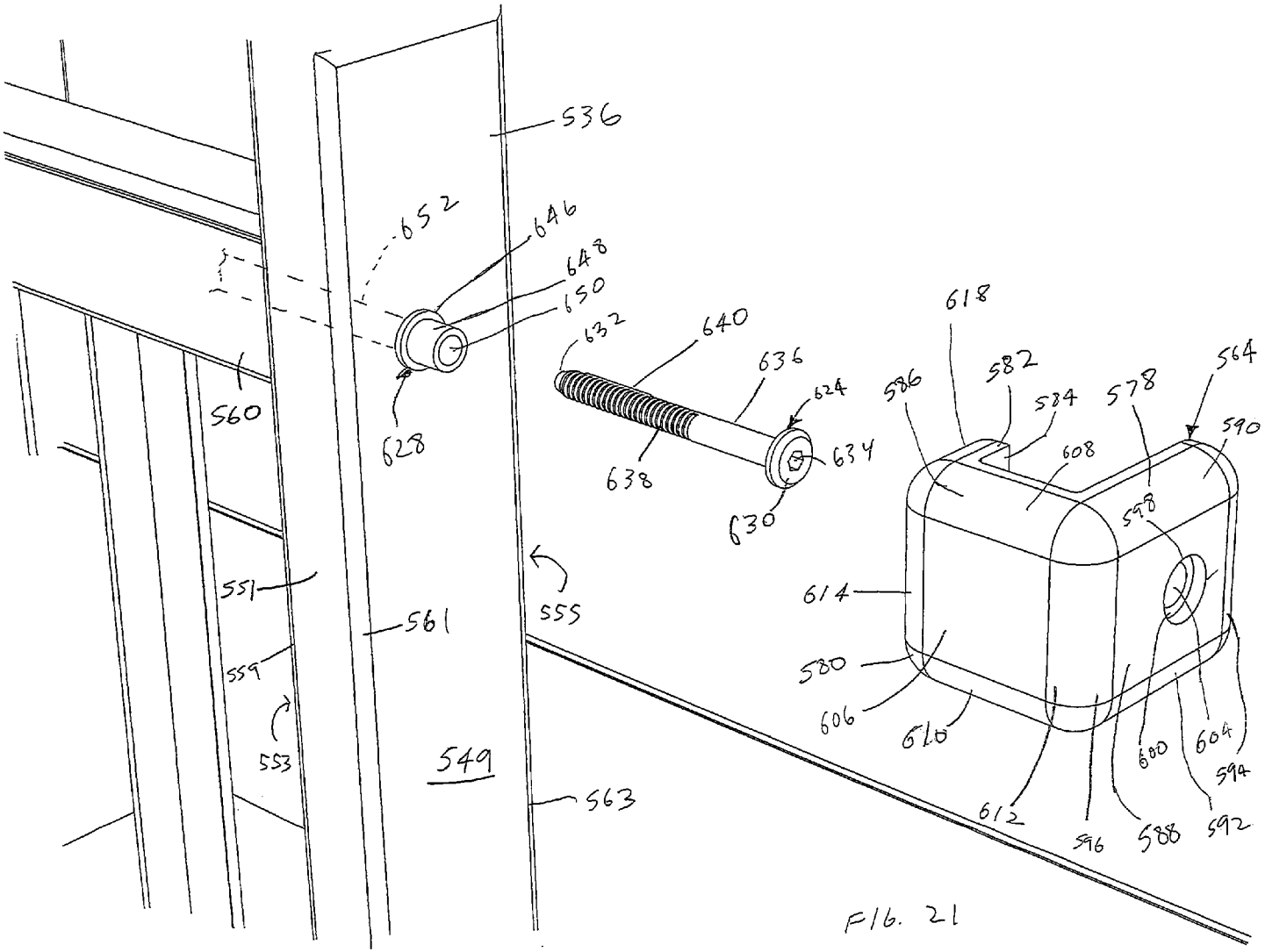
FIG. 21 shows a front perspective view of a portion of the crib of FIG. 19 and with a partial exploded view of a bumper and a portion of its fastening arrangement for the crib of FIG. 19.

Referring to FIG. 21, a bumper 564 may be generally L-shaped and may be made of a soft deformable and elastic material such as rubber or polyurethane. The bumper 564 may be formed in one piece by any suitable process such as injection molding. In this example, the bumper 564 may comprise first and second legs 578, 580 and a lip 582 that together define a hook like configuration. In this example, the bumper 564 also includes interior and exterior surfaces 584, 586.

Figure 23:
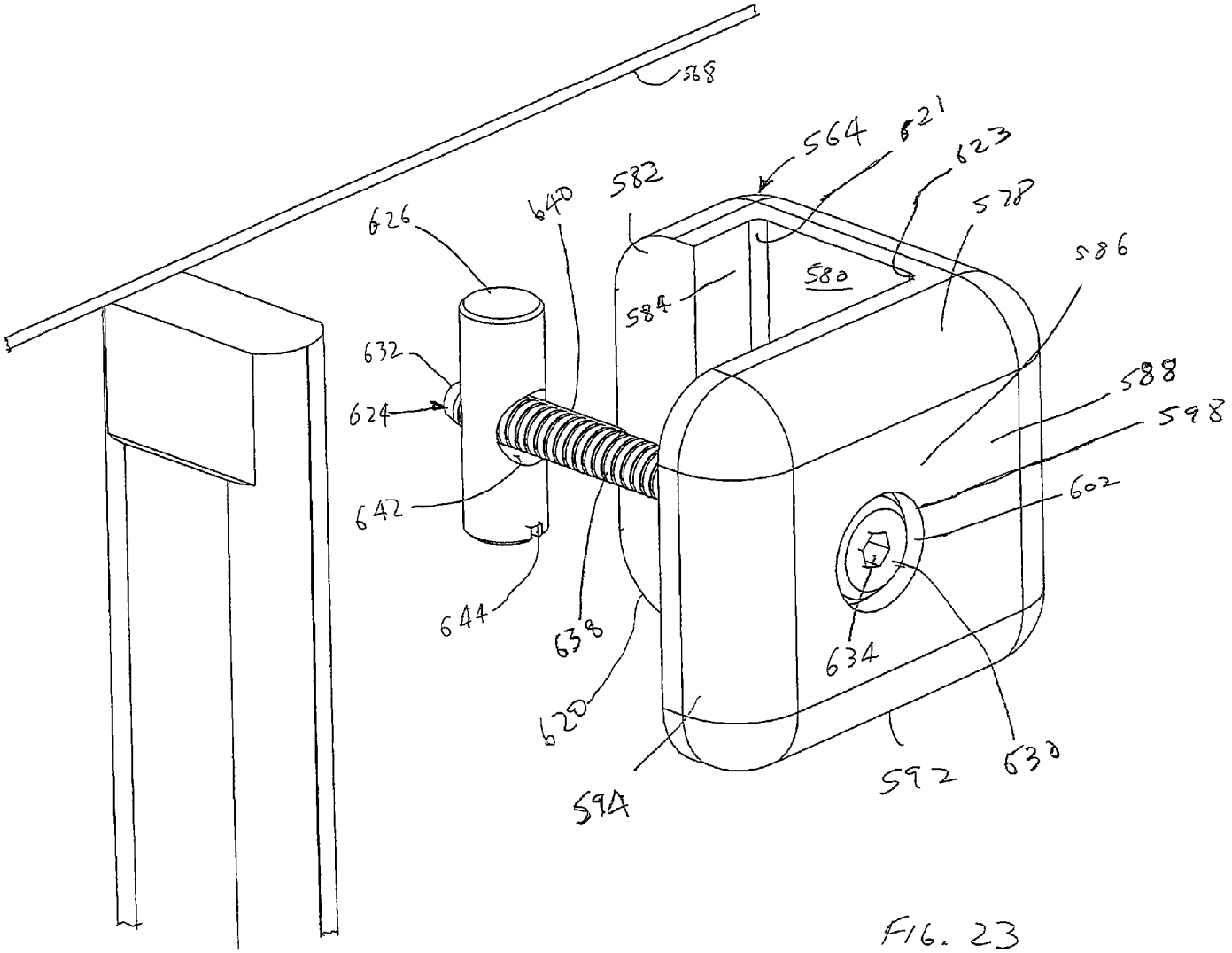
FIG. 23 shows a right perspective view of a portion of the crib of FIG. 19 illustrating the bumper located rearward to the bumper of FIG. 21.

The first leg 578 may have a generally flat square shaped base 588 with rounded upper, lower, and side ends 590, 592, 594, 596 at its periphery. In particular, the exterior surface 586 at each of the ends convexly curves radially outwardly from the base 588 as viewed in FIGS. 21-23. As shown in FIG. 23, the interior surface 584 of the first leg 578 may be flat. The first leg 578 may also includes a circular recess 598 formed in the exterior surface 586 at the center of the base 588. As shown in FIG. 21, the recess 598 is defined by a bottom face 600. As shown in FIG. 22, the recess 598 is also defined by a side wall 602. As shown in FIG. 21, the bottom face 600 of the recess 598 includes an aperture 604.

The second leg 580 may also have a generally flat square shaped base 606 with rounded upper, lower, and side ends 608, 610, 612, 614 at its periphery. In particular, the exterior surface 586 at each of the ends convexly curves radially outwardly from the base 606. The interior surface 584 of the second leg 580 may be flat. The second leg 580 may extend inwardly from side end 596 of the first leg 578 of the bumper 564 along the right or left direction (as viewed in FIG. 19). At the intersection of the first and second legs 578, 580, the curved side end 596 of the first leg 578 blends into the curved side end of the second leg 580 to define a curved junction portion of the two side ends. The lip 582 may extend inwardly from the side end 614 of the second leg along the front or rear direction (as viewed in FIG. 19). The lip 582 may include a rectangular shaped base with rounded upper and lower peripheral ends 618, 620. Specifically, the exterior surface 586 at each of the ends 618, 620 convexly may curve radially outwardly. The interior surface 584 of the base 616 may be flat.

As shown in FIG. 23, the bumper 564 may include concavely curved side ends 621, 623 formed in the interior surface 584 at the intersection of the first leg 578 and second leg 580 and at the intersection of the second leg 580 and lip 582. The side ends 621, 623 may be complimentary with the curved side ends 621, 623 of the vertical member and thus fittingly receive the respective side ends 559, 561 of the vertical member when the bumper 564 is mounted to the vertical member.

As shown in FIG. 22, the bumper 564 may be mounted to its respective vertical member by a fastening arrangement 622. The fastening arrangement 622 also secures the bumper 564, the respective vertical member, and the respective horizontal member to each other. Referring to FIGS. 21-23, the fastening arrangement 622 may include a fastener such as a bolt 624, a barrel nut 626 (FIGS. 22 and 23), and a bushing 628 (FIG. 21). The bolt 624 has a head 630 and a shaft 632. The head 630 includes a recess 634 configured to receive an Allen wrench. The shaft 632 includes an unthreaded portion 636 and a threaded portion 638. The threaded portion 638 also includes a flattened portion 640 extending axially a partial distance along the threaded portion 638.

As shown in FIG. 23, the barrel nut 626 includes a lateral hole 642 extending through its center. The barrel nut 626 also includes a slotted recess 644 formed in the exterior surface of an axial end of the barrel nut. The slotted recess 644 is configured to receive a blade of a suitable tool such as a slotted screwdriver.

As shown in FIG. 21, the bushing 628 includes a head 646 and a shaft 648 and an axial bore 650 extending through the head 646 and shaft 648. When the bumper 564, the vertical member, and the horizontal member are secured to each other, the shaft 632 of the bolt 624 extends through the aperture 604 of the bumper 564, the axial bore 650 of the bushing 628, and a horizontal bore 652 that extends through the vertical member and partially into the horizontal member. In this position also, the threaded portion 638 of the bolt 624 threadily engages the hole 642 of the barrel nut 626 to secure the bumper 564, the vertical member, and the horizontal member to each other.

To fasten the bumper 564, the vertical member, and the horizontal member to each other, the barrel nut 626 is positioned in the horizontal member such that the hole 642 (FIG. 23) is aligned with the horizontal bore 652 (FIG. 21). The bolt 624 is then inserted through the aperture 604 of the bumper 564 and the axial bore 650 of the bushing. The bumper 564 is then positioned on the vertical member such that the interior surface 584 at the first leg 578 contacts the side face 549 of the respective vertical member opposite or facing away from the horizontal member, and the interior surface 584 at the second leg 580 contacts the side face 551 of the vertical member opposite or facing away from the left or left walls 508, 510, the interior surface 584 at the lip 582 contacts a portion of the side face 555 of the vertical member facing the horizontal member.

The shaft 632 of the bolt 624 is then inserted into the bore 652 until it threadily engages the barrel nut 626. The bolt 624 is turned clockwise until the head 630 rests tightly upon the bottom face 600 of the recess 598 of the vertical leg (see FIG. 23) and the head 646 of the bushing is flushed with the interior surface 584 of the bumper 564 at the first leg 578 (see FIG. 22). When the bumper 564 is mounted to the vertical member, the shaft 648 of the bushing 628 bears against the underside of the bottom face 600 of the recess 598. Alternatively, the fastening arrangement may include just the threaded bolt. In either fastening arrangement, one single bolt 624 may only be needed to fasten the bumper, vertical member, and horizontal member to each other.

It should also be understood, that the curved configuration of the peripheral ends 590, 592, 594, 596 608, 610, 612, 614, 618, 620 of the bumper 564 may direct a child's finger or other body part that contacts the peripheral ends of the bumper 564 to gently slide off the bumper 564. This also reduces the possibility that the finger or other body part will be pinched between the interior surface 584 of the bumper 564 and vertical member. Also, as shown in FIGS. 19 to 21, the bases 588, 606 of the legs 578, 580 of the bumper 564 have a similar shape or configuration as the side faces of the vertical members and the faces 566, 568, 570, 572, 574 of each of the headboards 556, 557. Further, the curved side peripheral ends 594, 596, 612 of the legs 578, 580 have a similar contour as the curved side ends 559, 561 of the vertical member and the curved ends 576 of the headboard. This provides an aesthetically pleasing appearance.

Figure 24:
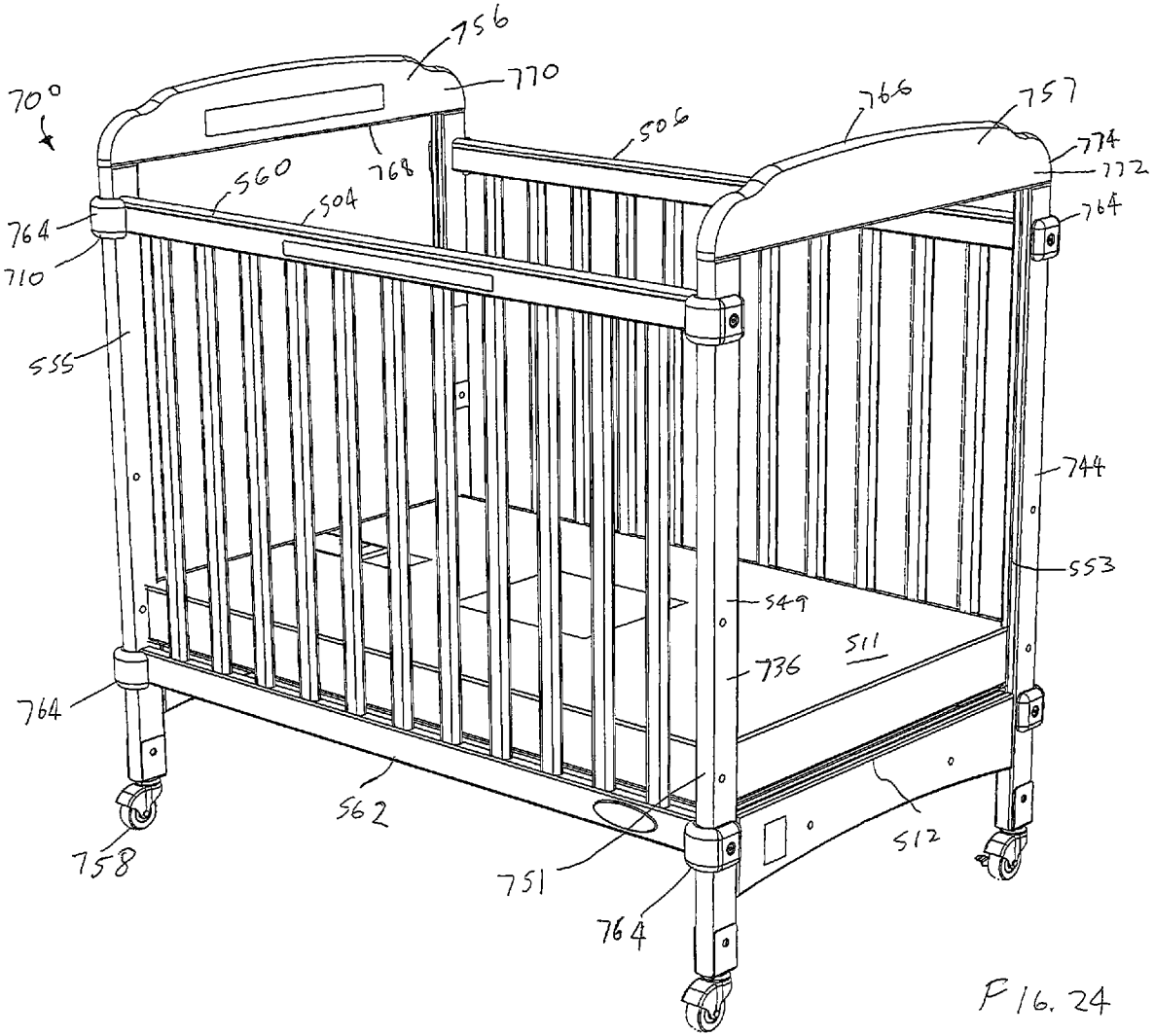
FIG. 24 shows a front and right perspective view of another exemplary embodiment of a crib.
Figure 25:
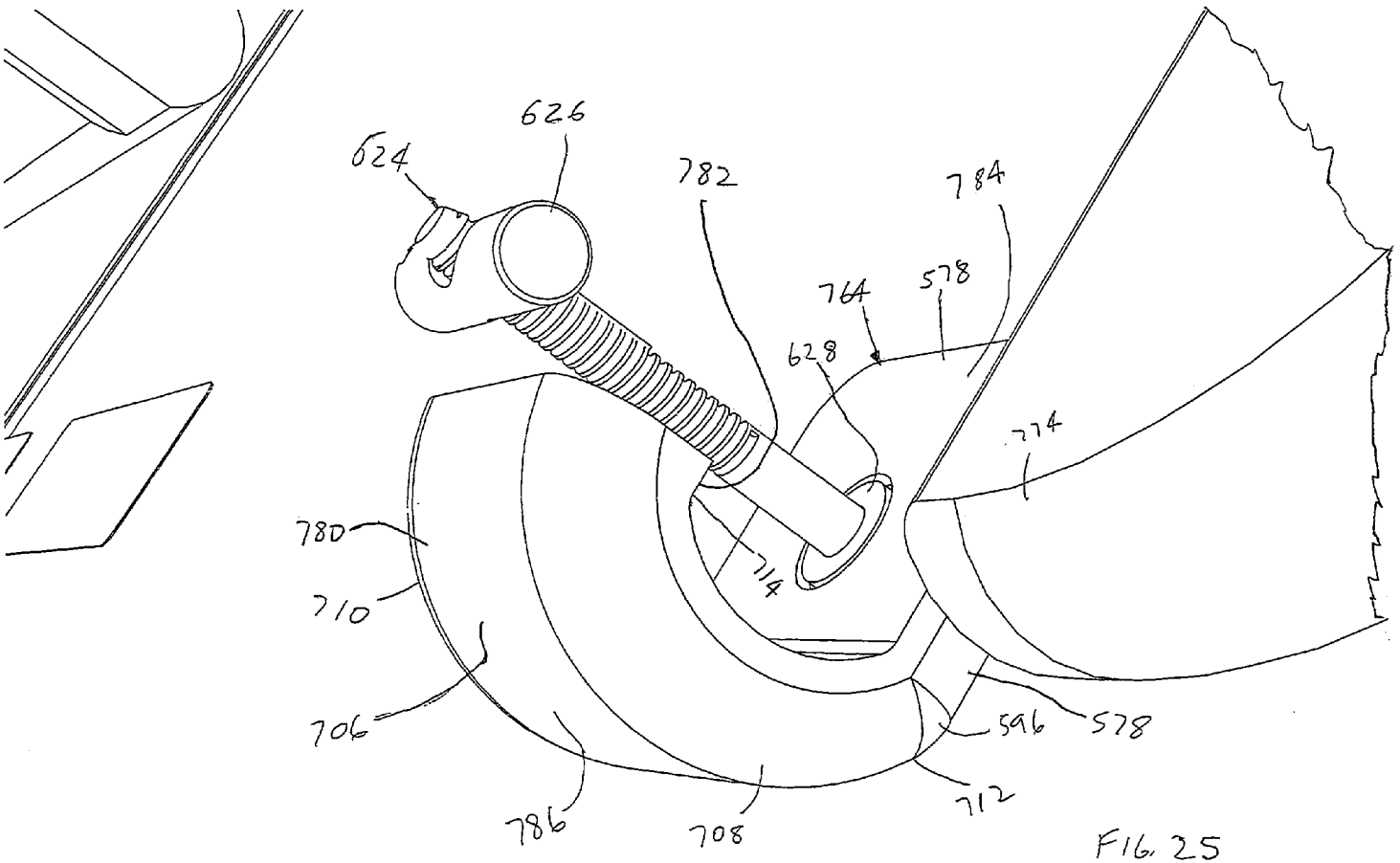
FIG. 25 shows a top perspective view of a portion of the crib of FIG. 24 with portions removed and in phantom to illustrate a bumper and its fastening arrangement.

FIGS. 24-25 show another example embodiment of a crib 700 with bumpers. In this example embodiment, the bumper 764 has a different shape. Referring to FIG. 25, the bumper 764 comprises first and second legs 578, 780 and a lip 782 that define a hook like configuration. The bumper also includes interior and exterior surfaces 784, 786. The first leg 578 is similar in structure and function to the first leg 578 of the bumper 564 of the previous exemplary embodiment. The second leg 780 has a base 706 that is generally partly cylindrical with rounded upper and lower ends 708, 710 at its periphery. In particular, the exterior surface 786 at each of the ends 708, 710 convexly curves radially outwardly from the base 706, and the exterior surface 786 at the base 706 convexly curves from one side end 712 to another side end 714 of the base 706 as viewed in FIGS. 24-25. The second leg 780 extends inwardly from a side end 596 of the first leg 778 of the bumper along the right or left direction (as viewed in FIG. 25). The lip 782 extends inwardly from the side end 714 of the second leg 780 along the front or rear direction (as viewed in FIG. 25). The interior surface 784 of the lip 782 is flat. The exterior surface of the lip 782 is convexly curved with a contour that blends in with the curved base 706 of the second leg 780 to define an arcuate portion of the bumper 764.

As shown in FIG. 24, the crib may include right and left headboards 756, 757. Each headboard comprises upper, lower, inner, outer, and side faces 766, 768, 770, 772, 774. In this exemplary embodiment, the side face 751 of the vertical member 736 that receives the second leg 780 and the upper and side faces 766, 774 of each headboard is curved to match the curved contour of the second leg 780. The bumper 764 is mounted to the vertical members using the same fastening arrangement as that previously mentioned. The headboards 756, 757 are shaped different to that of FIG. 12 and different casters 758 are provided, but generally other aspects of the crib 700 are similar to the crib 500 of the previous embodiment.

Figure 26:
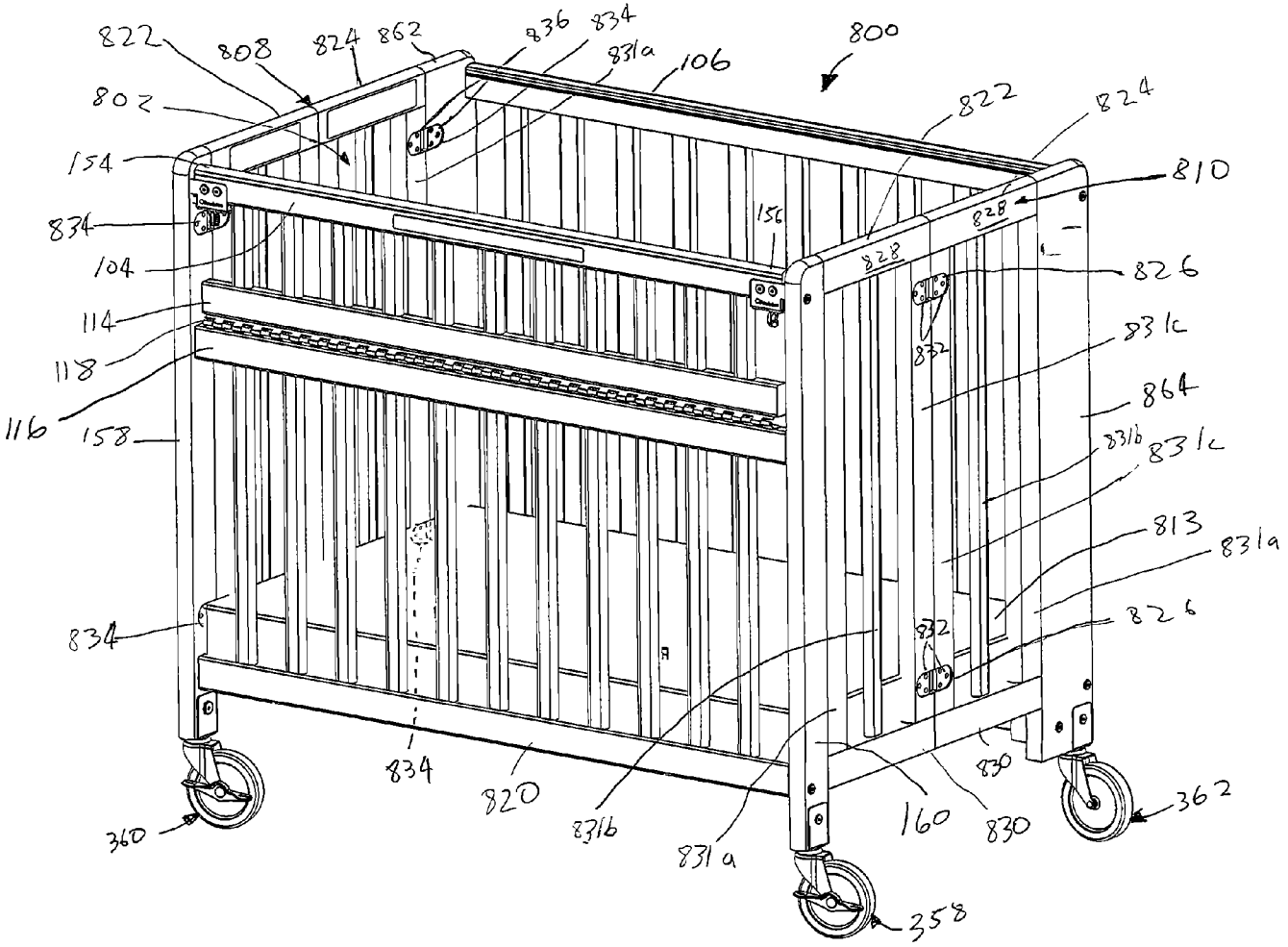
FIG. 26 is a front and right perspective view of another exemplary embodiment of a crib in an extended position.

Cribs may be foldable or collapsible so that they can be conveniently transported or stored in small area. FIG. 26 shows an exemplary embodiment of a foldable crib 800. The crib 800 is similar to the crib 100 of FIGS. 1-10 except for that described below. In particular, the crib 800 includes an interior space 802 that is bounded by four walls 104, 106, 808, 810. Vertical members 158, 160, 862, 864 are located at the corners of the crib 800. The vertical member 158 interconnects the front wall 104 and the left side wall 808. The vertical member 158 also interconnects a lower horizontal rail 820 of the front wall 104 and the lower stationary portion 116. The vertical member 160 interconnects the front wall 104 and the right side wall 810. The vertical member 160 also interconnects the lower horizontal rail 820 of the front wall 104 and the lower stationary portion 116. The vertical member 862 interconnects the rear wall 106 and the left side wall 808. The vertical member 864 interconnects the rear wall 106 and the right side wall 810. Each of the vertical members 862 and 864 may have a larger width than the width of the vertical members 158 and 160. A bottom portion 812 (FIG. 27) of the interior of the crib may include slats, a board, frame, and/or other types of support members that are capable of supporting a mattress 813.

Figure 27:
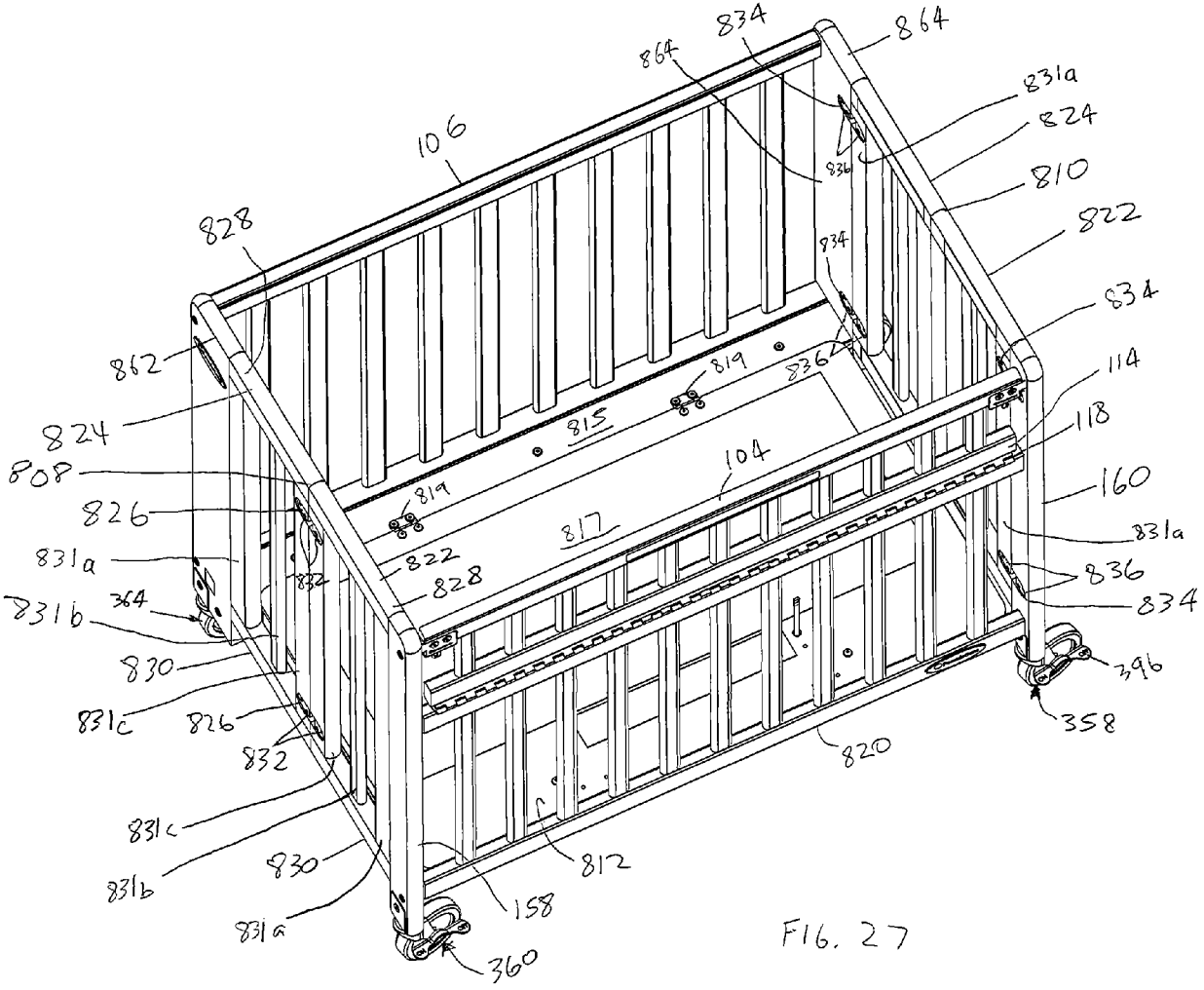
FIG. 27 is a front and top perspective view of the embodiment of the crib of FIG. 26.

As seen in FIG. 27, in the exemplary embodiment, the bottom portion 812 includes a rear mattress support member 815 that is fixed to the vertical members 862 and 864 and extends between them. The rear mattress support member 815 also extends forwardly from the rear wall 106 to side walls 808, 810. A mattress support board 817 is pivotally connected to the rear mattress support 815 member by a pair of hinges 819 or other suitable pivoting devices to allow the mattress support board 817 to move relative to the rear mattress support member 815 from a horizontal position (FIGS. 26 and 27) in which the mattress support board 817 rests upon the lower horizontal rail 820 of the front wall 104 to a vertical position (FIG. 28) in which the opposite longitudinal side ends 821 of the mattress support board 817 are faced in the vertical direction. Alternatively, the mattress support board 817 may rest upon a front support or other structure that is fixed to the front wall 104 and/or vertical members 158, 160 in the horizontal position. The walls 104, 106, 808, 810 of the crib 800 may be comprised of vertical slats, rails, posts, boards, and any other elements operative to form a barrier that keeps a child within the interior space. These described elements of the crib 800 may be made out of materials such as wood, plastic, metal, and combinations thereof and/or other materials operative to form a barrier. Also one or more of these described elements of the crib may be integrally formed and/or may be fastened together via fasteners (e.g., screws, bolts, clips, adhesives).

In an example embodiment, at least one wall of the crib 800 may include the pivoting drop gate 114. In the example shown in FIGS. 26-27, the front wall 104 of the crib includes the drop gate 114 which is in an upper closed position. The drop gate 114 and related elements are similar in structure and function to the drop gate of the exemplary embodiment of FIGS. 1-10 and will be described briefly in the interest of brevity. To enable the drop gate 114 to pivot relative to the lower stationary portion 116, the crib may include at least one hinge 118 positioned between the drop gate 114 and the stationary portion 116 of the wall 104. Such a hinge may correspond to at least one elongated piano hinge or one or more of any other type of hinges that are capable of enabling the drop gate to pivot with respect to the stationary portion of the wall. This hinge is similar to that of the embodiment shown in FIGS. 1-6. However, it should be noted that other types of hinges may instead be used that do not include a gap.

The example embodiment of the crib 800 may also include the two latch devices 150, 152 as seen in FIGS. 1 and 6-10 on opposed side ends 154, 156 of the drop gate 114 and adjacent portions of the vertical members 158, 160 that bound the opposed side ends 154, 156 of the drop gate. As shown in FIG. 26, such vertical members 158, 160 may correspond to posts and/or side ends of the side walls 808, 810 of the crib. Each of the side walls 808, 810 includes a pair of side panels 822, 824 that are pivotally connected to each other by a pair of hinges 826. The side panels 822, 824 are generally equal in length, height, and thickness. In an exemplary embodiment, the hinges 826 may be butler hinges, which are also referred to recessed or pocket pivot hinges. In essence, each of these butler hinges 826 is flushed with its associated side panels 822, 824 and does not protrude into the crib interior 802 so that clothing, bedding, or other objects do not get caught in the hinge when the crib 800 is unfolded. No part of the butler hinge 826 projects beyond the face of its associated side panels 822, 824 in either the folded or unfolded position of the crib 800.

Each side panel includes upper and lower horizontal rails 828, 830 interconnected by vertical slats 831*a*, 831*b*, 831*c*. Each hinge 826 includes a pair of hinge plates 832 that are mortised into the outer (facing away from the crib interior) surfaces of the two adjacent vertical slats 831*c* of the respective side panels 822, 824 at their junction, so that when the crib is unfolded or extended the side panels 822, 824 are in close proximity to each other such that space between them is not large enough for a baby to get his finger or thumb caught and/or pinched between the side panels 822, 824. As seen in FIGS. 26 and 27, each of the side panels 822, 824 is also pivotally connected to a respective adjacent vertical member 158, 160, 862, or 864 by hinges 834 or other pivoting devices. Each hinge 834 includes a pair of hinge plates 836 that are mortised into the crib interior facing surfaces of the vertical member and the slat 831*a* adjacent the vertical member, so that when the crib 800 is unfolded or extended, the side panel and respective adjacent vertical member are in close proximity to each other such that the space between them is not large enough for a baby to get his finger or thumb caught and/or pinched between the side panel 822 or 824 and associated vertical member. In an exemplary embodiment, the hinges 834 may be butler hinges in which each of the hinges 834 is flushed with the side panel and associated vertical member 158, 160, 862, or 864 and does not protrude into the crib interior 802 so that clothing, bedding, or other objects do not get caught in the hinge when the crib is unfolded. No part of each of the butler hinges 834 projects beyond the face of its associated side panel or vertical member 158, 160, 862, 864 in either its folded or unfolded position. The hinges 826, 834 may be configured to enable the side panels 822, 824 to pivot or fold inwardly into the interior space 802 but not outwardly.

FIGS. 26 and 27 show the crib 800 in the unfolded or extended position for use. In this position, each pair of adjacent side panels 822, 824 are extended and the mattress support board 817 (FIG. 27) is in the horizontal position abutting the side panels 822, 824 of the side walls 808, 810 to prevent the side panels 822, 824 from folding inwardly and hence the crib 800 from being in the folded position. In this extended position, the mattress support board 817 also abuts the lower horizontal rail 820 or otherwise interferes with the lower rail 820 to prevent the front wall 104 from being moved rearwardly to the folded position.

Figure 28:
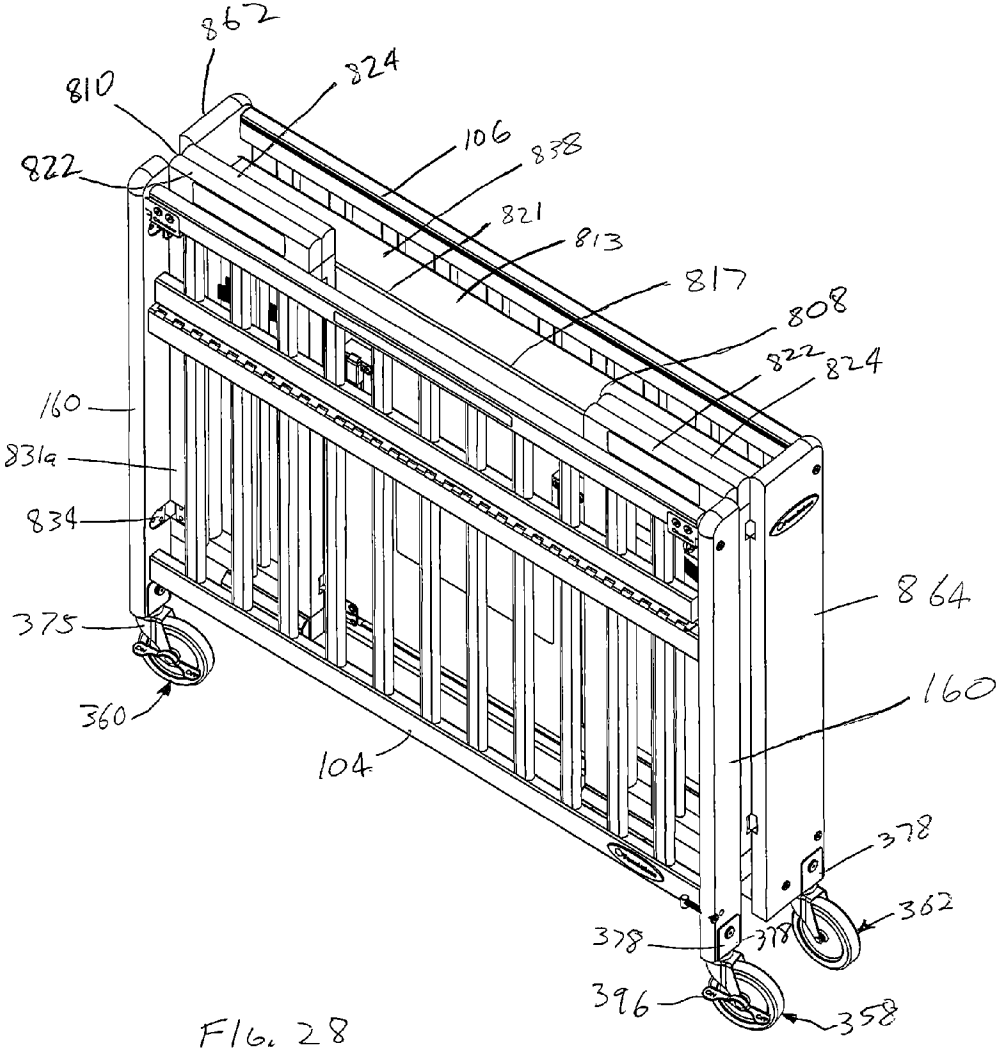
FIG. 28 is a view similar to FIG. 26 except that the crib is in a folded position.

When the mattress support board 817 pivots to the vertical position as shown in FIG. 28, the mattress support board 817 moves out away from the side panels 822, 824 and front wall 104 to enable the adjacent side panels 822, 824 to pivot and extend inwardly and fold upon each other which causes the front and rear walls 104, 106 to move toward each other to place the crib 800 in the folded position, which folded position is shown in FIG. 28. In this collapsed or folded position, the mattress 813 may be positioned in a vertical orientation with the opposite longitudinal side ends 838 of the mattress 813 facing vertically, and located in the space bounded by the rear wall 106, rear vertical members 862, 864 and the side panels 824 closest to the rear wall 106. The rear wall 106 and rear vertical members 862, 864 may be in contact with the mattress 813 and the side panels 824 may be in contact with the mattress support board 817 such that the rear wall 106, vertical members 862, 864, and side panels 824 snugly support the mattress 813 in the vertical position.

As seen FIG. 28, the width of the mattress 813 is less than the height of the rear wall, to minimize or reduce the storage space required for the crib 800. The crib 800 also includes casters 358, 360, 362, 364 operatively connected to the lower ends of their respective vertical members 158, 160, 862, 864 so as to be in contact with the floor. The casters and related elements are similar in structure and function to the casters and related elements depicted in FIG. 12-16.

Figure 29:
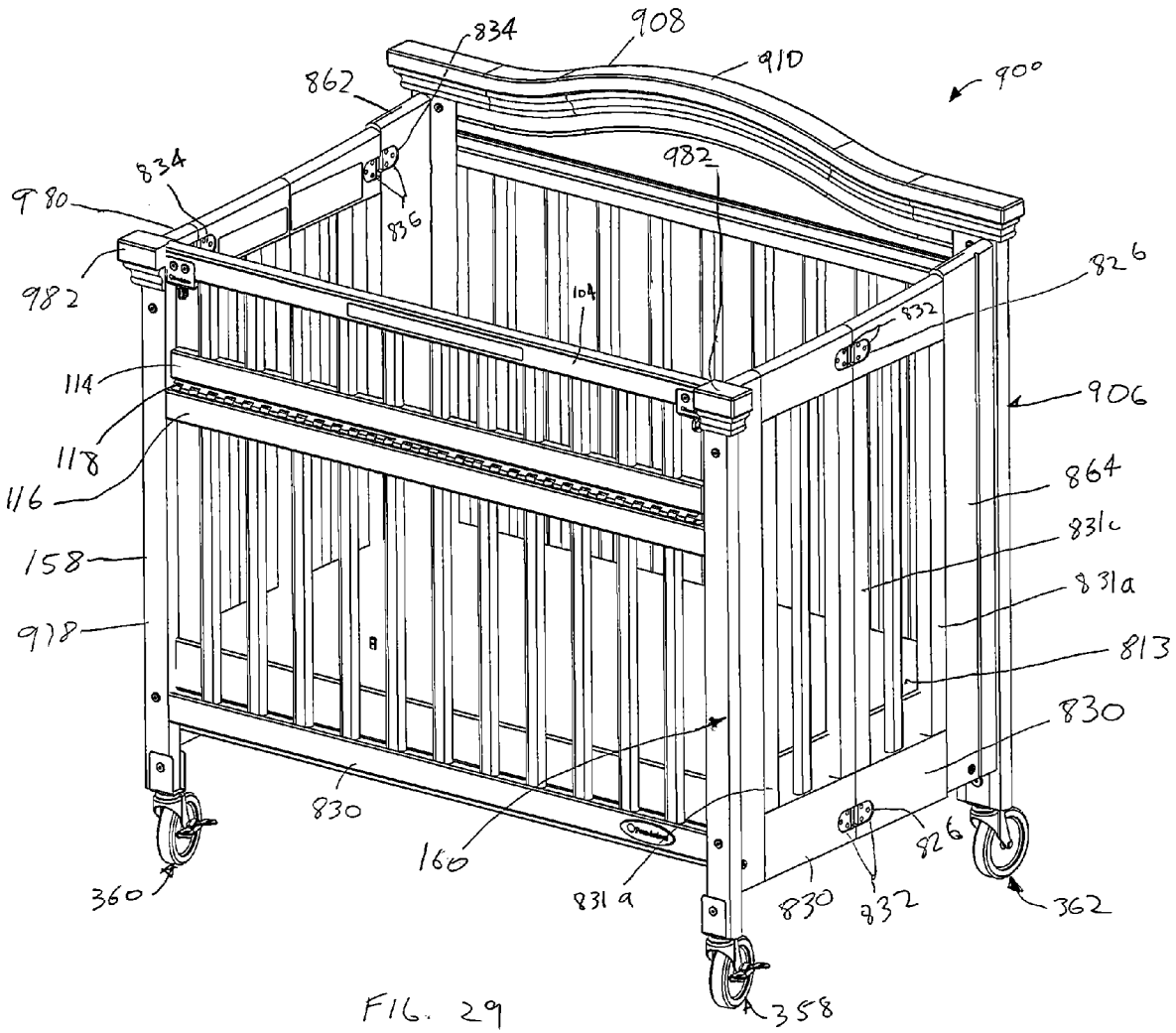
FIG. 29 is a front and right perspective of another exemplary embodiment of a crib.
Figure 30:
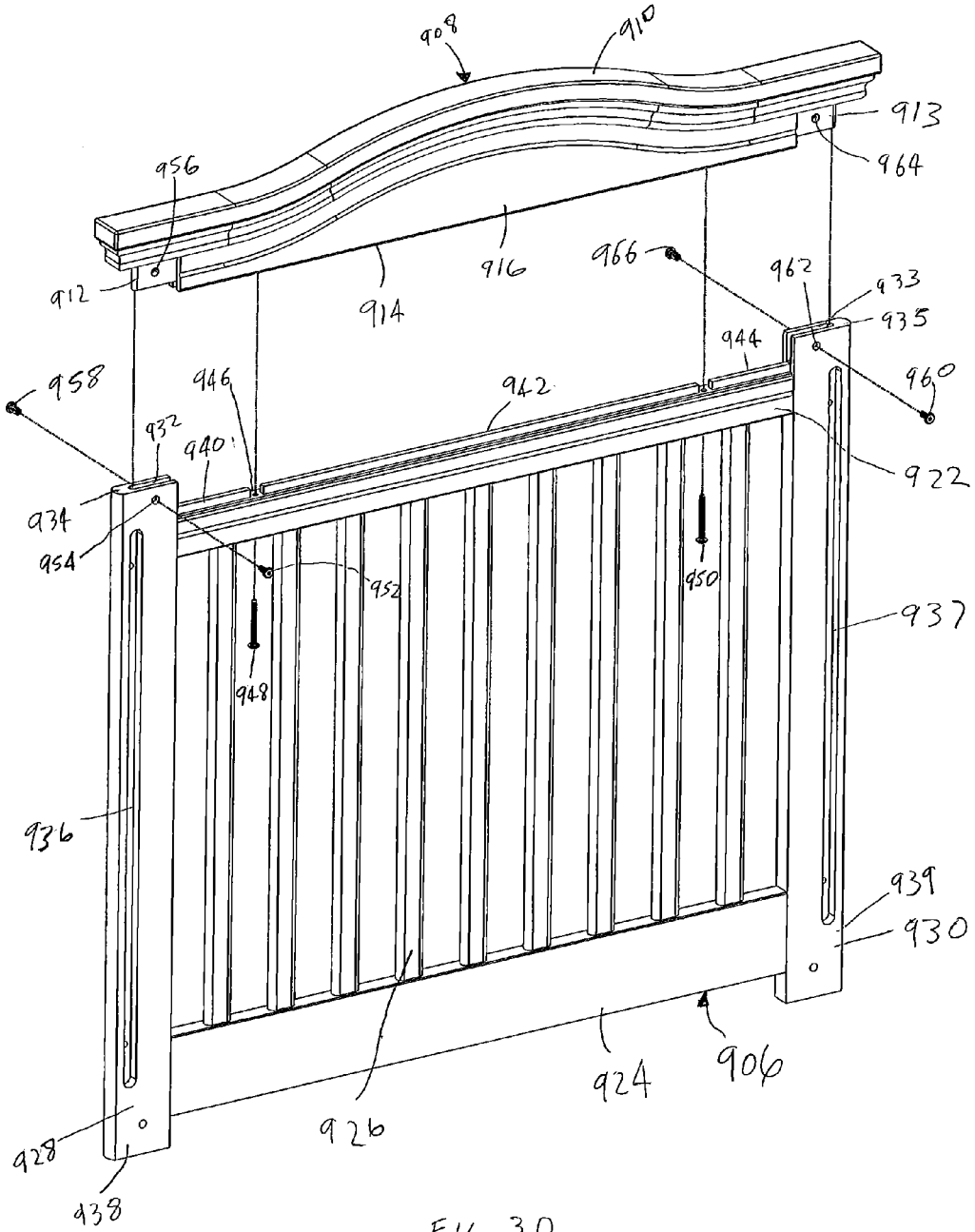
FIG. 30 is a front and left exploded view of the rear wall and headboard of the crib of the embodiment of FIG. 29.
Figure 31:
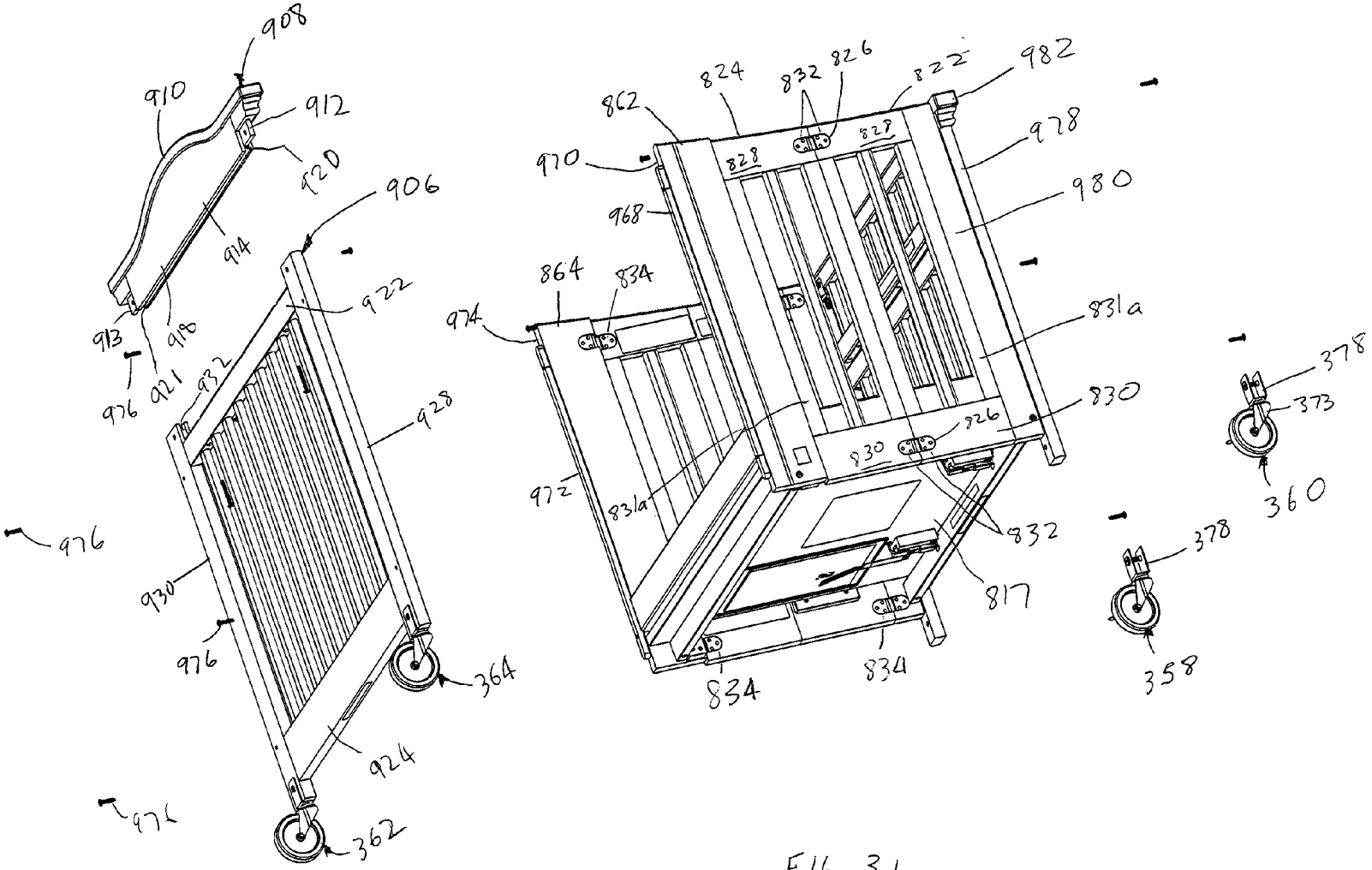
FIG. 31 is bottom and left exploded view of the crib of the embodiment of FIG. 29.

FIG. 29 shows another exemplary embodiment of a foldable or collapsible crib 900 with the drop gate 114. In this embodiment, the crib 900 is similar to the crib 800 except for that discussed below. In this embodiment, the crib 900 includes a headboard 908 removably mounted to a rear wall 906. The headboard 908 may be formed in one piece or multiple pieces. Referring to FIGS. 30 and 31, the headboard 908 may include a curved top portion 910, tongues 912, 913, and a channeled connector 914. Alternatively, the top portion may take a variety of shapes. For example, the top portion may be flat instead of curved. The tongues 912, 913 are attached to the bottom of the top portion 910 and are spaced longitudinally from each other. The tongues 912, 913 extend downwardly from the top portion 910. The channeled connector 914 is positioned between the tongues 912, 913 and abuts or extends longitudinally in close proximity to each of the tongues 912, 913. The channeled connector 914 includes spaced apart front and rear walls 916, 918 that extend downwardly from the base 920 of the connector 914. The walls 916, 918 in combination with the base 920 define a channel 921 (FIG. 31). The rear wall 906 also comprises upper and lower horizontal rails 922, 924 that are interconnected by vertical slats 926 or panrel. The rails 922, 924 axially extend between vertical posts 928, 930 and are attached to the vertical posts 928, 930 at their axial ends. Referring to FIG. 30, the vertical post 928 includes a recess 932 formed in the top side 934 of the post 928 and an elongated groove 936 formed in inner facing side 938 of the vertical post 928. Likewise, the vertical post 930 includes a recess 933 formed in the top side 935 of the post 928 and an elongated groove 937 formed in inner facing side 939 of the vertical post 928. Three ribs 940, 942, 944 are attached to the top side 946 of the upper rail 922. The ribs 940, 942, 944 are longitudinally spaced apart from each other and extend along the length of the upper rail 922.

When the headboard 908 is mounted to the rear wall 906, the ribs 940, 942, 944 are inserted into the channel 921, the tongue 912 is inserted into the recess 932 of the vertical post 928, and the tongue 913 is inserted into the recess 933 of the vertical post 930. A first threaded bolt 948 extends through the upper rail 922 between ribs 940, 942, and into the base 920 and a second threaded bolt 950 extends through the upper rail 922 between ribs 942, 944 and into the base 920 to threadily fasten the headboard 908 to the upper rail 922. To secure the headboard 908 to the left vertical post 928, a third threaded bolt 952 extends through apertures 954, 956 in the left vertical post 928 and the left tongue 912 and is threadily received by a T-nut 958. To secure the headboard 908 to the right vertical post 930, a fourth threaded bolt 960 extends through apertures 962, 964 of the right vertical post 930 and right tongue 913 and is threadily received by a T-nut 966. To remove the headboard 908, the threaded bolts 948, 950, 952, 960 and T-nuts 958, 966 are unfastened and removed, and the headboard 908 is moved upwardly such that the tongues 912, 913 are slid out of their respective recesses 932, 933 and the ribs 940, 942, 944 are slid out of the channel 921.

Figure 41:
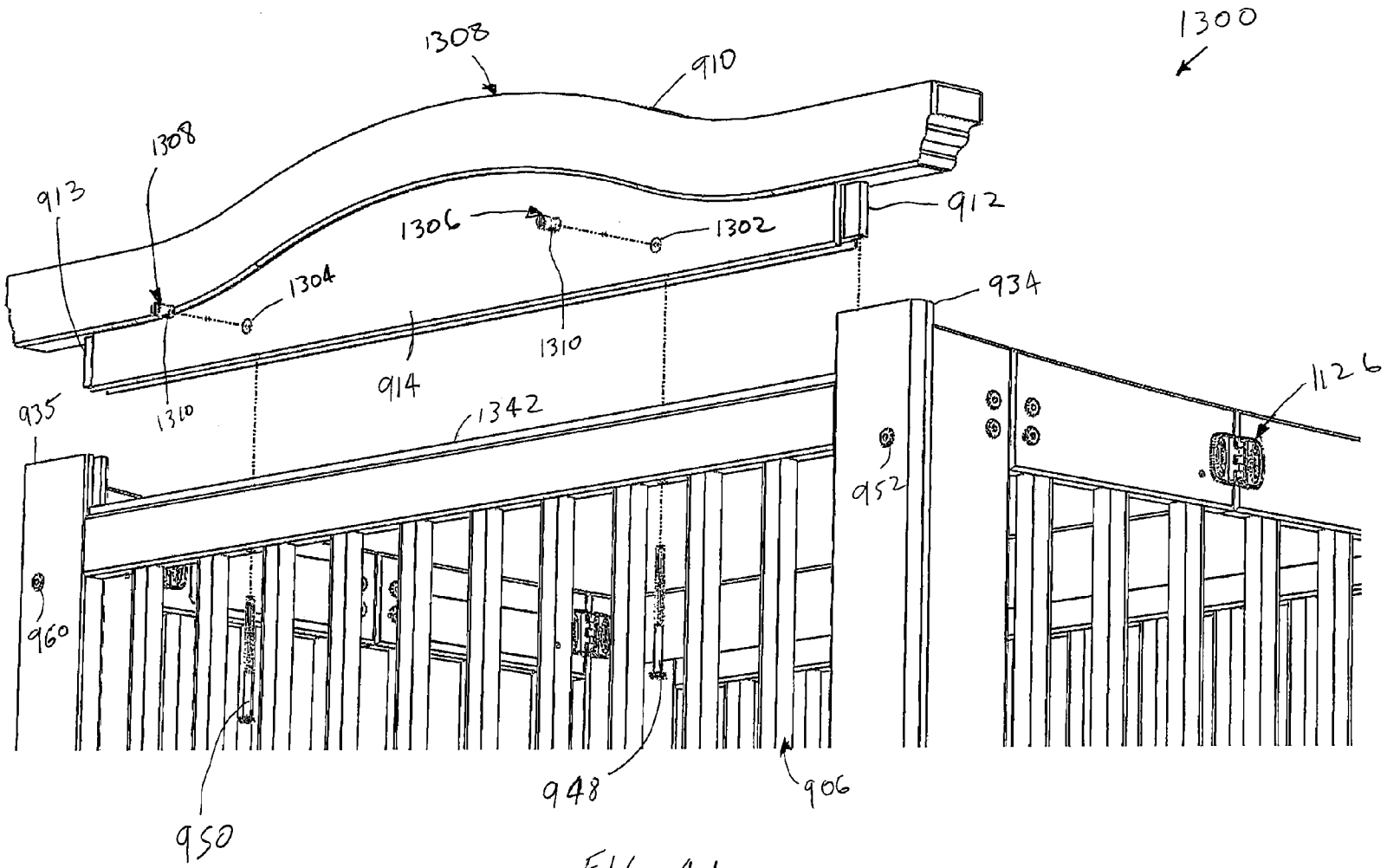
FIG. 41 is a rear exploded view of the headboard of the crib and a portion of the crib with another exemplary embodiment.

Alternatively, other types of ways may be used to connect the headboard 908 to the rear wall 906. For example, a reversal of these parts may be used to removably connect the headboard 908 to the upper rail 922. In particular, the headboard 908 may have ribs that are inserted into a channel on the upper rail and recesses that receive tongues of the vertical posts. FIG. 41 shows another exemplary embodiment that includes another type of way to connect the headboard to the rear wall. In this exemplary embodiment, the crib 1300 is similar to the crib 900 except for that discussed below. In this exemplary embodiment, channel connector 914 of the headboard 1308 includes a pair of lateral apertures or recesses 1302, 1304 for receiving respective barrel nuts 1306, 1308. In this exemplary embodiment, the three ribs 940, 942, 944 are replaced by one rib 1342 that is attached to the top side 946 of the upper rail 922 and extends along the length of the upper rail 922. Also, in this embodiment, the width of each of the tongues 912, 913 and recesses 932, 933 is shorter than that of the embodiment shown in FIG. 30. Also, the tongues 912, 913 do not have apertures that receive the threaded bolts 952, 960 and T-nuts 958, 966. Also, the apertures 954, 962 that receive the threaded bolts 952, 960 and T-nuts 958, 966 are positioned lower than that of the embodiment shown in FIG. 30.

When the headboard 1308 is mounted, the rib 1342 is inserted into the channel 921, and the threaded bolts 948, 950 extend through the rib 1342 and threadily engage respective threaded openings 1310 in their respective barrel nuts 1306, 1308. To remove the headboard 908, the threaded bolts 948, 950 are unfastened from their respective barrel nuts 1306 and removed, and the headboard 908 is moved upwardly such that the tongues 912, 913 are slid out of their respective recesses 932, 933 and the rib 1342 slides out of the channel 921. The removability of the headboard allows for a reduction in the height of the package needed to ship or transport the crib, thereby reducing the costs of shipping. Further, this removability feature allows for different types of removable headboards to be interchanged with the crib.

Referring to FIG. 31, a rib or insert 968 is attached to the rearward facing side 970 of the vertical members 862, and a rib or insert 972 is attached to the rearward facing side 974 of the vertical member 864. When the rear wall 906 is assembled to the vertical members 862, 864, the inserts 968, 972 are inserted into their respective grooves 936, 937 on the vertical posts 928, 930. Fasteners 976 such as threaded bolts or screws are threadily extended through the vertical posts 928, 930 and vertical members 862, 864 to fastened the vertical posts 928, 930 to the vertical members 862, 864. The crib 900 also has the upper rails 828 of the side panels 822, 824 inclining upwardly going in the rearward direction. Further, the hinge plates 832 of one hinge 826 are mortised into the outer (facing away from the crib interior) surfaces of the upper rails 828 of the respective side panels 822, 824 at their junction, and the hinge plates 832 of the other hinge 826 are mortised into the outer (facing away from the crib interior) surfaces of the lower rails 830 of the respective side panels 822, 824 at their junction.

Figure 32:
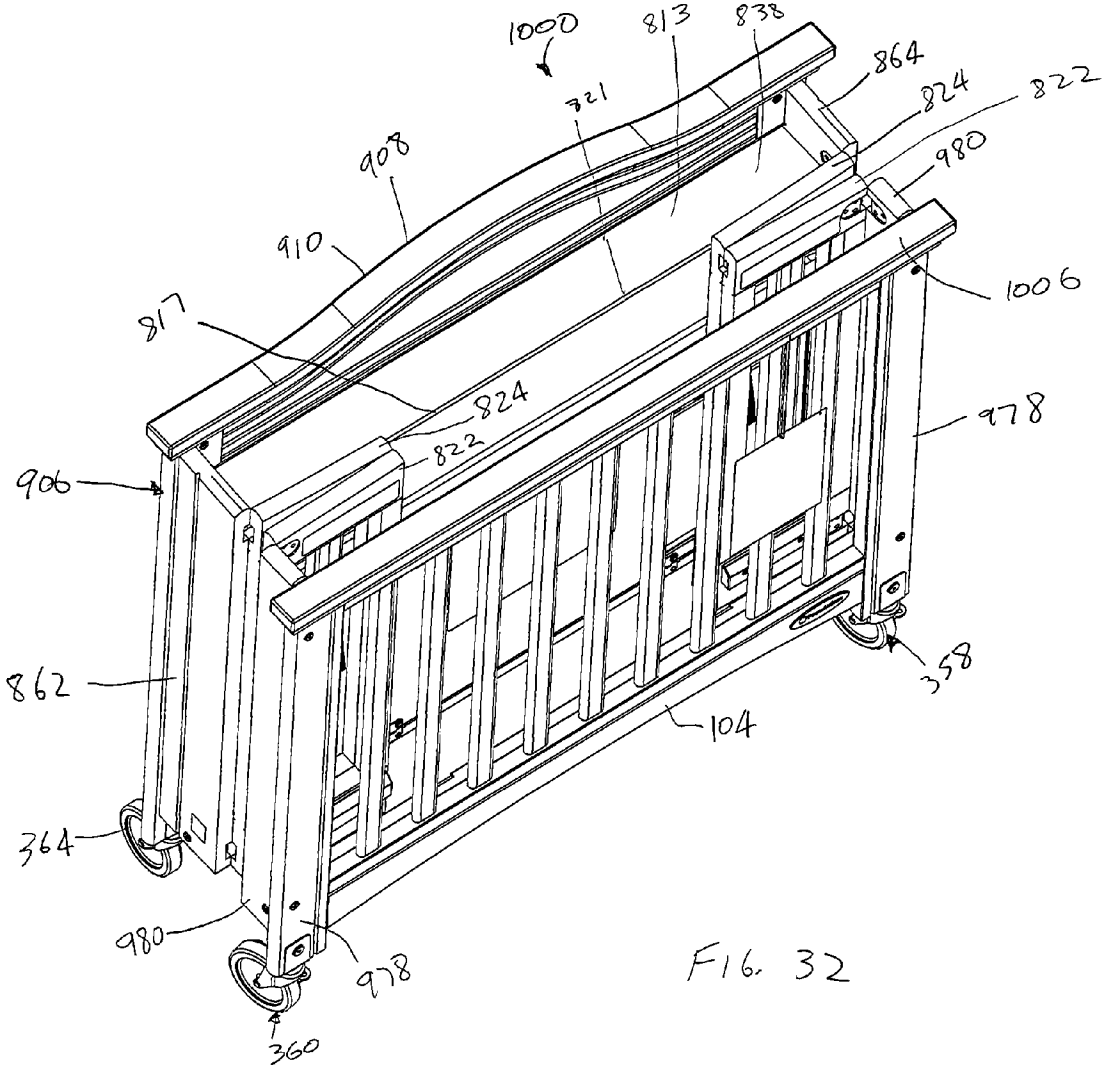
FIG. 32 is a front and left perspective view of another exemplary embodiment of a crib in a folded position.

Also, in this exemplary embodiment, the vertical members 158, 160 that span the front wall 104 each comprises front and rear vertical pieces 978, 980 fixed to each other. Each rear vertical piece 980 is located adjacent the side panel 822 and is of the same thickness as the side panel 822. The front vertical pieces 978 are located on opposite side ends of the front wall 104. The crib 900 may also include decorative headposts 982 provided on the top of the front vertical pieces 978 of the vertical members 158, 160 to aesthetically match the shape of the top portion 910 of the headboard 908. FIG. 32 shows a crib 1000 with the removable headboard 908 in a folded or collapsed position. This crib 1000 is the same in structure and function as that of the crib 900 except that the front wall 104 does not include the drop gate feature or headposts. Instead, a top portion 1006 is attached to the top of the two front vertical pieces 978 and extends between them. This top portion 1006 aesthetically matches the top portion 910 of the headboard 908.

Figure 33:
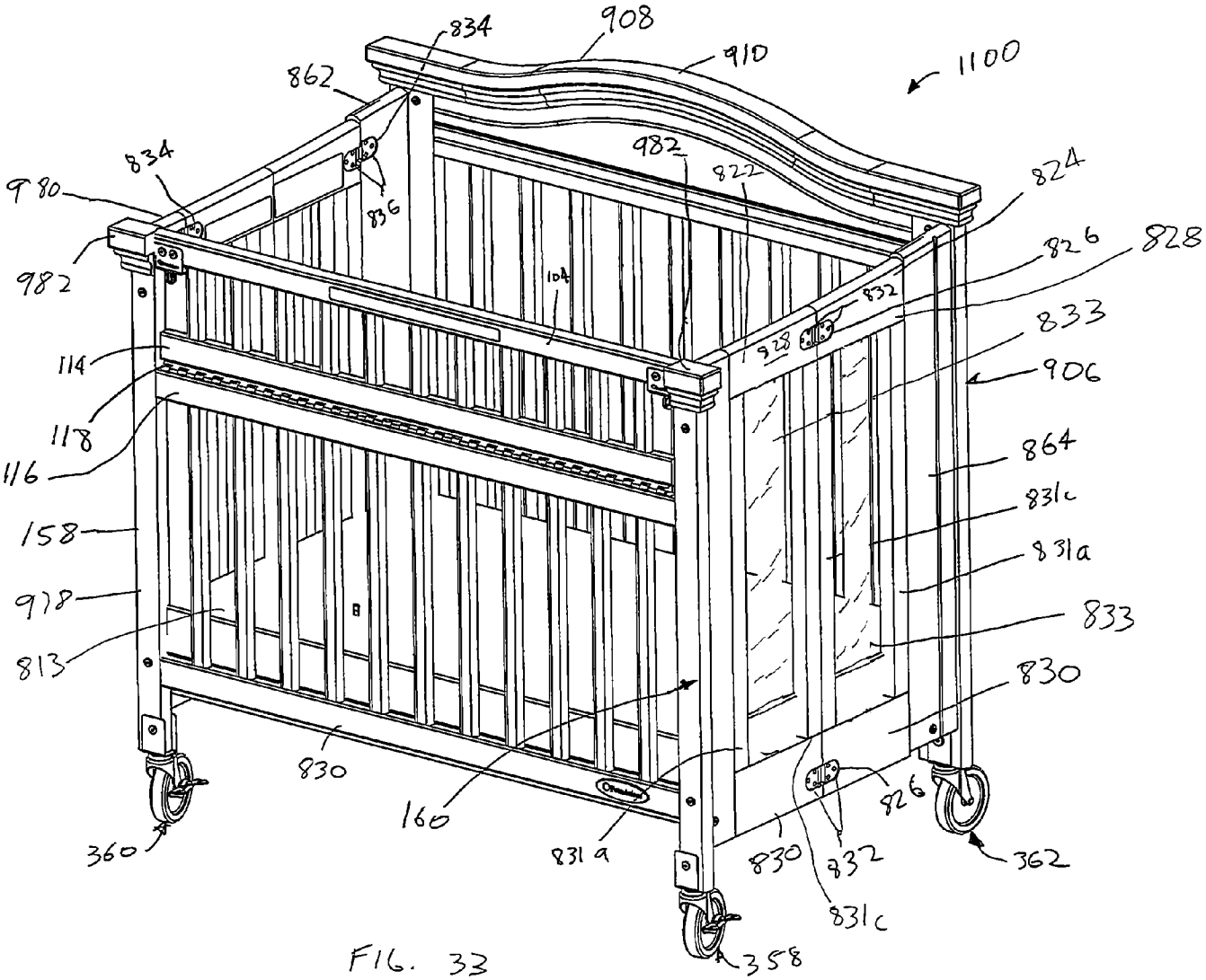
FIG. 33 a front and right perspective of another exemplary embodiment of a crib.

Alternatively, or additionally, solid panel portions may be provided on the side panels 822, 824 instead of or in addition to the vertical slats to protect the child in the crib. The panel portions may be clear or opaque and made of acrylic, glass, or other suitable material. For example, in another exemplary embodiment of a crib 1100 as depicted in FIG. 33, a panel portion 833 made of clear acrylic material may be provided between vertical slat 831*a* and vertical slat 831*c* of the side panels 822 and another panel portion 833 made of clear acrylic material may be provided between vertical slat 831*a* and vertical slat 831*c* of the side panels 824. Vertical slat 831*b* is not included in this embodiment. Each panel portion 883 extends between the slats 831*a*, 831*c* and at least between the upper and lower rails 828, 830 to cover the space in its respective side panel bounded by the slats 831*a*, 831*c*, and rails 828, 830. In essence, each of the side panels 822, 824 is completely covered by a respective panel portion 833, rails 828, 830, and slats 831*a*, 831*c* to prevent finger, hands or other objects from entering or exiting the crib 1100 through the side panel. The crib 1100 is similar to the crib 900 in all other aspects.

Figure 34:
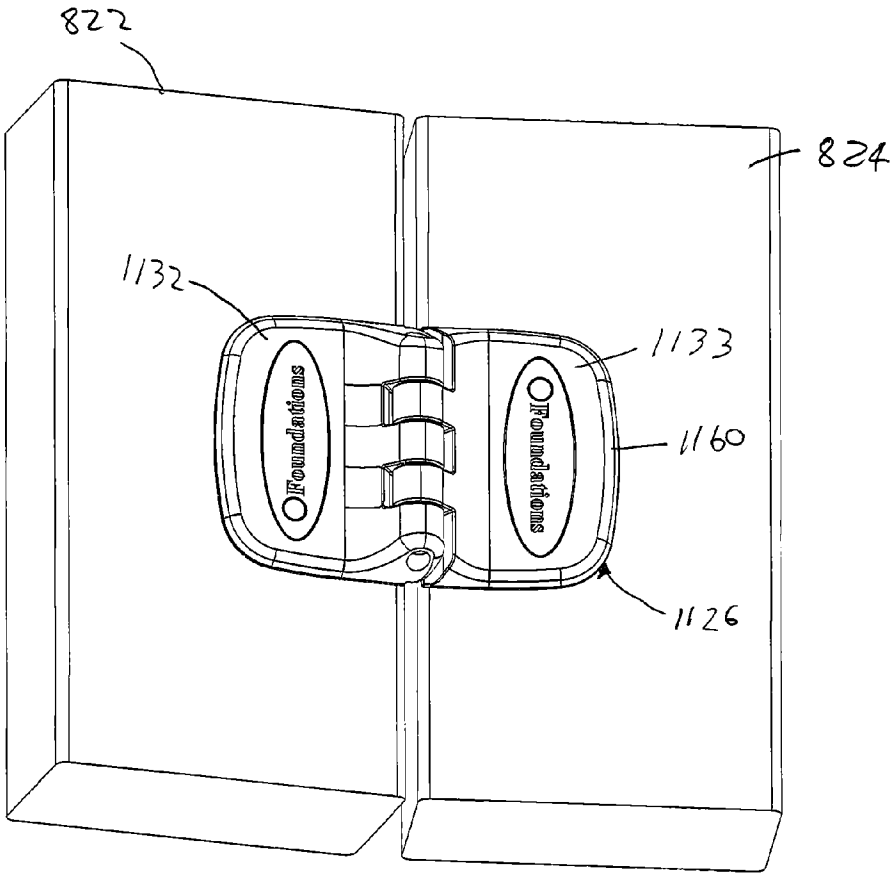
FIG. 34 is a right side perspective view of a portion of the crib showing another exemplary hinge arrangement.
Figure 35:
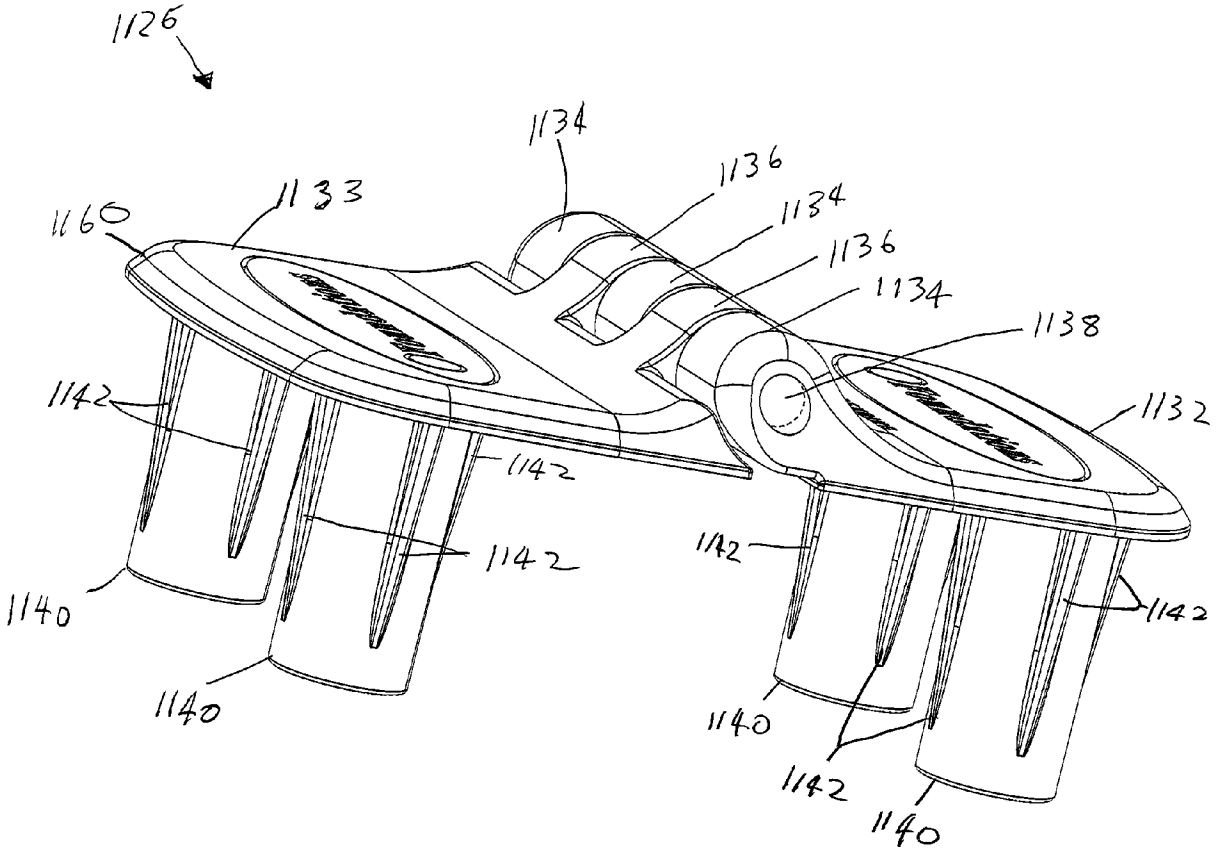
FIG. 35 is a top and side perspective view of the hinge of FIG. 34.

FIGS. 34-38 show another exemplary hinge arrangement for pivotally connecting the side panels or side panel and vertical member together. In this arrangement, the hinges 1126 are made of metal such as steel and manufactured using a cast metal alloy process. Other suitable processes to manufacture the hinge could also be used such as a stamping or extrusion process. Alternatively, the hinges 1126 may be made of plastic material by using, for example, plastic injection molding or other suitable process. Referring to FIG. 34, the hinges 1126 are mounted to the side panels 822, 824 to pivotally connect the side panels 822, 824 to each other. Also, these hinges 1126 may be mounted to each of the side panels 822, 824 and its respective adjacent vertical member 158, 160, 862, or 864 to pivotally connect each of the side panels to its respective adjacent vertical member 158, 160, 862, or 864 as previously mentioned. As seen in FIG. 35, each hinge 1126 includes a pair of first and second hinge plates 1132, 1133. The first hinge plate 1132 includes three knuckles 1134 that are vertically aligned with each other and vertically spaced apart from each other. The second hinge plate 1133 includes two knuckles 1136 that are vertically aligned with each other and vertically space apart from each other. The two knuckles 1136 are also vertically spaced from the upper and lower (with respect to the crib) edges of the second plate 1133. The two spaces separating adjacent knuckles 1134 of the first hinge plate 1132 receive the two knuckles 1136 of the second hinge plate 1133. The space between the two knuckles 1136 and the spaces between the knuckles 1136 and lower and uppers edges of the second plate 1133 receive the three knuckles 1134 of the first plate 1132.

Figure 36:
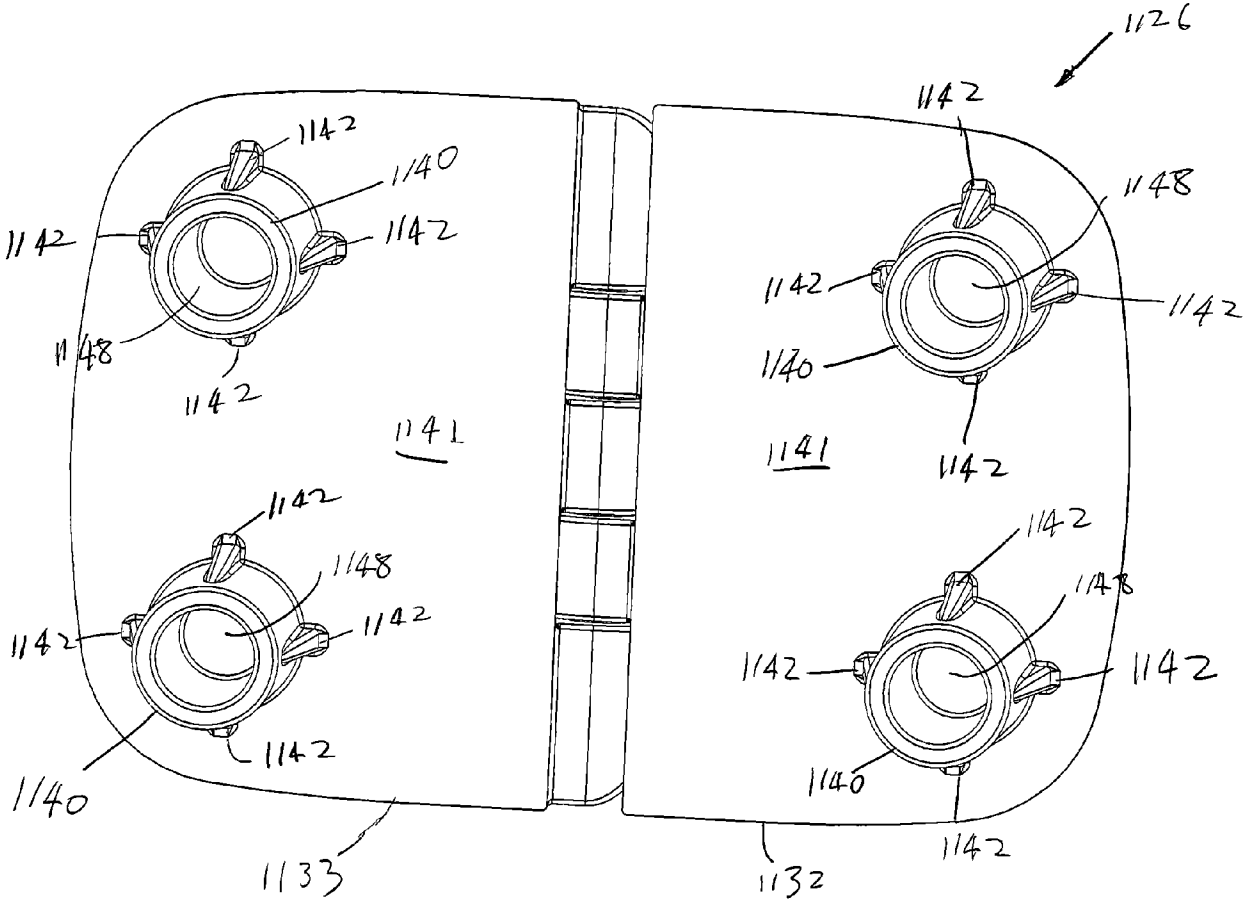
FIG. 36 is a bottom perspective view of the hinge of FIG. 34.

When assembled, the knuckles 1134, 1136 are vertically aligned with each other and receive a pivot pin 1138 extend vertically through them. The plates 1132, 1133 pivot about the pivot pin 1138. The pivot pin 1138 may be made of hard plastic or other suitable hard material such as steel. As seen in FIGS. 35 and 36, four bosses 1140 are integrally attached to the plates 1132, 1133. Two bosses 1140 are each formed in one piece with the first plate 1132 and two bosses 1140 are each formed in one piece with the second plate 1133. The bosses 1140 extend perpendicularly with respect to the pivot axis of the hinge 1126 from the bottom surface 1141 (with respect to the hinge 1126) of their respective plates 1132, 1133. Each boss 1140 may include four support ribs 1142 circumferentially spaced around body of the boss 1140. Each support rib 1142 is integrally attached to the respective plate 1132 or 1133 and body of the boss 1140 and formed in one piece with them. Each support rib 1142 is triangular in shape and flares or angles outwardly going towards the plate 1132 or 1133. This creates a wedge effect that allows the support ribs 1142 to penetrate or bite into the wood defining the drilled holes 1146 (FIG. 38) of the side panel 822, 824 or vertical member to help locate and stabilize the hinge 1126 upon and after the boss 1142 is inserted into the side panel or vertical member. The ribs 1142 also provide support for the boss 1140. Alternatively, the boss 1140 may not include the ribs as shown in FIG. 37.

Figure 37:
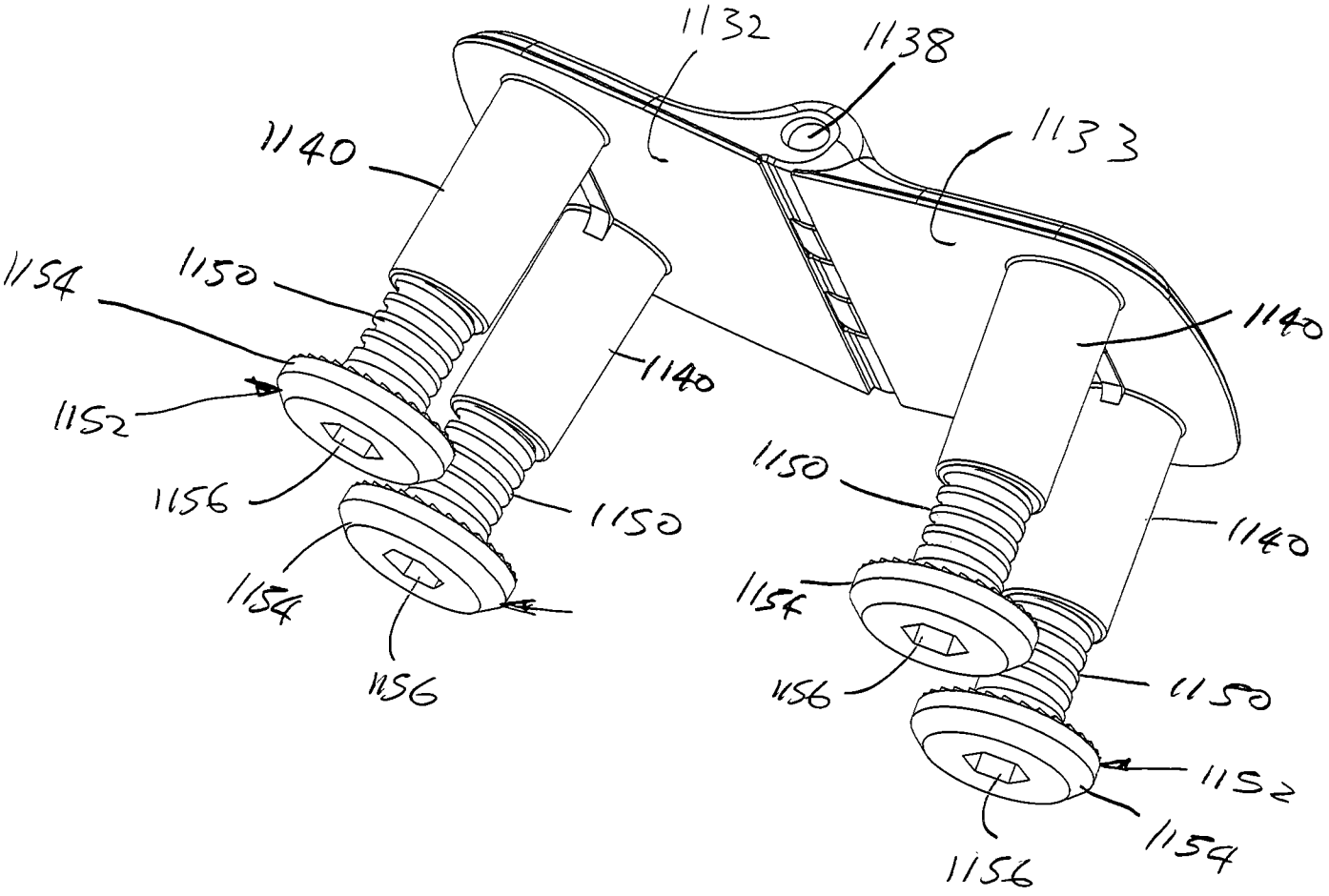
FIG. 37 is a bottom and side perspective view of the hinge and related elements but without the ribs of FIG. 34.
Figure 38:
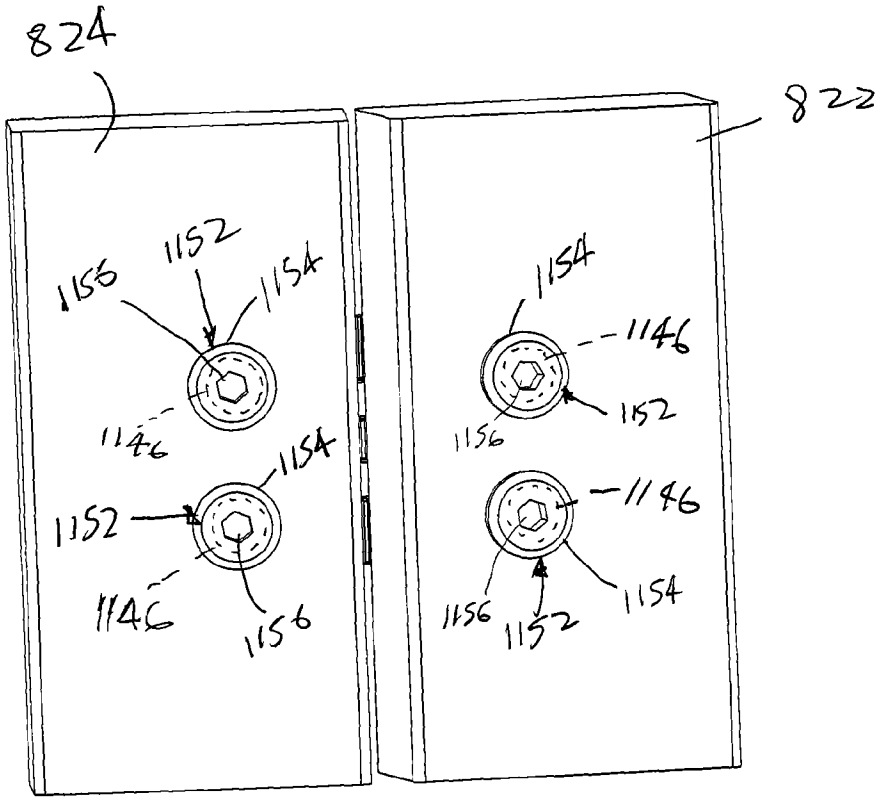
FIG. 38 is left side view of the portion of the crib and hinge arrangement shown in FIG. 34.

Each boss 1140 further includes a bore 1148 (FIG. 36) that threadily receives a threaded shaft 1150 of a bolt 1152 as depicted in FIG. 37. The bosses in FIG. 37 are shown without the ribs 1142. Each bolt 1152 also includes a head 1154 that is serrated on its underside. The head 1154 has a diameter that is larger than its corresponding drilled hole 1146 of the side panel or vertical member and also its corresponding bore 1148 in the boss 1140. The top of the head 1154 includes a recess 1156 that is configured to receive an Allen wrench. The hinge 1126 is mounted to its respective side panels or side panel and vertical member by inserting the bosses 1140 through the their respective drill holes 1146 until the plates 1132, 1133 abut the side panel or vertical member such that there are no gaps between the side panel or vertical member for a child's finger to get caught. Each bolt 1152 is then threadily inserted into its respective bore 1148 until the underside of the head 1154 engages its respective side panel or vertical member.

Figure 39:
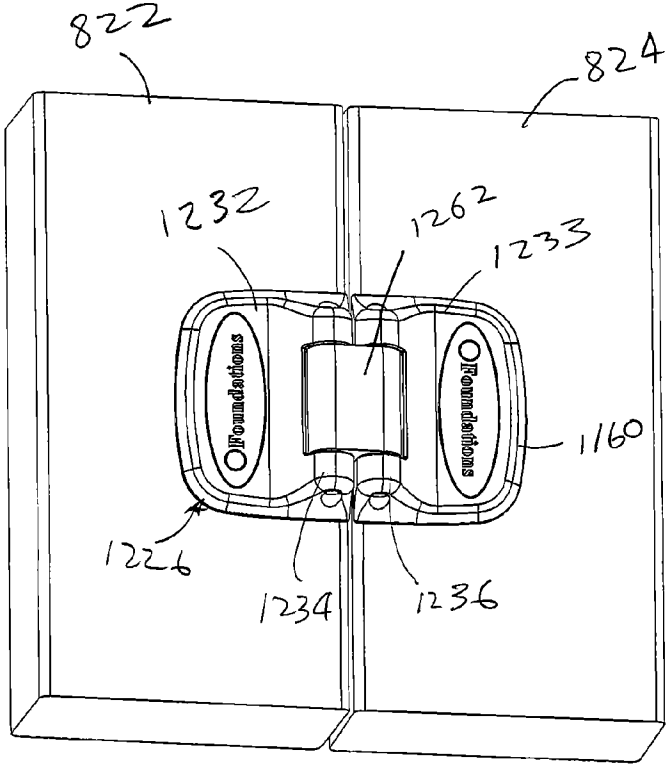
FIG. 39 is a right side perspective view of a portion of the crib showing still another exemplary hinge arrangement.
Figure 40:
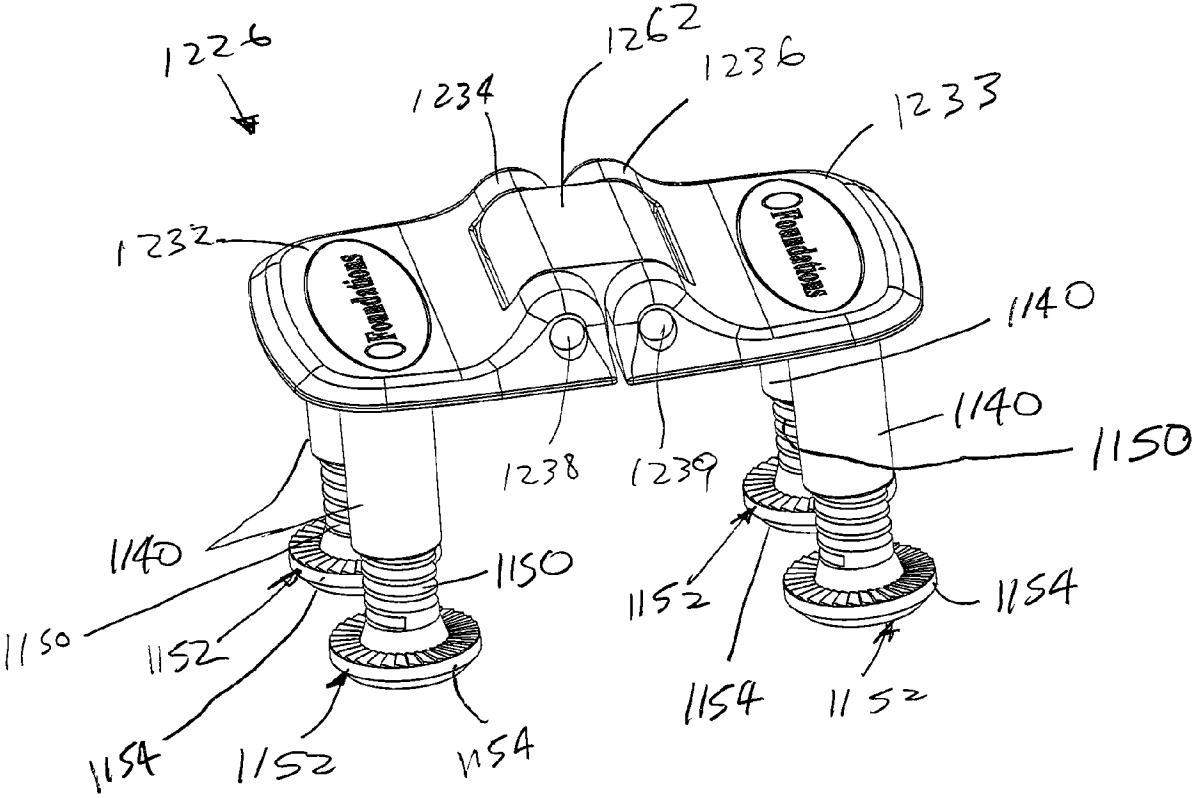
FIG. 40 is a top and side perspective view of the hinge and related elements but without the ribs of FIG. 39.

The hinge 1126 allows the pivoting and folding of the side panels and vertical members similar to that as previously mentioned. The plate includes a beveled edge 1160 to help prevent a child's finger from getting pinched therebetween. This hinge 1126 also diminishes the potential hazard of strings/cords, such as a hooded top that a child may be wearing from getting caught in between. FIGS. 39 and 40 show a hinge 1226 with double pins 1238, 1239. Specifically, the hinge 1226 includes a first plate 1232 with knuckles 1234 that receive a first pivot pin 1238 and a second plate 1233 with knuckles that receive a second pivot pin as seen in FIG. 40. A link member 1262 extends over the pins 1238, 1239 and interconnects in a manner that allows the plates 1232, 1233 to pivot with respect to each other. In all other aspects, the hinge 1226 and related elements is similar to that of the hinge 1126.

Similar reference numbers are used to refer to similar elements in structure and function for both hinges. As can be seen, the hinges 1126, 1226 are surface mounted on the surfaces of the side panels and vertical members instead of being mounted in recesses mortised in the side panels and vertical members.

Also, it should be appreciated that the one or more of the described principles and features described herein related to a crib, may be applied to alternative embodiments and configurations of cribs. It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A crib comprising:

first, second, third, and fourth walls configured to bound an interior space that is operative to support a mattress therein;

wherein the third wall comprises first and second panels, wherein the fourth wall comprises third and fourth panels, wherein the first and second panels are pivotally connected to each other and the third and fourth panels are pivotally connected to each other to enable the crib to be configured between a folded position for storage and an extended position for use;

wherein the first wall includes:

a stationary portion;

a drop gate, wherein the drop gate includes opposed side ends;

wherein the drop gate pivots relative to the stationary portion between an upper closed position and a lower open position;

first, second, third and fourth vertical members, wherein the first and second vertical members are positioned adjacent opposed side ends of the drop gate when the drop gate is in the closed position, wherein the third and fourth vertical members are position at least in close proximity to the opposed side ends of the second wall, wherein the third and fourth walls are opposite each other, wherein the first panel of the third wall is in operative pivotal connection with the first vertical member and the second panel of the third wall is in operative pivotal connection with the third vertical member, wherein the fourth panel of the fourth wall is in operative pivotal connection to the fourth vertical member and the third panel of the fourth wall is in operative pivotal connection to the second vertical member;

a first mattress support member; and a second mattress support member, wherein the second mattress support member is fixed to the third and fourth vertical members and extends between the third and fourth vertical members, wherein the second mattress support member is configured to extend underneath the mattress, wherein the first mattress support member is pivotally connected to the second mattress support member by at least one first hinge to enable the first mattress support member to pivot between a horizontal position and a vertical position, wherein in the horizontal position, the first mattress support member prevents the crib from being in the folded position, wherein the second mattress support member remains stationary as the first mattress support member pivots between the horizontal position and the vertical position, wherein the second mattress support member is configured to face the mattress in an upward direction when the first mattress support member is in the vertical position.

2. The crib according to claim 1 including a headboard removably mounted to one of the first and second walls.

3. The crib according to claim 2 wherein one of the headboard and the one of the first and second walls includes a pair of tongues and a channel extending between the tongues, wherein the other one of the headboard and the one of the first and second walls includes a pair of recesses and at least one rib extending between the recesses, wherein each of the recesses is configured to receive a respective tongue and the channel is configured to receive the at least one rib to mount the headboard to the one of the first and second walls, wherein the first and second panels or the third and fourth panels or both the first and second panels and the third and fourth panels are connected to each other by at least one second hinge, wherein the second hinge comprises first and second hinge members that are pivotally connected to each other, wherein the second hinge includes at least one boss integrally formed in one piece with the first hinge member, wherein the boss extends into a hole formed in one of the panels, wherein the boss includes a bore for securely receiving a fastener to secure the first hinge member to the panel.

4. The crib according to claim 1 including at least one second hinge mounted to the stationary portion and the drop gate, wherein the at least one second hinge includes a pivot axis and is configured to enable the drop gate to pivot about the pivot axis and relative to the stationary portion between the upper closed position and the lower open position, wherein when the drop gate is in the closed position the at least one second hinge forms a shape having a cavity therein, which cavity has an upper inner portion and a lower inner portion, wherein the pivot axis extends below the upper inner portion and above the lower inner portion; and the formed cavity of the at least one second hinge has a height between the upper inner portion and the lower inner portion that is sufficiently large to enable a finger of a child to extend into the cavity of the at least one second hinge to be adjacent to the pivot axis, without being pinched by the at least one second hinge.

5. The crib according to claim 4, wherein when the drop gate is in the closed position the formed cavity of the at least one second hinge has a height of at least 1 cm.

6. The crib according to claim 5, wherein when the drop gate is in the open position, the drop gate extends downwardly from the at least one second hinge adjacent the stationary portion; and the at least one second hinge forms a shape that places portions of the drop gate and stationary portion that are mounted to the at least one second hinge in spaced apart relation that includes at least one gap therebetween that is sufficiently wide to enable a finger of a child to extend therein without being pinched.

7. The crib according to claim 6, wherein the at least one second hinge includes a first hinge member and a second hinge member that are in pivoting connection at the pivot axis, wherein each of the first and second hinge members include a mounted end and a pivot end, wherein the pivot ends are connected at the pivot axis, wherein the mounted ends are in operative connection with respective portions of the drop gate and stationary portion, wherein each of the first and second hinge members are bent with respect to each other.

8. The crib according to claim 7, wherein each of the first and second hinge members are bent such that the mounted and pivot ends are orientated with respect to each other at an oblique angle towards an interior of the crib.

9. The crib according to claim 4, further comprising at least one latch device and at least one striker plate, wherein the at least one striker plate includes a cavity therein, wherein the at least one striker plate includes a projection within the cavity in the striker plate, wherein the at least one latch device includes a stop surface that is operative to contact the projection and prevent pivoting of the drop gate into an interior space of the crib, wherein the cavity in the at least one striker plate includes sufficiently large spaces above and below the projection to receive a finger of a child therein without the finger being pinched by the stop surface.

10. The crib according to claim 1 wherein each panel includes a panel portion substantially covering panel.

11. The crib according to claim 1 wherein the first and second panels or the third and fourth panels or both the first and second panels and the third and fourth panels are pivotally connected to each other by at least one butler hinge.

12. The crib according to claim 1 wherein in the vertical position, the mattress and the first mattress support member can be located in the space bounded by the second wall, the third and fourth vertical members, and the first and fourth panels when the crib is in the folded position.

13. The crib according to claim 1 wherein when the crib is in the folded position, the second wall, third and fourth vertical members, and the first and fourth panels are configured to snugly support the mattress in the vertical position.

14. A crib comprising:

first, second, third, and fourth walls configured to bound an interior space that is operative to support a mattress therein;

wherein the third wall comprises first and second panels, wherein the fourth wall comprises third and fourth panels, wherein the first and second panels are pivotally connected to each other and the third and fourth panels are pivotally connected to each other to enable the crib to be configured between a folded position for storage and an extended position for use;

wherein the first wall includes:

a stationary portion;

a drop gate, wherein the drop gate includes opposed side ends;

wherein the drop gate pivots relative to the stationary portion between an upper closed position and a lower open position;

wherein the first and second panels or the third and fourth panels or both the first and second panels and the third and fourth panels are connected to each other by at least one first hinge, wherein the at least one first hinge comprises first and second hinge members that are pivotally connected to each other, wherein the at least one first hinge includes at least one boss integrally formed in one piece with the first hinge member, wherein the boss extends into a hole formed in one of the panels, wherein the at least one boss includes a bore for securely receiving a fastener to secure the first hinge member to the panel, wherein the at least one boss includes at least one support rib, wherein the at least one support rib is configured to angle outwardly towards the first hinge member to create a wedge effect to allow penetration of the at least one support rib into the panel.

15. The crib according to claim 14 further comprising:

first, second, third and fourth vertical members, wherein the first and second vertical members are positioned adjacent opposed side ends of the drop gate when the drop gate is in the closed position, wherein the third and fourth vertical members are positioned at least in close proximity to the opposed side ends of the second wall, wherein the third and fourth walls are opposite each other, wherein the first panel of the third wall is in operative pivotal connection with the first vertical member and the second panel of the third wall is in operative pivotal connection with the third vertical member, wherein the fourth panel of the fourth wall is in operative pivotal connection to the fourth vertical member and the third panel of the fourth wall is in operative pivotal connection to the second vertical member;

a first mattress support member;

a second mattress support member, wherein the second mattress support member is connected to the third and fourth vertical members and extends between the third and fourth vertical members, wherein the first mattress support member is pivotally connected to the second mattress support member by at least one second hinge to enable the first mattress support member to pivot between a horizontal position and a vertical position, wherein in the horizontal position, the first mattress support member prevents the crib from being in the folded position; and a headboard removably mounted to one of the first and second walls, wherein one of the headboard and one of the first and second walls includes a pair of tongues and a channel extending between the tongues, wherein the other one of the headboard and the one of the first and second walls includes a pair of recesses and at least one rib extending between the recesses, wherein each of the recesses is configured to receive a respective tongue and the channel is configured to receive the at least one rib to mount the headboard to the one of the first and second walls.

16. A crib comprising:

first, second, third, and fourth walls configured to bound an interior space that is operative to support a mattress therein;

wherein the third wall comprises first and second panels, wherein the fourth wall comprises third and fourth panels, wherein the first and second panels are pivotally connected to each other and the third and fourth panels are pivotally connected to each other to enable the crib to be configured between a folded position for storage and an extended position for use;

wherein the first wall includes:

a stationary portion;

a drop gate, wherein the drop gate includes opposed side ends;

wherein the drop gate pivots relative to the stationary portion between an upper closed position and a lower open position;

first, second, third and fourth vertical members, wherein the first and second vertical members are positioned adjacent opposed side ends of the drop gate when the drop gate is in the closed position, wherein the third and fourth vertical members are position at least in close proximity to the opposed side ends of the second wall, wherein the third and fourth walls are opposite each other, wherein the first panel of the third wall is in operative pivotal connection with the first vertical member and the second panel of the third wall is in operative pivotal connection with the third vertical member, wherein the fourth panel of the fourth wall is in operative pivotal connection to the fourth vertical member and the third panel of the fourth wall is in operative pivotal connection to the second vertical member;

a first mattress support member; and a second mattress support member, wherein the second mattress support member is connected to the third and fourth vertical members and extends between the third and fourth vertical members, wherein the first mattress support member is pivotally connected to the second mattress support member by at least one first hinge to enable the first mattress support member to pivot between a horizontal position and a vertical position, wherein in the horizontal position, the first mattress support member prevents the crib from being in the folded position, wherein the second mattress support member is fixed to the third vertical member at a height that is less than approximately one third of the height of the third vertical member, wherein the second mattress support member is fixed to the fourth vertical member at a height that is less than approximately one third of the height of the fourth vertical member, wherein the second mattress support member extends continuously from the third vertical member to the fourth vertical member.

* * * * *